US009109593B2

(12) United States Patent
Oikawa et al.

(10) Patent No.: US 9,109,593 B2
(45) Date of Patent: Aug. 18, 2015

(54) HIGH PRESSURE PUMP

(75) Inventors: Shinobu Oikawa, Kariya (JP); Takayuki Watanabe, Okazaki (JP); Hiroshi Inoue, Anjo (JP)

(73) Assignee: DENSO CORPORATION, Kariya (JP)

( * ) Notice: Subject to any disclaimer, the term of this patent is extended or adjusted under 35 U.S.C. 154(b) by 135 days.

(21) Appl. No.: 13/586,087

(22) Filed: Aug. 15, 2012

(65) Prior Publication Data

US 2013/0052064 A1 Feb. 28, 2013

(30) Foreign Application Priority Data

| | | |
|---|---|---|
| Aug. 23, 2011 | (JP) | 2011-181464 |
| Aug. 23, 2011 | (JP) | 2011-181465 |
| Jul. 23, 2012 | (JP) | 2012-162494 |
| Jul. 23, 2012 | (JP) | 2012-162523 |

(51) Int. Cl.
*F04B 11/00* (2006.01)
*F04B 53/00* (2006.01)

(52) U.S. Cl.
CPC ..... *F04B 53/001* (2013.01); *F04B 11/0016* (2013.01)

(58) Field of Classification Search
CPC .... F04B 11/0016; F04B 53/001; F04B 11/00; F04B 11/0008
USPC ..... 417/540
See application file for complete search history.

(56) References Cited

U.S. PATENT DOCUMENTS

| | | | | |
|---|---|---|---|---|
| 6,053,208 | A | 4/2000 | Onishi et al. | |
| 6,079,450 | A | 6/2000 | Onishi et al. | |
| 2009/0288639 | A1 | 11/2009 | Usui et al. | |
| 2010/0209274 | A1 * | 8/2010 | Oikawa et al. | 417/540 |

FOREIGN PATENT DOCUMENTS

| | | |
|---|---|---|
| JP | 2000-266182 | 9/2000 |
| JP | P4235647 | 3/2009 |
| JP | P2011-099426 A | 5/2011 |

OTHER PUBLICATIONS

Office Action (2 pages) dated Nov. 14, 2013, issued in corresponding Japanese Application No. 2012-162494 and English translation (3 pages).

(Continued)

*Primary Examiner* — Charles Freay
*Assistant Examiner* — Philip Stimpert
(74) *Attorney, Agent, or Firm* — Nixon & Vanderhye P.C.

(57) ABSTRACT

A high-pressure pump has: a plunger; a pump body; a cover member for covering the pump body and forming a fuel chamber; a pulsation damper body constructed of upper and lower diaphragms with their peripheral edge portions joined and for reducing pressure pulsation in the chamber, the upper and lower diaphragms trapping gas having a given pressure between them; an upper support member having an upper ring-shaped part and an upper support body, the upper ring-shaped part being joined to the peripheral edge portion of the upper diaphragm, the upper support body extending from the upper ring-shaped part and abutting on the cover member; and a lower support member having a lower ring-shaped part and a lower support body, the lower ring-shaped part being joined to the peripheral edge portion of the lower diaphragm, the lower support body extending from the lower ring-shaped part and abutting on the pump body.

9 Claims, 45 Drawing Sheets

(56) References Cited

OTHER PUBLICATIONS

Office Action (2 pages) dated Nov. 14, 2013, issued in corresponding Japanese Application No. 2012-162523 and English translation (3 pages).

Office Action (2 pages) dated Jun. 27, 2014, issued in corresponding Japanese Application No. 2012-162494 and English translation (3 pages).

Office Action (2 pages) dated Jun. 27, 2014, issued in corresponding Japanese Application No. 2012-162523 and English translation (2 pages).

* cited by examiner

HIGH PRESSURE PUMP

CROSS REFERENCE TO RELATED APPLICATIONS

This application is based on Japanese Patent Application No. 2011-181464 filed on Aug. 23, 2011, Japanese Patent Application No. 2011-181465 filed on Aug. 23, 2011, Japanese Patent Application No. 2012-162494 filed on Jul. 23, 2012, and Japanese Patent Application No. 2012-162523 filed on Jul. 23, 2012, the disclosures of which are incorporated herein by reference.

TECHNICAL FIELD

The present disclosure relates to a high pressure pump.

BACKGROUND

Traditionally, there has been known a high pressure pump for pressurizing fuel sucked from a fuel tank by a low pressure pump and for supplying the pressurized fuel to an internal combustion engine. The high pressure pump has a pulsation damper for reducing a pressure pulsation in a fuel chamber communicating with a pressurizing chamber in which the fuel is pressurized. In the pulsation damper, the peripheral edge portions of two diaphragms are welded to each other and gas having a pressure equal to or higher than the atmospheric pressure is trapped inside the two diaphragms. The two diaphragms are displaced according to a pressure change in the fuel chamber to thereby change the volume of the fuel chamber, whereby a pressure pulsation of the fuel is damped.

A pulsation damper described in Japanese Patent No. 423567 is fitted in a fuel chamber in a state where the peripheral edge portions of diaphragms constructing the pulsation damper are sandwiched by an upper support member and a lower support member. In this way, the pulsation damper is inhibited from being displaced in a direction in which the peripheral edge portions of two diaphragms constructing the pulsation damper are separated from each other by a pressure pulsation in the fuel chamber.

However, the pulsation damper described in Japanese Patent No. 423567 is liable to present the following problems (1), (2), and (3). (1) In the upper support member and the lower support member, in order to prevent a stress developed by the displacement of the diaphragm from being applied to the welded portion of joining the peripheral edge portions thereof, end faces abutting on the peripheral edge portions of the diaphragms need to be formed in parallel to the peripheral edge portions For this reason, the working cost of the upper support member and the lower support member is increased. (2) In the upper support member and the lower support member, in order to prevent the stress developed by the displacement of the diaphragm from being applied to the welded portion of the peripheral edge portions thereof, the peripheral edge portions of the diaphragms need to be pressed over the entire circumference by the same load. For this reason, in the upper support member and the lower support member, an area of a conical portion of connecting an end face abutting on an inner wall of the fuel chamber with an end face abutting on the peripheral edge portion of the diaphragm is made large. For this reason, the flow of the fuel in the fuel chamber is prevented by the upper support member and the lower support member. (3) In order to prevent a twisting force from being applied to the diaphragms, the upper support member and the lower support member need to be fitted to the diaphragms in such a way that the center of the upper support member is aligned with the center of the lower support member. For this reason, the working accuracy and the fitting accuracy of the upper support member and the lower support member need to be improved and hence a manufacturing cost is increased. Further, in the case where the upper support member and the lower support member are formed by a press, it is difficult to decrease a manufacturing tolerance in such a way that the center of the upper support member is aligned with the center of the lower support member.

SUMMARY

According to one mode of the present disclosure, a high pressure pump having a pulsation damper body is characterized in that an upper support body extending from an upper ring-shaped part joined to a peripheral edge portion of the pulsation damper body abuts on a cover member and in that a lower support body extending from a lower ring-shaped part joined to the peripheral edge portion abuts on a pump body.

According to this mode, the upper ring-shaped part and the lower ring-shaped part can prevent a stress developed by a displacement of a diaphragm from being applied to a welded portion of the peripheral edge portion. To this end, the upper support body extending from the upper ring-shaped part is made to abut on the cover member and the lower support body extending from the lower ring-shaped part is made to abut on the pump body, whereby a pulsation damper can be fitted in a fuel chamber. Hence, the size of the support body can be decreased and the flow of the fuel in the fuel chamber can be made better, and the pulsation damper can be fitted in the fuel chamber by a simple construction.

According to another mode of the present disclosure, a high pressure pump having a pulsation damper body is characterized in that a support body extending from at least one of an upper ring-shaped part and a lower ring-shaped part, which are joined to a peripheral edge portion of a pulsation damper body, is engaged with a pump body or a cover member.

According this mode, the upper ring-shaped part and the lower ring-shaped part can prevent a stress developed by the displacement of the diaphragm from being applied to the welded portion of the peripheral edge portion. To this end, the support body extending from at least one of the upper ring-shaped part and the lower ring-shaped part is engaged with the pump body or the cover member, whereby a pulsation damper can be fitted in a fuel chamber. Hence, the size of the support body can be decreased and the flow of the fuel in the fuel chamber can be made better, and the pulsation damper can be fitted in the fuel chamber by a simple construction.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Hereinafter, a plurality of embodiments will be described on the basis of the drawings.

(First Embodiment)

Figure 1:
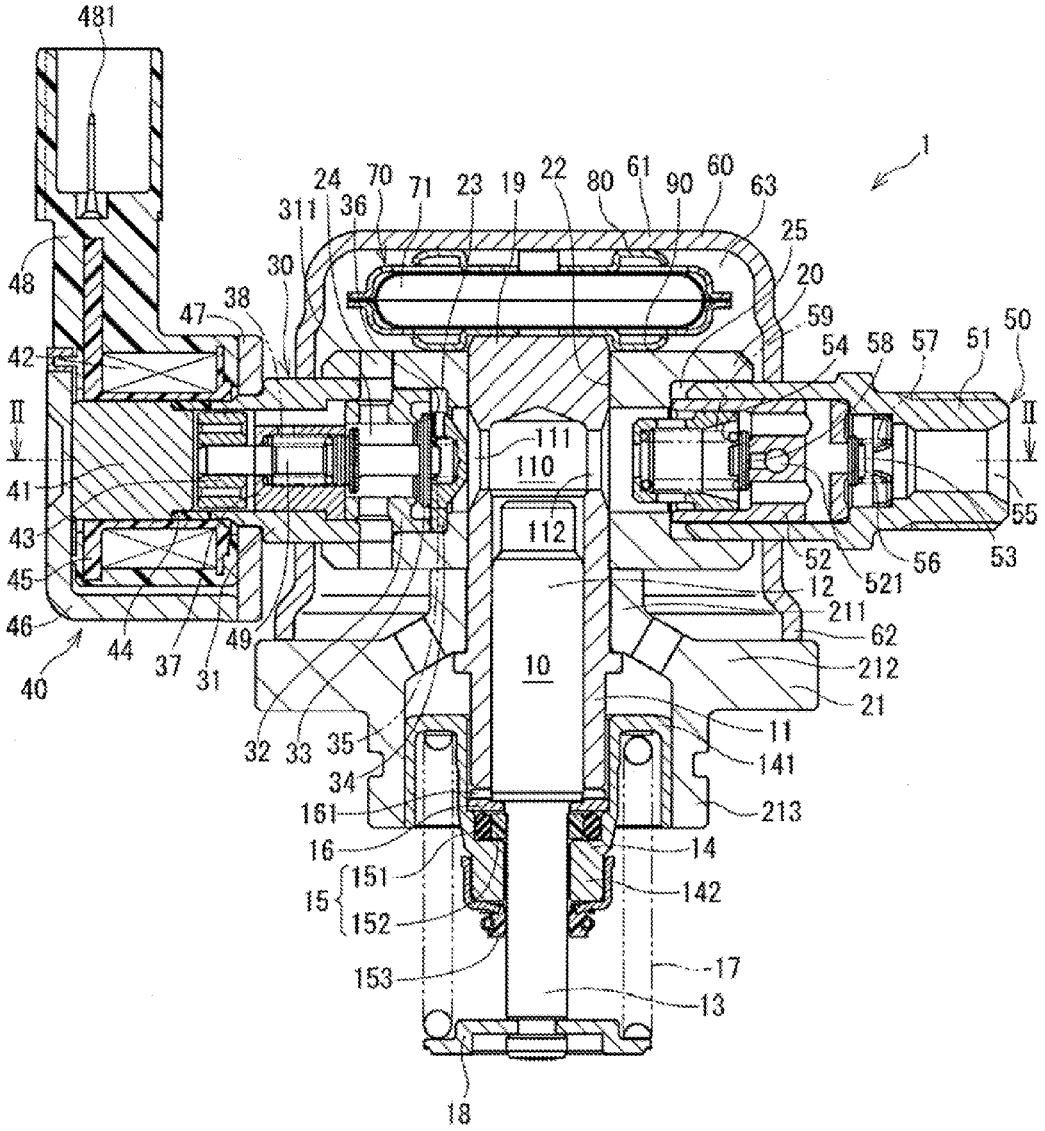
FIG. 1 is a section view of a high pressure pump according to a first embodiment.

A high pressure pump 1 according to a first embodiment will be shown in FIGS. 1 to 6B. The high pressure pump 1 pressurizes fuel sucked from a fuel tank (not shown) by a low pressure pump and pressure-feeds the fuel to a fuel rail (not shown). To the fuel rail is coupled an injector for injecting the fuel into a cylinder of an internal combustion engine. Hereinafter, the embodiment will be described on the assumption that an upper side in FIG. 1 is an "upper" side and that a lower side in FIG. 1 is a "lower" side. However, it is not intended to limit a direction in which the high pressure pump is set.

Figure 2:
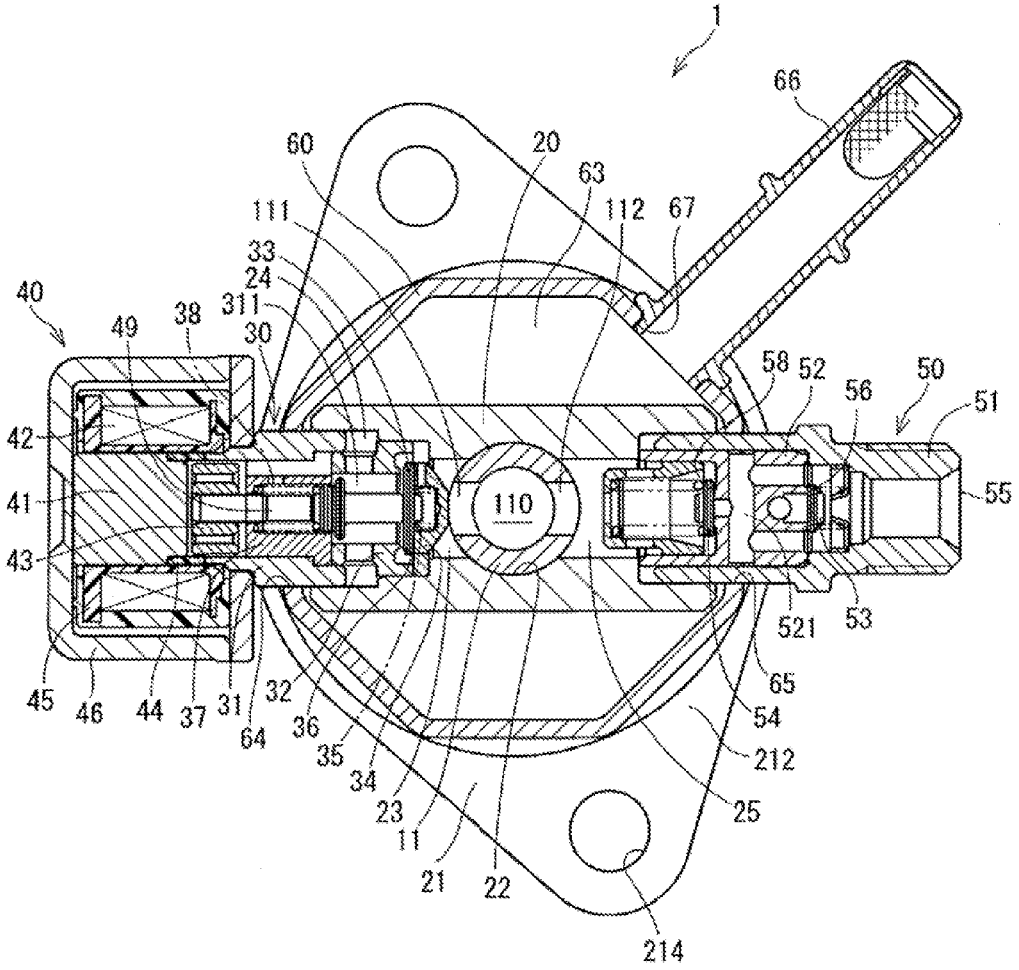
FIG. 2 is a section view taken on a line II-II in FIG. 1.

The high pressure pump 1, as shown in FIG. 1 and FIG. 2, includes a plunger 10, a cylinder part 11, an upper pump body 20 and a lower pump body 21 which form a pump body, a cover member 60, a pulsation damper 70, and the like. Here, the cylinder part 11 and the pump body may be integrally constructed. The plunger 10 is formed in the shape of a solid cylinder and is set inside the cylinder part 11 in such a way as to reciprocate in an axial direction. In the plunger 10, a large-diameter part 12 and a small-diameter part 13, whose outside diameter is smaller than the outside diameter of the large-diameter part 12, are integrally formed. The large-diameter part 12 slides on an inner wall of the cylinder part 11. The small-diameter part 13 is formed below the large-diameter part 12.

The cylinder part 11 is formed in the shape of a cylinder having a closed bottom end. A pressurizing chamber 110 is formed of an inner wall on the bottom side of the cylinder part 11 and an outer wall of the large-diameter part 12 of the plunger 10. The cylinder part 11 has a suction port 111, which makes the pressurizing chamber 110 communicate with a supply part 30, and a discharge port 112, which makes the pressurizing chamber 110 communicate with a discharge part 50.

The lower pump body 21 is set outside in a radial direction of the cylinder part 11 and has a cylinder holding part 211, an engine fixing part 212, and a fitting part 213. The cylinder holding part 211 is formed in a cylindrical shape and abuts on an outer wall outside in the radial direction of the cylinder part 11. The engine fixing part 212 extends in the shape of a ring and outward in the radial direction from a lower portion of the cylinder holding part 211. In this engine fixing part 212 is formed a fixing hole 214 by which the high pressure pump 1 can be fixed to an engine head. The fitting part 213 extends downward in a cylindrical shape from the engine fixing part 212. The fitting part 213 can be fitted in a high pressure pump fixing hole of the engine head (not shown).

An oil seal holder 14 is set inside the fitting part 213. The oil seal holder 14 is formed nearly in a cylindrical shape and has a press-in part 141 pressed in the inner wall of the fitting part 213 and a base part 142 positioned at the outer periphery of the small-diameter part 13. A ring-shaped seal 15 is set between the oil seal holder 14 and the small-diameter part 13. The seal 15 is constructed of a Teflon ring 151 (Teflon is a trademark) set inside in the radial direction and an O ring 152 set outside in the radial direction. The thickness of a fuel oil film around the small-diameter part 13 of the plunger 10 is controlled by the seal 15 to inhibit a leak of the fuel to the engine. Further, the oil seal holder 14 has an oil seal 153 at its tip. The thickness of the oil film around the small-diameter part 13 of the plunger 10 is controlled by the oil seal 153 to inhibit a leak of the oil into the high pressure pump 1 from the engine.

A plunger stopper 16 is formed in the shape of a disk and is set between an end portion of the cylinder part 11 and the seal 15. The plunger stopper 16 has the small-diameter part 13 of the plunger 10 passed through a hole formed in its center. The plunger stopper 16 has a plurality of grooves 161 extending to the outside in the radial direction from the hole formed in the center. A variable volume chamber is formed by a cylindrical space surrounded by a stepped face of the large-diameter part 12 and the small-diameter part 13 of the plunger 10, the outer wall of the small-diameter part 13, the inner wall of the cylinder part 11, and the plunger stopper 16. A plunger spring 17 has one end engaged with a spring seat 18 set on an end portion of the plunger 10 and has the other end engaged with a press-in part 141 of the oil seal holder 14. The plunger spring 17 biases the end portion of the plunger 10 to a camshaft (not shown) via a tappet (not shown), whereby the plunger 10 is reciprocated in an axial direction according to a profile of the camshaft. The volume of the pressurizing chamber 110 and the volume of the variable volume chamber are changed by the reciprocation movement of the plunger 10.

The upper pump body 20 is formed nearly in the shape of a rectangular solid and is set above the lower pump body 21. The upper pump body 20 has a cylinder insertion hole 22, the supply part 30, and the discharge part 50. In the upper pump body 20, an inner wall of the cylinder insertion hole 22 is pressed onto an outer wall outside in the radial direction of the cylinder part 11. The supply part 30 is constructed of a suction valve body 31, a seat body 32, a suction valve member 33, a first spring holder 34, a first spring 35, an electromagnetic drive part 40, and the like. The suction valve body 31 is formed nearly in a cylindrical shape and is pressed in a suction passage 23 formed in the upper pump body 20. The cylindrical seat body 32 is set on the pressurizing chamber side of the suction valve body 31. The seat body 32 has a suction chamber 311 formed inside. The suction chamber 311 communicates with a fuel chamber 63 outside the upper pump body 20 through a communication passage 24 formed in the upper pump body 20. The seat body 32 has a valve seat 36 for a suction valve on the pressurizing chamber side. The suction valve member 33 is set on the pressurizing chamber side of the valve seat 36 for a suction valve and can be seated on or separated from the valve seat 36 for a suction valve. One end of the first spring 35 abuts on a first spring holder 34 set on the pressurizing chamber side of the suction valve member 33 and the other end of the first spring 35 abuts on the suction valve member 33. The first spring 35 biases the suction valve member 33 in a direction to close the valve (in the left direction in FIG. 1).

The electromagnetic drive part 40 has a fixed core 41, a coil 42, a movable core 43, and the like. The fixed core 41 is set on a side opposite to the pressurizing chamber 110 of the suction valve body 31. A cylindrical member 44 formed of a non-magnetic material is set between the fixed core 41 and the suction valve body 31. The cylindrical member 44 inhibits a short circuit of a magnetic flux from being developed between the fixed core 41 and the suction valve body 31. The coil 42 is wound around a bobbin 45 set outside in the radial direction of the fixed core 41. The outside of the coil 42 is covered with a cylindrical case 46 and a flange 47. A connector 48 is extended outward in the radial direction of the case 46. When electricity is passed through the coil 42 via a terminal 481 of the connector 48, the coil 42 generates a magnetic field. The movable core 43 nearly shaped like a cylinder is set on the pressurizing chamber side of the fixed core 41 and inside the suction valve body 31 in such a way as to reciprocate. The movable core 43 has a needle 49 fixed thereto. The needle 49 is supported by a second spring holder 37 set inside the suction valve body 31 in such a way as to reciprocate. An end portion on the pressurizing chamber side of the needle 49 can abut on the suction valve member 33. A second spring 38 set inside the second spring holder 37 biases the needle 49 in a direction to open the valve (in the right direction in FIG. 1) by a force stronger than a force by which the first spring 35 biases the suction valve member 33 in a direction to close the valve.

When the electricity is not passed through the coil 42, the movable core 43 and the fixed core 41 are separated from each other by a biasing force of the second spring 38. In this way, the needle 49 integrated with the movable core 43 is moved to the pressurizing chamber side to thereby press the suction valve member 33 by an end face of the needle 49, whereby the suction valve member 33 is opened. When the electricity is passed through the coil 42, a magnetic flux flows through a magnetic circuit formed of the fixed core 41, the movable core 43, the flange 47, and the case 46, and hence the movable core 43 is magnetically attracted to the fixed core 41 side against the biasing force of the second spring 38. In this way, the needle 49 releases a force of pressing the suction valve member 33.

The discharge part 50 is constructed of a fuel discharge housing 51, a discharge valve body 52, a discharge valve member 53, a relief valve member 54, and the like. The fuel discharge housing 51 is formed nearly in a cylindrical shape and is pressed in a discharge passage 25 formed in the upper valve body 20. Inside the fuel discharge housing 51 is set the discharge valve body 52. The discharge valve body 52 has a valve seat 56 for a discharge valve on a fuel outlet 55 side. The discharge valve member 53 is set on the fuel outlet 55 side of the discharge valve body 52 and can be seated on and separated from the valve seat 56 for a discharge valve. A discharge valve spring 57 biases the discharge valve member 53 to the valve seat 56 for a discharge valve. The discharge valve body 52 has a valve seat 58 for a relief valve on the pressurizing chamber side. The relief valve member 54 is set on the pressurizing chamber side of the valve seat 58 for a relief valve and can be seated on and separated from the valve seat 58 for a relief valve. A relief valve spring 59 biases the relief valve member 54 to the valve seat 58 for a relief valve. A relief passage 521 formed inside the valve seat 58 for a relief valve communicates with a fuel outlet 55.

The cover member 60 is formed in the shape of a cylinder having a closed bottom end and has a bottom part 61 and a cylinder part 62 extending in one direction from an outer edge of the bottom part 61. The cylinder part 62 is hermetically joined to the engine fixing part 212 of the lower pump body 21 by welding or the like. The cover member 60 covers the upper pump body 20 and the lower pump body 21 and forms a fuel chamber 63 inside itself. The fuel chamber 63 communicates with the pressurizing chamber 110 through a communication passage 24 of the upper pump body 20 and a suction chamber 311. As shown in FIG. 2, the cover member 60 has the cylinder part 62 formed nearly in an octagonal shape in cross section and has a first insertion hole 64 into which the supply part 30 is inserted, a second insertion hole 65 into which the discharge part 50 is inserted, and a third insertion hole 67 into which a fuel inlet 66 is inserted. The fuel inlet 66 supplies the fuel sucked from a fuel tank (not shown) by a low-pressure pump (not shown) to the fuel chamber 63. The first insertion hole 64 and the supply part 30 of the cover member 60 are hermetically joined to each other by welding or the like. Similarly, the second insertion hole 65 and the discharge part 50, and the third insertion hole 67 and the fuel inlet 66, are hermetically joined to each other, respectively, by the welding or the like. When the fuel is sucked into the pressurizing chamber 110 from the fuel chamber 63 via the communication passage 24 and the suction chamber 311 by the reciprocation movement of the plunger 10 or when the fuel is discharged to the fuel chamber 63 from the pressurizing chamber 110 via the suction chamber 311 and the communication passage 24, a fuel pressure pulsation is generated in the fuel chamber 63.

Figure 3:
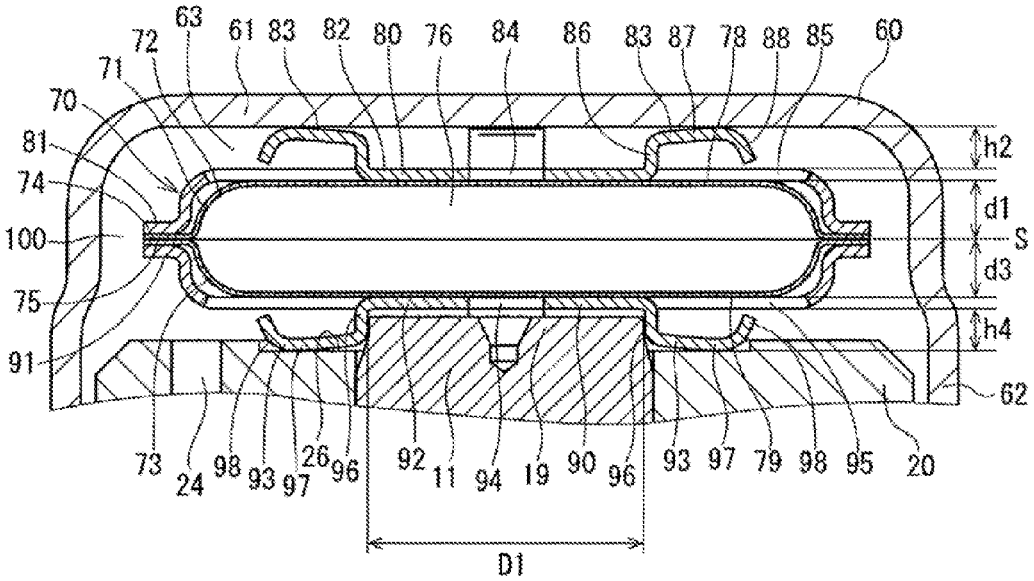
FIG. 3 is a section view, on an enlarged scale, of a main portion of the high pressure pump according to the first embodiment.
Figure 4A:
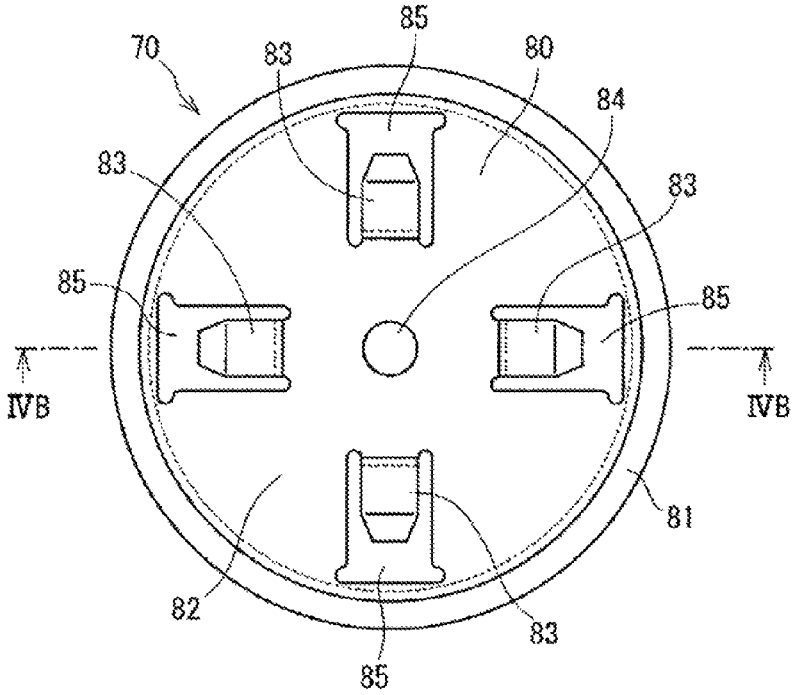
FIG. 4A is a plan view of a state where a pulsation damper to be set in the high pressure pump according to the first embodiment is not yet fitted in a fuel chamber.
Figure 4B:
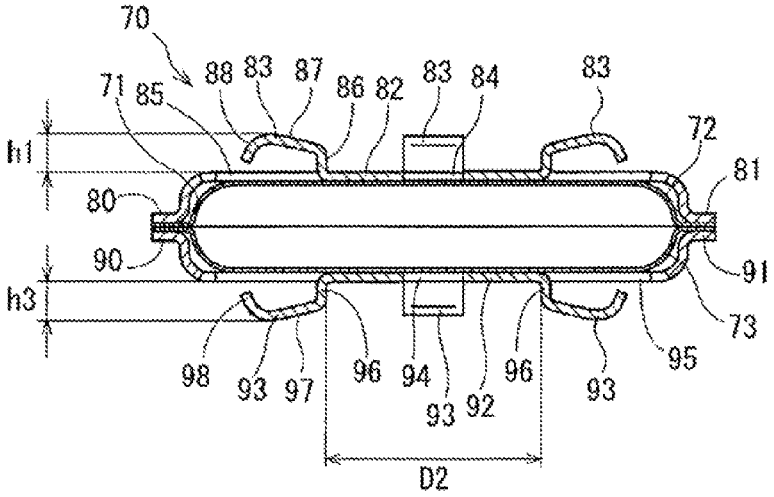
FIG. 4B is a section view taken on a line IVB-IVB in FIG. 4A.
Figure 5:
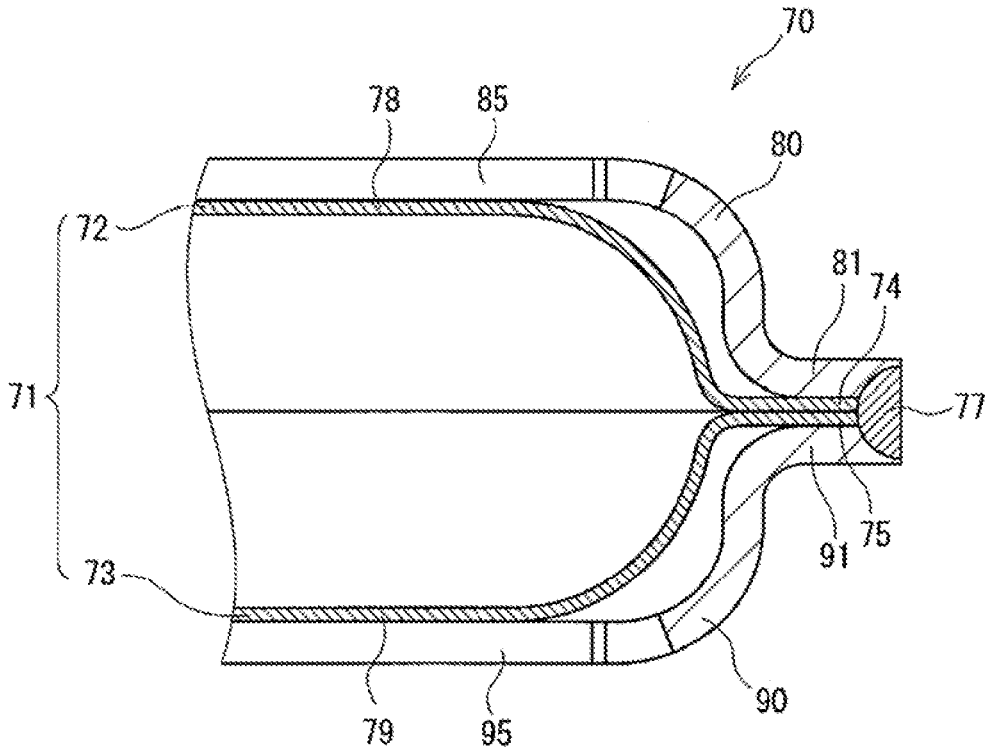
FIG. 5 is a section view, on an enlarged scale, of the pulsation damper to be set in the high pressure pump according to the first embodiment.

As shown in FIG. 3 and FIG. 4, a pulsation damper 70 is set between the upper pump body 20 and the cover member 60. The pulsation damper 70 has a pulsation damper body 71, an upper support member 80, and a lower support member 90 and is constructed as a sub-assembly. The pulsation damper body 71 is constructed of two diaphragms 72, 73. Each of the diaphragms 72, 73 is formed in the shape of a plate by press-working a metal plate, for example, a stainless steel plate having a high proof stress and a high fatigue limit. In the pulsation damper body 71, the peripheral edge portions 74, 75 of the two diaphragms 72, 73 are joined to each other and gas having a given pressure is trapped in a closed space 76 formed inside the joined diaphragms 72, 73. In the pulsation damper body 71, the two diaphragms 72, 73 are elastically deformed according to a change in a fuel pressure in the fuel chamber 63 to thereby reduce a fuel pressure pulsation in the fuel chamber 63. By adequately setting the thickness, material, and outside diameter of the two diaphragms 72, 73 and the pressure of the gas trapped in the closed space 76 according to endurance or the other required performance, a spring constant of the pulsation damper body 71 is set. A pulsation frequency and a pulsation damping capacity that are reduced by the pulsation damper body 71 are determined by the spring constant. When the thickness of the diaphragm is thin, a pulsation damping effect of the pulsation damper body 71 is improved. Further, when the movable parts 78, 79 of the pulsation damper body 71 have a large outside diameter, the pulsation damping effect of the pulsation damper body 71 is improved. Here, the movable parts 78, 79 are parts that are nearly shaped like a disk and that can be displaced when the pulsation damper body 71 reduces the fuel pressure pulsation in the fuel chamber 63.

The upper support member 80 has an upper ring-shaped part 81, an upper cover part 82, and upper support bodies 83 and is integrally formed by press-working a metal plate, for example, a stainless steel plate having a given rigidity. A plate forming the upper support member 80 is referred to as a first plate. The upper ring-shaped part 81 is formed parallel to the peripheral edge portion 74 of the upper diaphragm 72 and in the shape of a ring. The upper ring-shaped part 81 of the upper support member 80, the peripheral edge portion 74 of the upper diaphragm 72, the peripheral edge portion 75 of the lower diaphragm 73, and a lower ring-shaped part 91 of the lower support member 90 are joined to each other continuously over an entire circumference in a peripheral direction by the laser welding. A welding seam 77 will be shown in FIG. 5. The welding seam 77 is formed over the entire circumference of the pulsation damper 70.

The upper cover part 82 extends along the upper diaphragm 72 from the upper ring-shaped part 81. The upper cover part 82 is formed in the shape of a plane nearly parallel to the movable part 78 of the upper diaphragm 72. Here, a plane including the abutting faces of the peripheral edge portions 74, 75 of the two diaphragms 72, 73 is assumed to be an imaginary plane S. A distance between the imaginary plane S in the case where an atmospheric pressure in the closed space 76 of the pulsation damper body 71 is equal to an atmospheric pressure outside the pulsation damper body 71 and a center of an outside end face of the movable part 78 is assumed to be a distance d1. Further, a distance between an end face on the upper diaphragm side of the upper cover part 82 and the imaginary plane S is assumed to be a distance d2 (not shown). In this case, there is a relationship such that d2>d1. The upper cover part 82 inhibits the upper diaphragm 72 from bulging to a bottom side of the cover member 60. The upper cover part 82 has a circular fuel passage 84 in the center and has four fuel passages 85 in the peripheral direction. These fuel passages 84, 85 are formed by press-working the first plate.

The four upper support bodies 83 are formed at the same time of press-working the fuel passages 84, 85 or by bending conducted after the press-working. In other words, a hole formed when the upper support body 83 is cut out of the first plate becomes the fuel passage 85. The upper support body 83 connects with the upper cover part 82 on the cover member side of the movable part 78 of the upper diaphragm 72 and extends outward in the radial direction from a position where the upper support body 83 connects with the upper cover part 82. Specifically, the upper support body 83 has its one end connected with an inner peripheral side of the upper cover part 82 (in detail, a position inside half the radius of the upper diaphragm 72 and outside the fuel passage 84 in the center) and has the other end extended to an outer peripheral side of the upper cover part 82. The upper support body 83 has a vertical part 86 which extends nearly vertically to a bottom portion side of the cover member 60 from the upper cover part 82, an upper abutting part 87 which bends short of the cover member 60 to the outside in the radial direction from an end portion on a cover member side of the vertical part 86 and extends to the outside in the radial direction, and a curving part 88 which curves to an upper diaphragm side from an end portion outside in the radial direction of the upper abutting part 87. In the upper support body 83, the upper abutting part 87 abuts on an inner wall of the cover member 60. The upper abutting part 87 abuts on the cover member 60 on the outside in the radial direction and has a clearance formed between a portion inside in the radial direction and the cover member 60. In this state, a distance between the upper abutting part 87 of the upper support body 83 and the upper cover part 82 is assumed to be h1. On the other hand, in the state where the pulsation damper 70 is set in the fuel chamber 63, a distance between the upper abutting part 87 of the upper support body 83 and the upper cover part 82 is assumed to be h2. In this case, there is a relationship such that h1>h2. A load to be applied to the upper support body 83 is set by the material and the thickness of the upper support body 83, the angle formed by the vertical part 86 and the upper abutting part 87, and a distance of (h1−h2). In other words, the upper support body 83 has a spring force of pressing the cover member 60 to a side opposite to the pump body.

The lower support member 90 has substantially the same construction as the upper support body 80. The lower support member 90 has a lower ring-shaped part 91, a lower cover part 92, and lower support bodies 93 and is integrally formed by press-working a plate made of metal, for example, stainless steel having a given rigidity. The plate forming the lower support member 90 is referred to as a second plate. The lower ring-shaped part 91 is formed parallel to the peripheral edge portion 75 of the lower diaphragm 73 and in the shape of a ring. The lower cover part 92 extends along the lower diaphragm 73 from the lower ring-shaped part 91. The lower cover part 92 is formed in the shape of a plane nearly parallel to the movable part 79 of the lower diaphragm 73. A distance between the imaginary plane S in the case where the atmospheric pressure in the closed space 76 of the pulsation damper body 71 is equal to the atmospheric pressure outside the pulsation damper body 71 and a center of an outside end face of the movable part 79 is assumed to be d3. Further, a distance between an end face on a lower diaphragm 73 side of the lower cover part 92 and the imaginary plane S is assumed to be d4 (not shown). In this case, there is a relationship such that d4>d3. The lower cover part 92 inhibits the lower diaphragm 72 from bulging to an upper body side. The lower cover part 92 has a circular fuel passage 94 in the center and has four fuel passages 95 in the peripheral direction. These fuel passages 94, 95 are formed by press-working the second plate member.

The four lower support bodies 93 are formed at the same time of press-working the fuel passages 94, 95 or by bending conducted after the press-working. In other words, a hole formed when the lower support body 93 is cut out of the second plate becomes the fuel passage 95. The lower support body 93 connects with the lower cover part 92 on a pump body side of the movable part 79 of the lower diaphragm 73 and extends outward in the radial direction from a position where the lower support part 93 connects with the lower cover part 92. Specifically, the lower support body 93 has its one end connected with an inner peripheral side of the lower cover part 92 (in detail, a position inside half the radius of the lower diaphragm 73 and outside the fuel passage 94 in the center) and has the other end extended to an outer peripheral side of the lower cover part 92. The lower support body 93 has a cylinder abutting part 96 which extends nearly vertically to an upper pump body side from the lower cover part 92, a lower abutting part 97 which bends short of the upper pump body 20 to the outside in the radial direction from an end portion on an upper pump body side of the cylinder abutting part 96 and extends to the outside in the radial direction, and a curving part 98, which curves to the lower diaphragm 73 from an end portion outside in the radial direction of the lower abutting part 97.

The cylinder abutting part 96 extends in the axial direction of the cylinder part 11 along an outer wall of a projected portion 19 of the cylinder part 11 projecting to a fuel chamber side from the upper pump body 20. The projected portion 19 of the cylinder part 11 is inserted into between four cylinder abutting parts 96. An outside diameter D1 of the projected portion 19 of the cylinder part 11 is assumed to be an outside diameter D1. The outside diameter D1 of the projected portion 19 of the cylinder part 11 is formed in a smaller diameter than an outside diameter of a portion of a cylinder body pressed in the upper pump body 20. A distance between end faces inside in the radial direction of the two cylinder abutting parts 96 opposed to each other across the cylinder part 11 is assumed to be a distance D2. There is a relationship such that D1≤D2. In this way, the cylinder abutting parts 96 are engaged with the outer wall outside in the radial direction of the projected portion 19 of the cylinder part 11. Thus, the pulsation damper 70 is inhibited from moving in the radial direction.

The lower abutting part 97 is fitted in a depressed groove 26 made in the upper pump body 20. The lower abutting part 97 abuts on the depressed groove 26 of the upper pump body 20 on the outside in the radial direction and has a small clearance formed between its inside portion in the radial direction and the depressed groove 26. In this state, a distance between the lower abutting part 97 and the low cover part 92 is assumed to be h3. On the other hand, in the state where the pulsation damper 70 is set in the fuel chamber 63, a distance between the lower abutting part 97 and the lower cover part 92 is assumed to be h4. In this case, there is a relationship such that h3>h4. A load to be applied to the lower support body 93 is set by the material and the thickness of the lower support body 93, the angle formed by the cylinder abutting part 96 and the lower abutting part 97, and a distance of (h3−h4). In other words, the lower support body 93 has a spring force of pressing the upper pump body 20 to a side opposite to the cover member 60. A space 100 is formed continuously in the peripheral direction between the cylinder part 62 of the cover member 60 and the pulsation damper body 71. The fuel flows to the upper diaphragm 72 and the lower diaphragm 73 via the space 100. Thus, the fluid resistance of the fuel chamber 63 is reduced and the pulsation damper 70 can produce a high pulsation damping effect.

Next, the action of the high pressure pump 1 will be described.

(I) Suction Process

When the plunger 10 is moved down from a top dead center to a bottom dead center by the rotation of a camshaft, the volume of the pressurizing chamber 110 is increased and hence the pressure of the fuel is decreased. A discharge valve member 53 of the discharge part 50 is seated on the valve seat 56 for a discharge valve to close the fuel outlet 55. At this time, the passing of electricity through the coil 42 is stopped, so that the movable core 43 and the needle 49 are moved toward the pressuring chamber 110 by the biasing force of the second spring 38. As a result, the needle 49 presses the suction valve member 33 to bring the suction valve member 33 into a state where the suction valve member 33 abuts on the first spring holder 34, whereby the suction valve member 33 is held in an open state. In this way, the fuel is sucked into the pressurizing chamber 110 from the fuel chamber 63 via the communication passage 24, the suction chamber 311, and the suction hole 111. In the suction process, when the plunger 10 is moved down, the volume of a variable volume chamber is decreased. Thus the fuel in the variable volume chamber is fed to the fuel chamber 63.

(II) Volume Control Process

When the plunger 10 is moved up from the bottom dead center to the top dead center by the rotation of the camshaft, the volume of the pressurizing chamber 110 is decreased. At this time, the passing of electricity through the coil 42 is stopped until a given timing, so that the suction valve member 33 is held in the open state. For this reason, the low-pressure fuel sucked once into the pressurizing chamber 110 is returned to the fuel chamber 63 via the communication passage 24 and the like. In the volume control process, when the plunger 10 is moved up, the volume of the variable volume chamber is increased. Thus, the fuel in the fuel chamber 63 is sucked into the variable volume chamber.

When the passing of electricity through the coil 42 is started at a given timing in the middle of the process in which the plunger 10 is moved up, a magnetic attracting force is generated between the fixed core 41 and the movable core 43. When this magnetic attracting force is larger than a force obtained by subtracting the biasing force of the first spring 35 from the biasing force of the second spring 38, the movable core 43 and the needle 49 are moved to the fixed core 41, whereby the force by which the needle 49 presses the suction valve member 33 is released. In this way, the suction valve member 33 is seated on the valve seat 36 for a suction valve by the biasing force of the first spring 35, thereby being brought into the open state.

(III) Pressurizing Process

After the suction valve member 33 is closed, as the plunger 10 is moved up, a fuel pressure in the pressurizing chamber 110 is increased. When the force, which the pressure of the fuel on the pressurizing chamber side applies to the discharge valve member 53, is larger than a resultant force of the force, which the pressure of the fuel on the fuel outlet 55 side applies to the discharge valve member 53, and a biasing force of the discharge valve spring 57, the discharge valve member 53 is opened. In this way, the fuel pressurized in the pressurizing chamber 110 is discharged from the fuel outlet 55. Here, the passing of electricity through the coil 42 is stopped in the middle of the pressurizing process. The force which the pressure of the fuel in the pressurizing chamber 110 applies to the suction valve member 33 is larger than the biasing force of the second spring 38, so that the suction valve member 33 is held closed. In this way, the high pressure pump 1 repeatedly performs the suction process, the volume control process, and the pressuring process to thereby pressurize and discharge the fuel of a volume necessary for the internal combustion engine.

Figure 6A:
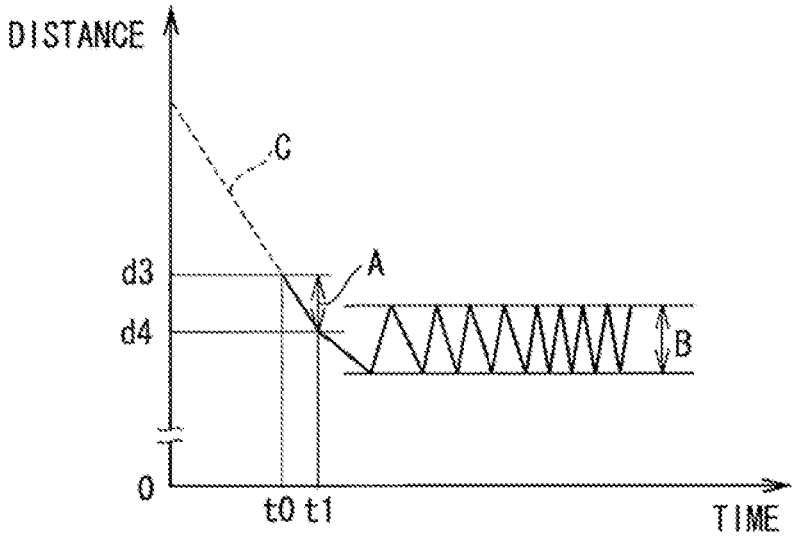
FIG. 6A is a graph to show a displacement of a diaphragm body of the high pressure pump according to the first embodiment.

Next, a displacement and a stress developed in the pulsation damper body 71 will be described. The displacement of the lower diaphragm 73 of the pulsation damper body 71 will be shown in FIG. 6A and the stress developed in the lower diaphragm 73 at that time will be shown in FIG. 6B. Solid lines on the left side of time t0 in FIG. 6A show a state in which the engine of a vehicle is stopped and in which the high pressure pump 1 is not acted (hereinafter referred to as "non-acting state"). Since the lower diaphragm 73 has its bulging restricted by the lower cover part 92, a distance between the center of the outside end face of the lower diaphragm 73 and the imaginary plane S is d3 in a non-acting state. Here, a broken line C on the left side of the time t0 in FIG. 6A shows a distance between a center of an outside end face of a lower diaphragm of a conventional pulsation damper body, which is not provided with a cover part, and the imaginary plane S. When time passes from the time t0 to the time t1, the high pressure pump 1 is brought into an action starting state from the non-acting state. At this time, the fuel pressure in the fuel chamber 63 is increased and hence the lower diaphragm 73 and the upper diaphragm 72 are displaced in the direction in which the lower/upper diaphragms 73, 72 are brought closer to each other, so that the distance between the center of the outside end face of the lower diaphragm 73 and the imaginary plane S is deceased to a distance d4. At this time, a displacement width of the lower diaphragm 73 is A (d3−d4). After the time t1, the high pressure pump 1 is in an acting state. At this time, the lower diaphragm 73 and the upper diaphragm 72 repeatedly perform an operation to come close to each other and an operation to separate from each other because of the pulsation of the fuel pressure in the fuel chamber 63. For this reason, the distance between the center of the outside end face of the lower diaphragm 73 and the imaginary plane S is changed within a given range. A displacement width of the lower diaphragm 73 at this time is B.

Figure 6B:
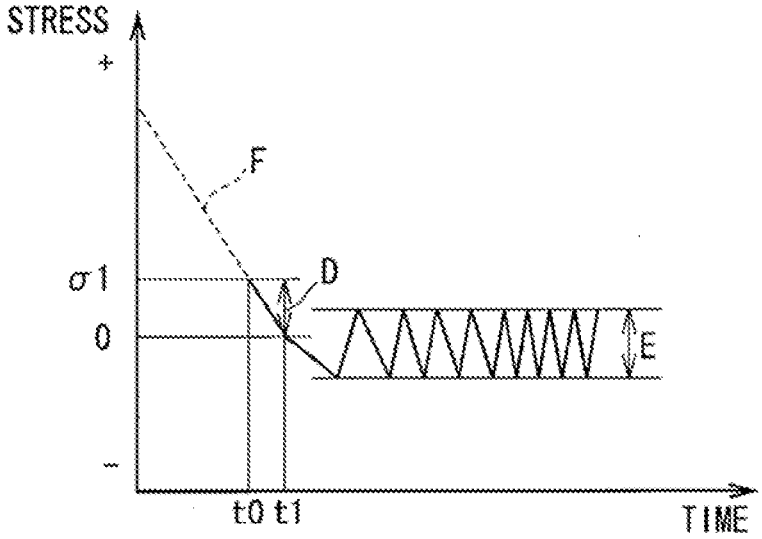
FIG. 6B is a graph to show a stress developed in the diaphragm body.

In FIG. 6B, a stress developed in the lower diaphragm 73 when the distance between the center of the outside end face of the lower diaphragm 73 and the imaginary plane S is larger than d4 is shown on a plus side (+) of a vertical axis, whereas a stress developed in the lower diaphragm 73 when the distance between the center of the outside end face of the lower diaphragm 73 and the imaginary plane S is smaller than d4 is shown on a minus side (−) of the vertical axis. The lower diaphragm 73 has its bulging restricted to d3 by the lower cover part 92, so that a stress developed in the lower diaphragm 73 when the high pressure pump 1 is in the non-acting state is σ1. When the high pressure pump 1 is brought from the non-acting state into the action starting state, a stress developed in the lower diaphragm 73 becomes 0. A change in the stress of the lower diaphragm 73 at this time is A (σ1−0). After the time t1, when the high pressure pump 1 is brought into the acting state, the stress developed in the lower diaphragm 73 is varied within a given range E. Here, a broken line F on the left side of the time t0 in FIG. 6B shows a stress developed in the lower diaphragm of the conventional pulsation damper body not having the cover part. The displacement and the stress of the upper diaphragm 72 are developed similarly to the displacement and the stress of the lower diaphragm 73. In the lower diaphragm 73 and the upper diaphragm 72, a change in the stress when the high pressure pump 1 is brought from the non-acting state into the action starting state and from the acting state into the non-acting state is reduced by the cover parts 82, 92 of the upper/lower support members 80, 90.

In the present embodiment, the following effects are produced. (1) In the present embodiment, the cylinder part 11 has the projected portion 19 projecting to the fuel chamber side from the upper pump body 20. The lower support body 93 of the lower support member 90 is engaged with the outer wall of the projected portion 19 of the cylinder part 11. The cylinder abutting parts 96 of the lower support body 93 extend in the axial direction of the cylinder part 11 along the outer wall of the projected portion 19 of the cylinder part 11, so that the pulsation damper 70 can be surely inhibited from moving in the radial direction by the cylinder abutting parts 96. Thus, the pulsation damper body 71 can be easily set in the fuel chamber 63. (2) In the present embodiment, the ring-shaped parts 81, 91 of the upper/lower support members 80, 90 are formed parallel to the peripheral edge portions 74, 75 of the upper/lower diaphragms 72, 73 and in the shape of a ring and are joined to each other over the entire circumference by the laser welding together with the peripheral edge portions 74, 75 of the upper/lower diaphragms 72, 73. The peripheral edge portions 74, 75 are increased in rigidity by the ring-shaped parts 81, 91, whereby the peripheral edge portion 74 of the upper diaphragm 72 and the peripheral edge portion 75 of the lower diaphragm 73 are inhibited from being displaced in the direction in which they are separated from each other. Thus, it is possible to surely inhibit a repeated stress from being applied to the joined portion 77 of the peripheral edge portions 74, 75 of the upper/lower diaphragms 72, 73 by a stress amplitude of the pulsation damper body 70. (3) In the present embodiment, the support bodies 83, 93 abutting on the cover member 80 or the upper pump body 20 connect with the cover parts 82, 92, so that the cover parts 82, 92 are inhibited from being displaced. For this reason, by the cover parts 82, 92, the movable parts 78, 79 of the upper/lower diaphragms 72, 73 can be inhibited from being displaced in the direction in which they are separated from each other. Hence, this can surely inhibit a repeated stress from being applied to the joined portion 77 of the peripheral edge portion 74 of the upper diaphragm 72 and the peripheral edge portion 75 of the lower diaphragm 73. (4) In the present embodiment, the space 100 is formed continuously in the peripheral direction between the cylinder part 62 of the cover member 60 and the pulsation damper body 71. In this way, the fuel easily flows to the upper diaphragm 72 and the lower diaphragm 73. Hence, the fluid resistance in the fuel chamber can be reduced and the pulsation damper body 71 can produce a high pulsation damping effect. (5) In the present embodiment, the hole made in the first plate that is the base material of the upper support member 80 by cutting out the upper support body 83 from the first plate becomes the fuel passage 85. Further, the hole made in the second plate that is the base material of the lower support member 90 by cutting out the lower support body 93 from the second plate becomes the fuel passage 95. In this way, without working the pump body 20 or the cover member 60, the upper support body 83 and the lower support body 93 can be formed in the upper support member 80 or the lower support member 90 and, at the same time, the fuel passages 85, 95 can be formed. Hence, the production process of the upper support member 80 and the lower support member 90 can be simplified and hence a production cost can be reduced.

(Second Embodiment)

Figure 7:
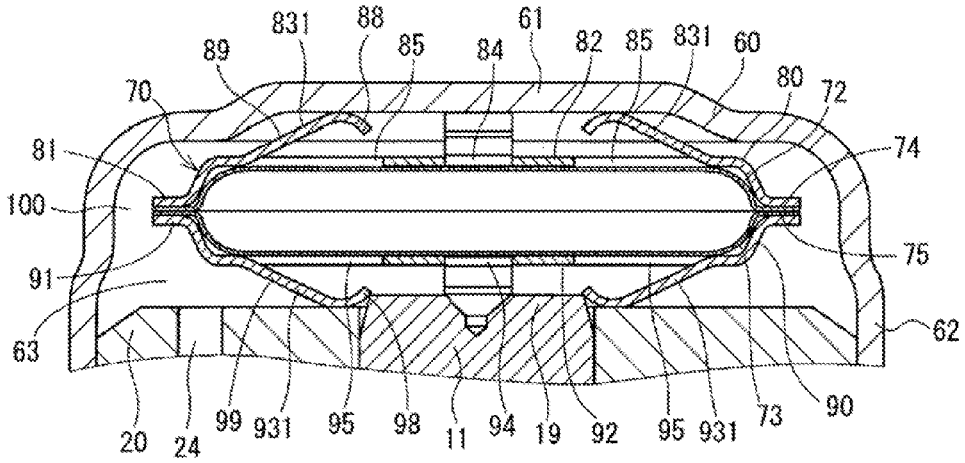
FIG. 7 is a section view, on an enlarged scale, of a main portion of a high pressure pump according to a second embodiment.

A high pressure pump according to a second embodiment will be shown in FIG. 7. In the second embodiment, four upper support bodies 831 of the upper support member 80 connect with the upper cover part 82 on the cover member side of the movable part 78 of the upper diaphragm 72 and extend to the inside in the radial direction from the positions in which the upper support bodies 831 connect with the upper cover part 82. Specifically, each of the upper support bodies 831 has its one end connected with an outer peripheral side of the upper cover part 82 (in detail, a position outside half the radius of the upper diaphragm 72 and inside a bent portion of the upper cover part 82) and has the other end extended to an inner peripheral side of the upper cover part 82. The upper support body 831 has a slant part 89, which extends on the slant to a bottom portion side of the cover member 60 from the upper cover part 82, and a curving part 88, which curves to the upper diaphragm 72 from an end portion inside in the radial direction of the slant part 89. The slant part 89 abuts on an inner wall of the cover member 60. Four lower support bodies 931 of the lower support member 90 connect with the lower cover part 92 on a pump body side of the movable part 79 of the lower diaphragm 73 and extend to the inside in the radial direction from the positions in which the lower support bodies 931 connect with the lower cover part 92. Specifically, each of the lower support bodies 931 has its one end connected with the outer peripheral side of the lower cover part 92 (in detail, a position outside half the radius of the lower diaphragm 73 and inside a bent portion of the lower cover part 92) and has the other end extended to the inner peripheral side of the lower cover part 92. The lower support body 931 has a slant part 99, which extends on the slant to the bottom portion side of the cover member 60 from the lower cover part 92, and a curving part 98, which curves to the lower diaphragm 72 from an end portion inside in the radial direction of the slant part 99. The slant part 99 abuts on the upper pump body 20 and the curving part 98 abuts on the depressed portion 19 of the cylinder part 11.

The four upper support bodies 831 are formed at the same time of press-working the fuel passages 84, 85 of the upper cover part 82 or by bending conducted after the press-working. A hole formed when the upper support body 831 is cut out of the first plate becomes the fuel passage 85. The four lower support bodies 931 are formed at the same time of press-working the fuel passage 95 of the lower cover part 92 or by bending conducted after the press-working. A hole formed when the lower support body 931 is cut out of the second plate becomes the fuel passage 95. A load to be applied to the upper support body 831 is set by the material and the thickness of the upper support body 831, an angle formed by the lower cover part 82 and the slant part 89. A load to be applied to the lower support body 931 is set by the material and the thickness of the lower support body 931, an angle formed by the lower cover part 92 and the slant part 99. The projected portion 19 of the cylinder part 11 is inserted into between the four lower support bodies 931. The lower support bodies 931 are engaged with the outer wall in the radial direction of the projected portion 19 of the cylinder part 11. In this way, the pulsation damper 70 is inhibited from moving in the radial direction. Also in the second embodiment, the same effects described in the first embodiment can be produced.

(Third Embodiment)

Figure 8:
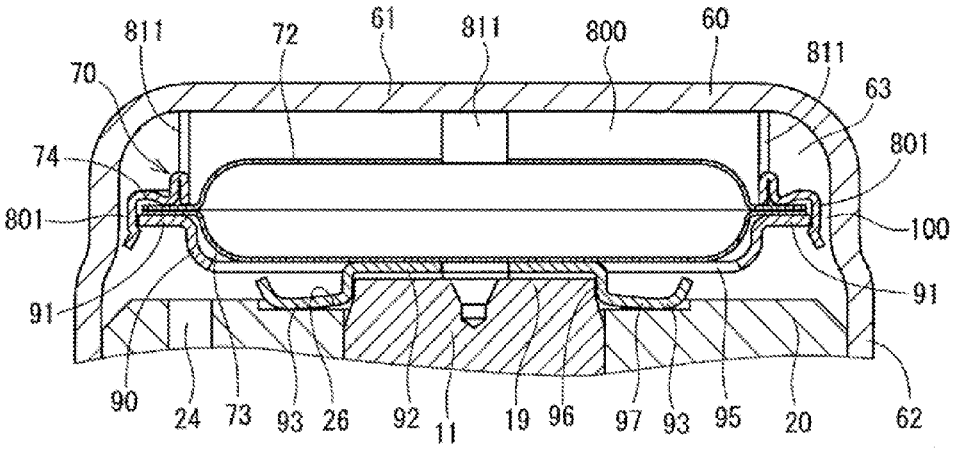
FIG. 8 is a section view, on an enlarged scale, of a main portion of a high pressure pump according to a third embodiment.

A high pressure pump according to a third embodiment will be shown in FIG. 8. In the third embodiment, an upper support member 800 is formed nearly in a cylindrical shape. In the upper support member 800, one side in the axial direction abuts on an inner wall of the cover member 60 and the other side abuts on the peripheral edge portion 74 of the upper diaphragm 72. The upper support member 800 has four claw parts 801 which are formed by cutting away one portion of the cylinder from a cover member side to an upper diaphragm side and by bending the one portion to the outside in the radial direction. The claw parts 801 are engaged with the outside edge of the ring-shaped part 91 of the lower support member 90. The portions cut away to form the claw parts 801 become fuel passages 811. The lower support member 90 has the same construction as in the first embodiment. For this reason, the pulsation damper 70 is inhibited from moving in the radial direction by the lower support body 93 and the pulsation damper 70 can be easily positioned in the fuel chamber. Also in the present embodiment, the space 100 is formed continuously in the peripheral direction between the cylinder part 62 of the cover member 60 and the pulsation damper body 71. Further, the fuel flows in the upper/lower diaphragm 72, 73 via the fuel passages 811 of the upper support members 800. In this way, the fluid resistance in the fuel chamber can be reduced and the pulsation damper body 71 can produce a high pulsation damping effect.

(Fourth Embodiment)

Figure 9A:
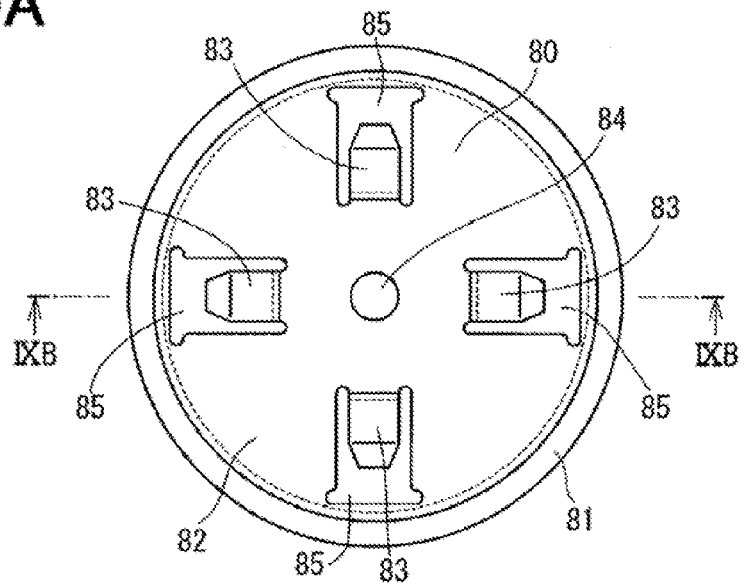
FIG. 9A is a plan view illustrating a pulsation damper to be set in a high pressure pump according to a fourth embodiment.
Figure 9B:
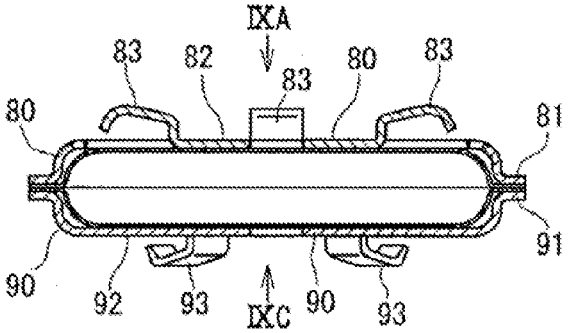
FIG. 9B is a section view taken on a line IXB-IXB in FIG. 9A.
Figure 9C:
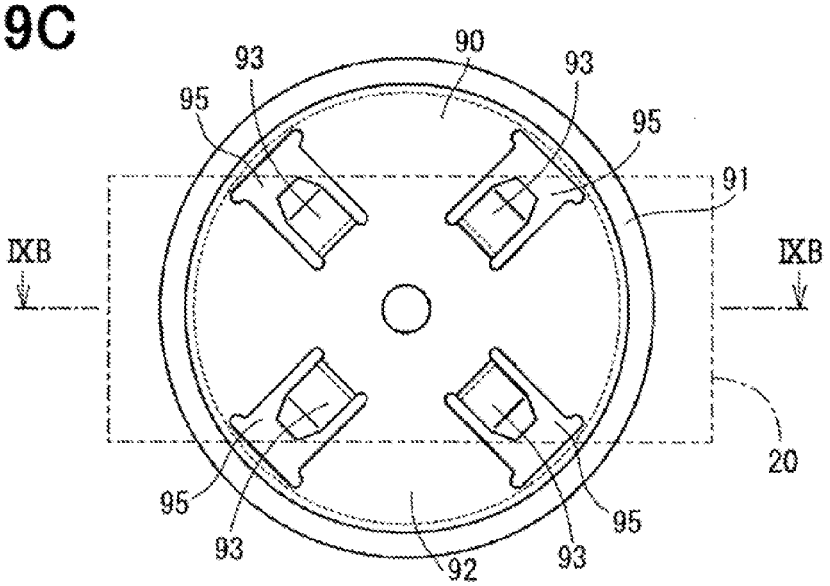
FIG. 9C is a view when viewed from a IXC direction shown by arrows in FIG. 9B and a bottom view of the pulsation damper.

A high pressure pump according to a fourth embodiment will be shown in FIGS. 9A to 9C. In the fourth embodiment, the upper support member 80 and the lower support member 90 are joined to each other in the state in which they are turned by 45° in the peripheral direction. The position of the upper pump body 20 is shown by a single-dot and dash line in FIG. 9C. Four lower support bodies 93 surely abut on the upper pump body 20. In the fourth embodiment, in the case where there is a limit in a direction in which the upper support member 80 is fitted under the conditions, for example, that an inner wall of the cover member 60 has depressions and projections, the pulsation damper 70 can be set in the fuel chamber without enlarging the width of the upper pump body 20.

(Fifth Embodiment)

Figure 10:
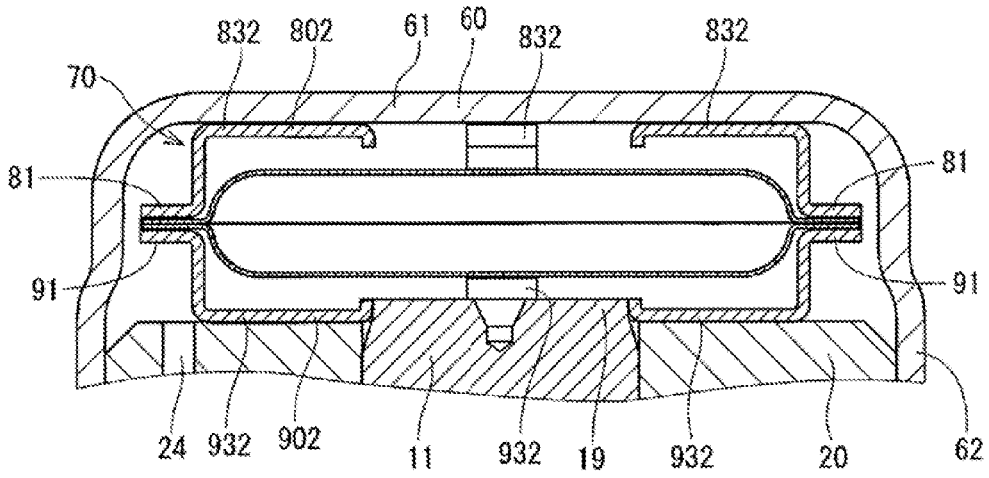
FIG. 10 is a section view, on an enlarged scale, of a main portion of a high pressure pump according to a fifth embodiment.

A high pressure pump according to a fifth embodiment will be shown in FIG. 10. In the fifth embodiment, an upper support member 802 does not have an upper cover part. In the upper support member 802, an upper support body 832 extends to a cover member side from the upper ring-shaped part 81 and abuts on the inner wall of the cover member 60. Further, a lower support member 902 does not have a lower cover part. In the lower support member 902, a lower support body 932 extends to the upper pump body side from the lower ring-shaped part 91 and abuts on the upper pump body 20 and is engaged with an outer wail outside in the radial direction of the projected portion 19 of the cylinder part 11. In the fifth embodiment, even in the case where the support members 802, 902 not having the cover part are used, by engaging the lower support body 932 of the lower support member 902 with the outer wall of the projected portion 19 of the cylinder part 11, the pulsation damper 70 can be easily positioned in the fuel chamber.

(Sixth Embodiment)

Figure 11:
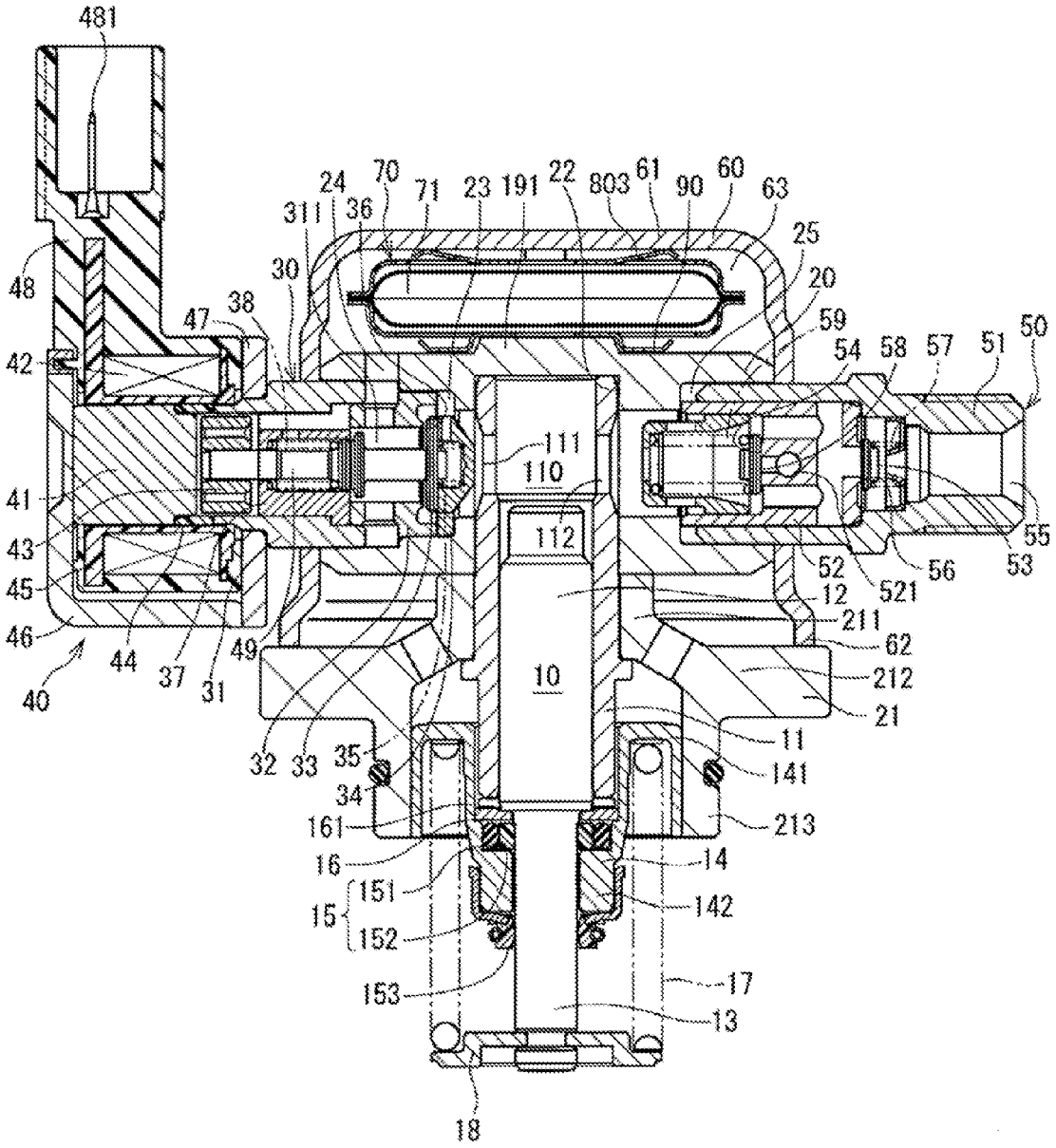
FIG. 11 is a section view of a high pressure pump according to a sixth embodiment.
Figure 12:
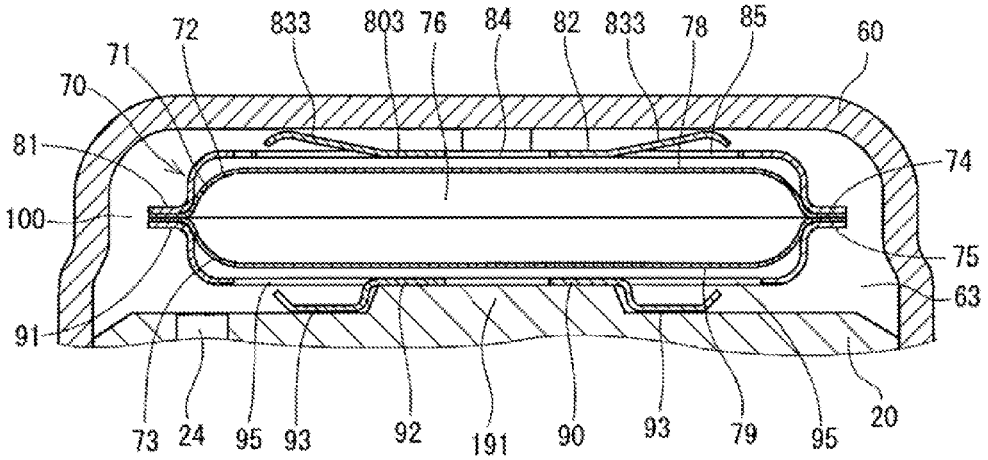
FIG. 12 is a section view, on an enlarged scale, of a main portion of the high pressure pump according to the sixth embodiment.

A high pressure pump according to a sixth embodiment will be shown in FIG. 11 and its main portion will be shown in FIG. 12. In the sixth embodiment, the cylinder part 11 does not project into the fuel chamber 63 from the upper pump body 20. Instead, the upper pump body 20 has a projected portion 191. An upper support member 803 has the upper ring-shaped part 81, the upper cover part 82, and an upper support body 833. The upper support body 833 abuts on the cover member 60. The upper support body 833 presses the cover member 60 to a side opposite to the upper pump body 20 by a given spring force. The lower support member 90 has the lower ring-shaped part 91, the lower cover part 92, and the lower support body 93. The lower support body 93 abuts on the upper pump body 20 and its projected portion 191. In this way, the pulsation damper 70 is inhibited from moving in the radial direction and is positioned in the fuel chamber 63. The lower support body 93 presses the upper pump body 20 to a side opposite to the cover member 60 by a given spring force. Also in the present embodiment, a hole made in the first plate that is the base material of the upper support member 803 by cutting out the upper support body 833 from the first plate becomes the fuel passage 85. Further, a hole made in the second plate that is the base material of the lower support member 90 by cutting out the lower support body 93 from the second plate becomes the fuel passage 95. Also in the sixth embodiment, the same effects as in the first to the fifth embodiments can be produced.

(Seventh Embodiment)

Figure 13:
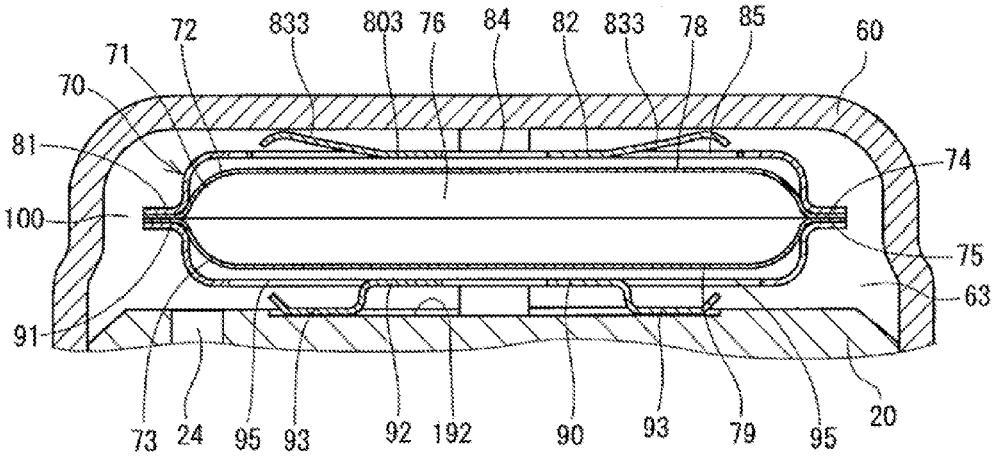
FIG. 13 is a section view, on an enlarged scale, of a main portion of a high pressure pump according to a seventh embodiment.

A main portion of a high pressure pump according to a seventh embodiment will be shown in FIG. 13. In the seventh embodiment, a depressed portion 192 is formed in the upper pump body 20. The lower support body 93 of the lower support member 90 abuts on the depressed portion 192 of the upper pump body 20. In this way, the pulsation damper 70 is inhibited from moving in the radial direction and is positioned in the fuel chamber 63. Also in the seven embodiment, the same effects as in the first to the sixth embodiments can be produced.

(Eighth Embodiment)

Figure 14:
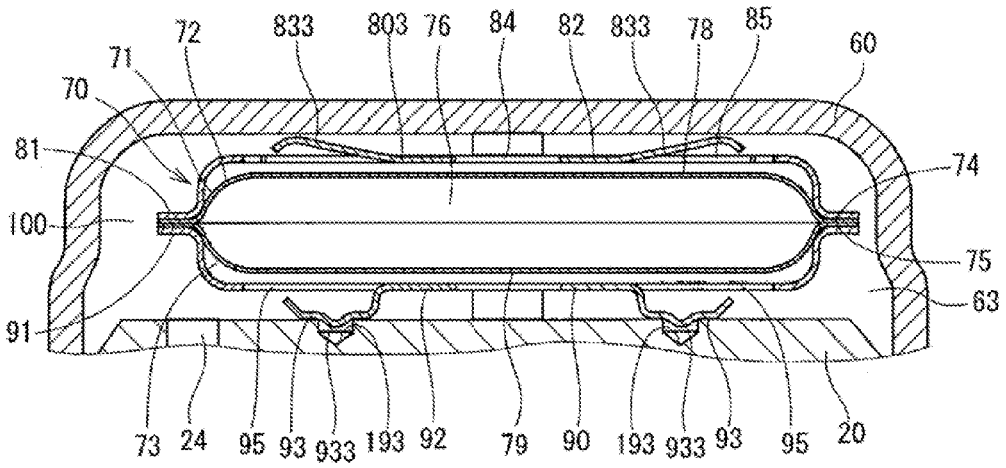
FIG. 14 is a section view, on an enlarged scale, of a main portion of a high pressure pump according to an eighth embodiment.

A main portion of a high pressure pump according to an eighth embodiment will be shown in FIG. 14. In the eighth embodiment, holes 193 are formed in the upper pump body 20. The lower support body 93 of the lower support member 90 has projections 933 at the positions corresponding to the holes 193 of the upper pump body 20. When the projections 933 of the lower support body 93 are put in the holes 193 of the upper pump body 20, the pulsation damper 70 is inhibited from moving in the radial direction and is positioned in the fuel chamber 63. Further, in the eighth embodiment, the pulsation damper 70 is positioned in a position shifted in a direction separated from the communication passage 24 of the upper pump body 20. For this reason, a space around the communication passage 24 of the fuel chamber 63 is made wider. Hence, a flow coefficient of the fuel flowing to the communication passage 24 from the fuel chamber 63 increases and hence the fuel easily flows. Further, the flow coefficient of the fuel flowing to the fuel chamber 63 from the communication passage 24 increases and hence the fuel easily flows. Hence, the pressure pulsation of the fuel can be reduced and a suction efficiency of the fuel into the pressurizing chamber 110 from the fuel chamber 63 can be improved.

(Ninth Embodiment)

Figure 15:
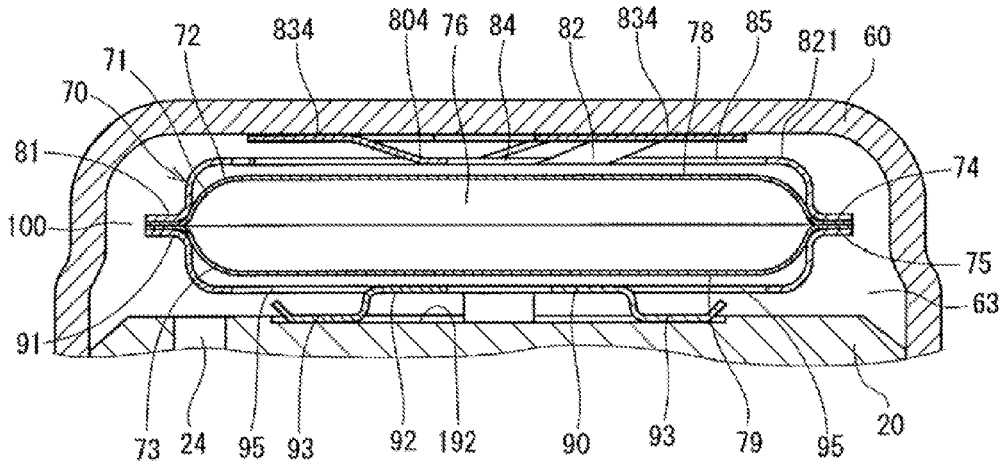
FIG. 15 is a section view, on an enlarged scale, of a main portion of a high pressure pump according to a ninth embodiment.
Figure 16:
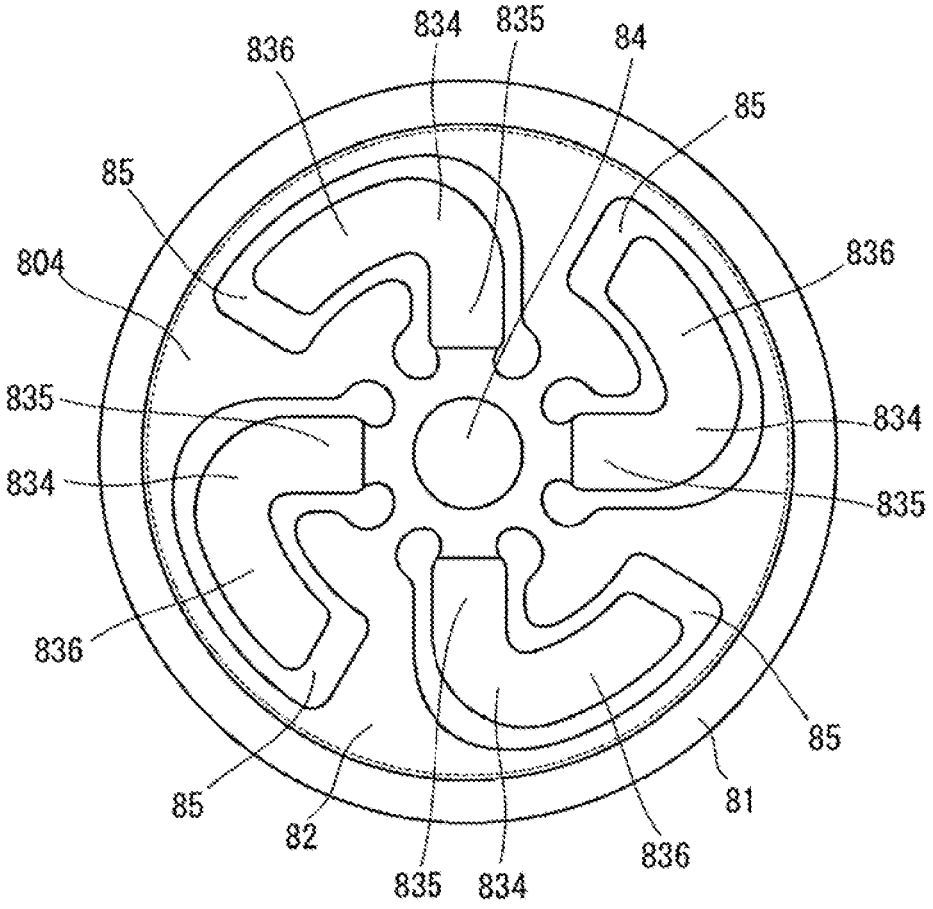
FIG. 16 is a plan view of only a pulsation damper.

A main portion of a high pressure pump according to a ninth embodiment will be shown in FIG. 15 and FIG. 16. In the ninth embodiment, four upper support bodies 834 of an upper support member 804 extend in the peripheral direction. The upper support body 834 has a slant part 835 and an abutting part 836. The slant part 835 connects with an upper cover part 821 inside in the radial direction of the upper support member 804 and extends to the outside in the radial direction and to the cover member side. The abutting part 836 extends in a peripheral direction from an end portion outside in the radial direction of the slant part 835. The abutting part 836 abuts on the cover member 60. The upper support body 833 presses the cover member 60 to a side opposite to the upper pump body 20 by a given spring force. In the lower support member 90, like the seventh embodiment, the lower support body 93 abuts on the depressed portion 192 of the upper pump body 20. In this way, the pulsation damper 70 is inhibited from moving in the radial direction and is positioned in the fuel chamber 63. In the ninth embodiment, an area in which the upper support body 834 abuts on the cover member 60 becomes large. For this reason, the resonance of the cover member 60 by the pressure pulsation of the fuel chamber 63 can be inhibited. Hence, noises caused by the resonance of the cover member 60 can be inhibited.

(10th Embodiment)

Figure 17:
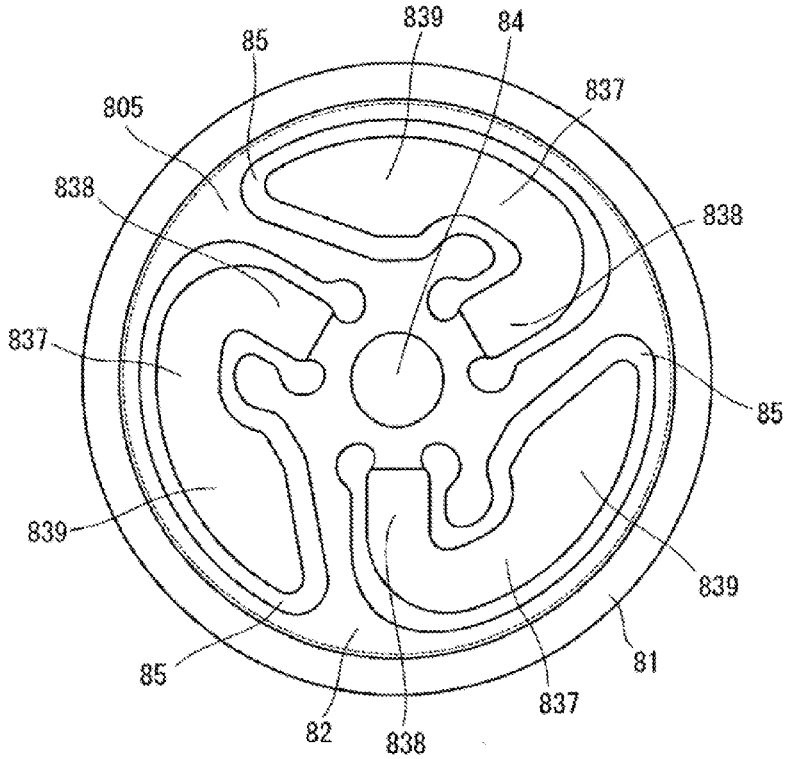
FIG. 17 is a plan view of only a pulsation damper according to a 10th embodiment.

A main portion of a high pressure pump according to a 10th embodiment will be shown in FIG. 17. In the tenth embodiment, an upper support member 805 has three upper support bodies 837. The upper support body 837 has a slant part 838 and an abutting part 839. The abutting part 839 extending in the peripheral direction has an area larger than the abutting part 836 of the ninth embodiment. The upper support body 833 presses the cover member 60 to a side opposite to the upper pump body 20 by a given spring force. In the tenth embodiment, an area in which the abutting part 839 of the upper support body 837 abuts on the cover member 60 becomes large. Hence, the resonance of the cover member 60 caused by the pressure pulsation of the fuel chamber 63 can be inhibited.

(11th Embodiment)

Figure 18:
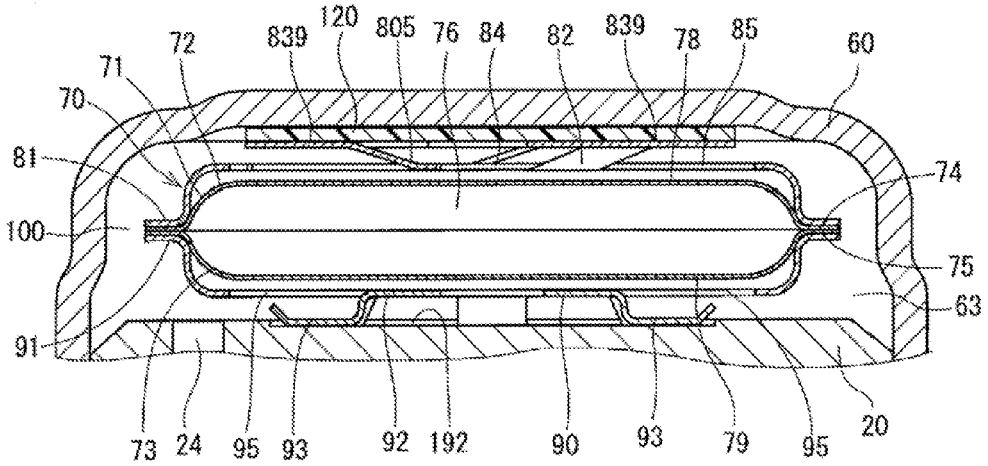
FIG. 18 is a section view, on an enlarged scale, of a main portion of a high pressure pump according to an 11th embodiment.

A main portion of a high pressure pump according to an 11th embodiment will be shown in FIG. 18. In the 11th embodiment, an elastic member 120 is set between the abutting part 839 of the upper support member 805 and the cover member 60. The elastic member 120 is made of, for example, rubber or resin in the shape of a disk. Here, the shape of the elastic member 120 is not limited to the shape of the disk but may be formed nearly in the same shape as the abutting part 839 of the upper support member 805. In the 11th embodiment, the resonance of the cover member 60 is absorbed by the elastic member 120 and hence the noises caused by the resonance of the cover member 60 can be inhibited.

(12th Embodiment)

Figure 19:
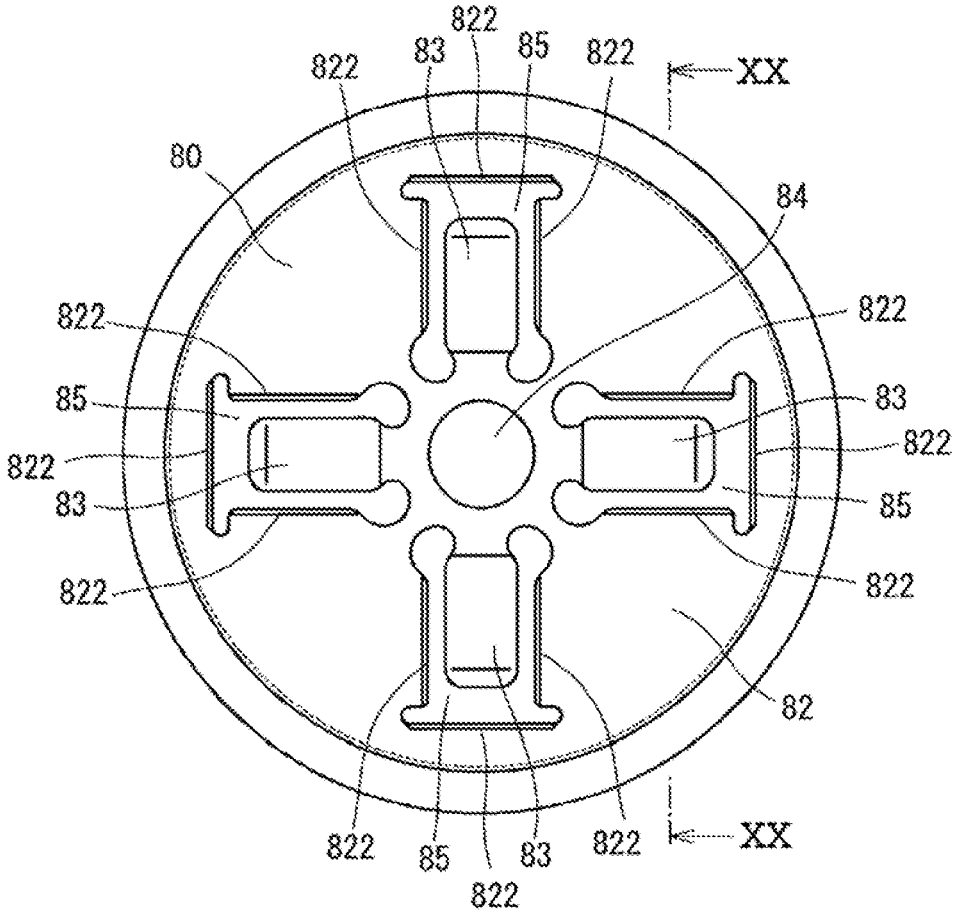
FIG. 19 is a bottom view of only a pulsation damper according to a 12th embodiment.
Figure 20:
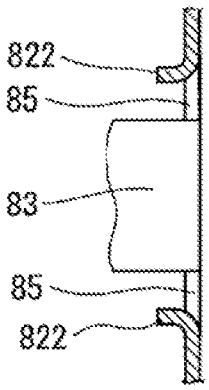
FIG. 20 is a section view taken on a line XX-XX in FIG. 19.

A main portion of a high pressure pump according to a 12th embodiment will be shown in FIG. 19 and FIG. 20. In the 12th embodiment, bent parts 822 are disposed on end portions on the fuel passage 85 side of the upper cover part 82 of the upper support member 80. Further, not shown in the drawing, bent parts are disposed also on end portions on the fuel passage side of the lower cover par 92 of the lower support member 90. The bent portions are bent to a side opposite to the pulsation damper body 71. In this way, contact pressures developed when the cover parts 82, 92 abut on the diaphragms 72, 73 are decreased and hence the durability of the pulsation damper 70 can be improved.

(13th Embodiment)

Figure 21:
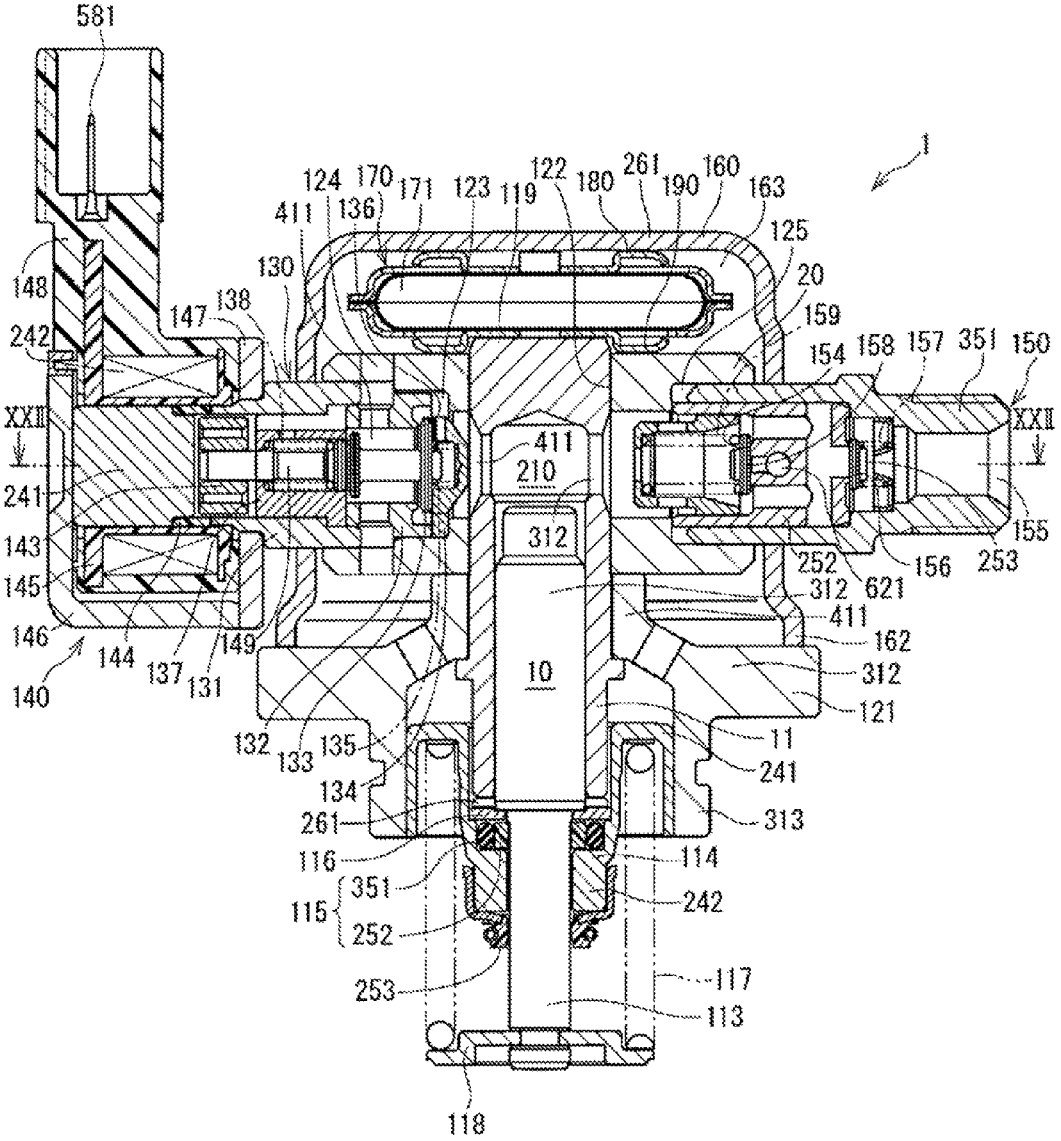
FIG. 21 is a section view of a high pressure pump according to a 13th embodiment.

A high pressure pump 1 according to a 13th embodiment will be shown in FIGS. 21 to 26B. The high pressure pump 1 pressurizes fuel sucked from a fuel tank (not shown) by a low pressure pump and pressure-feeds the fuel to a fuel rail. To the fuel rail is coupled an injector for injecting the fuel into a cylinder of an internal combustion engine. Hereinafter, the embodiment will be described on the assumption that an upper side in FIG. 21 is an "upper" side and that a lower side in FIG. 21 is a "lower" side. However, it is not intended to limit a direction in which the high pressure is set.

Figure 22:
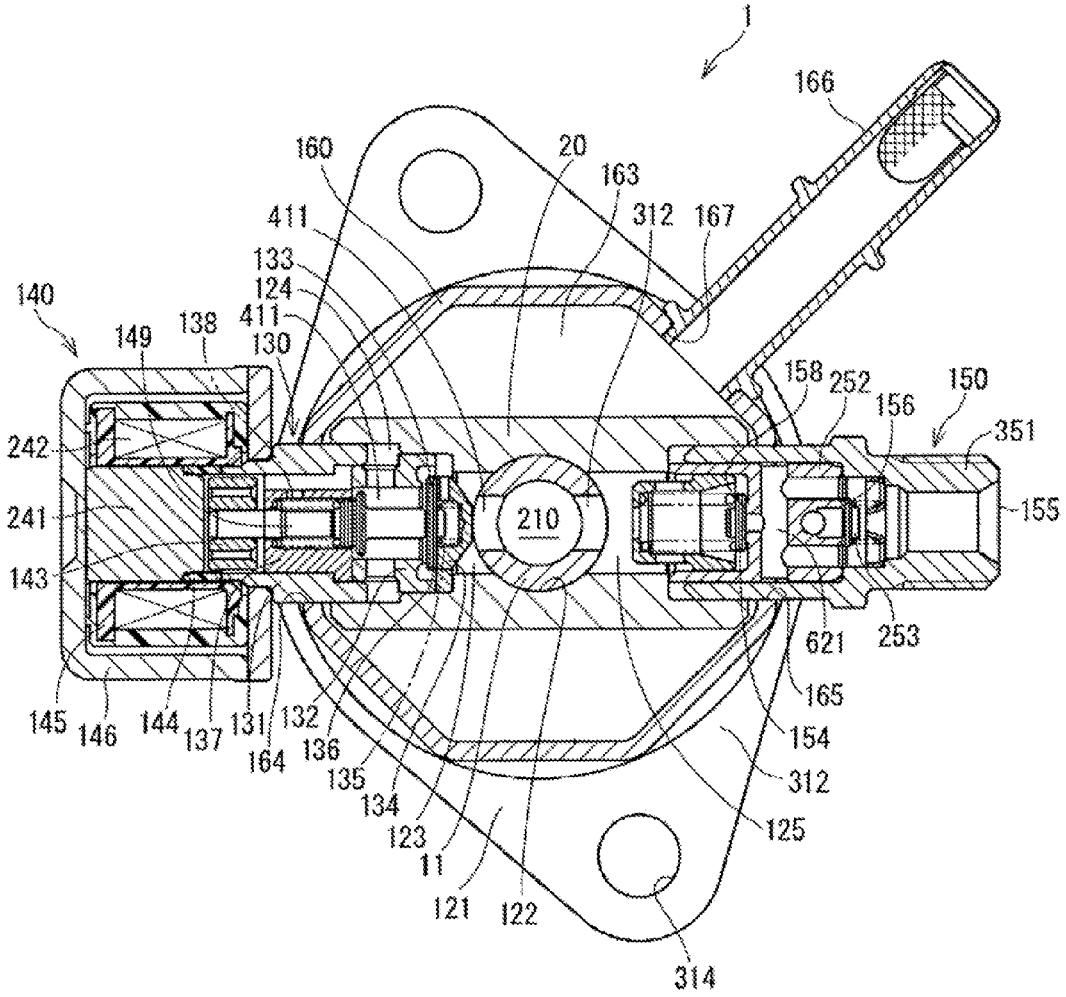
FIG. 22 is a section view taken on a line XXII-XXII in FIG. 21.

The high pressure pump 1, as shown in FIG. 21 and FIG. 22 includes the plunger 10, the cylinder part 11, the upper pump body 20 and a lower pump body 121 which form a pump body, a cover member 160, a pulsation damper 170, and the like. Here, the cylinder part 11 and the pump body may be integrally constructed. The plunger 10 is formed in the shape of a solid cylinder and is set inside the cylinder part 11 in such a way to reciprocate in an axial direction. In the plunger 10, a large-diameter part 312 and a small-diameter part 113, whose outside diameter is smaller than the outside diameter of the large-diameter part 312, are integrally formed. The large-diameter part 312 slides on an inner wall of the cylinder part 11. The small-diameter part 113 is formed below the large-diameter part 312.

The cylinder part 11 is formed in the shape of a cylinder having a closed bottom end. A pressurizing chamber 210 is formed of an inner wall on the bottom side of the cylinder part 11 and an outer wall of the large-diameter part 312 of the plunger 10. The cylinder part 11 has a suction port 411, which makes the pressurizing chamber 210 communicate with a supply part 130, and a discharge port 312, which makes the pressurizing chamber 210 communicate with a discharge part 150.

The lower pump body 121 is set outside in the radial direction of the cylinder part 11 and has a cylinder holding part 411, an engine fixing part 312, and a fitting part 313. The cylinder holding part 411 is formed in a cylindrical shape and abuts on an outer wall outside in the radial direction of the cylinder part 11. The engine fixing part 312 extends in the shape of a ring to the outside in the radial direction from a lower portion of the cylinder holding part 411. In this engine fixing part 312 is formed a fixing hole 314 by which the high pressure pump 1 can be fixed to an engine head. The fitting part 313 extends downward in a cylindrical shape from the engine fixing part 312. The fitting part 313 can be fitted in a high pressure pump fixing hole of the engine head (not shown).

An oil seal holder 114 is set inside the fitting part 313. The oil seal holder 114 is formed nearly in a cylindrical shape and has a press-in part 241 pressed in an inner wall of the fitting part 313 and a base part 242 positioned at an outer periphery of the small-diameter part 113. A ring-shaped seal 115 is set between the oil seal holder 114 and the small-diameter part 113. The seal 115 is constructed of a Teflon ring 351 (Teflon is a trademark) set inside in the radial direction and an O ring 252 set outside in the radial direction. The thickness of a fuel oil film around the small-diameter part 113 of the plunger 10 is controlled by the seal 115 to inhibit a leak of the fuel to the engine. Further, the oil seal holder 114 has an oil seal 253 at its tip. The thickness of an oil film around the small-diameter part 113 of the plunger 10 is controlled to inhibit a leak of the oil into the high pressure pump 1 from the engine.

A plunger stopper 116 is formed in the shape of a disk and is set between an end portion of the cylinder part 11 and the seal 115. The small-diameter part 113 of the plunger 10 is passed through a hole made in the center of the plunger stopper 116. The plunger stopper 116 has a plurality of grooves 261 extending to the outside in the radial direction from the hole of the center. A variable volume chamber is formed by a cylindrical space surrounded by the stepped face of the large-diameter part 312 and the small-diameter part 113 of the plunger 10, the inner wall of the small-diameter part 113, the inner wall of the cylinder part 11, and the plunger stopper 116. A plunger spring 117 has one end engaged with a spring seat 118 set on an end portion of the plunger 10 and has the other end engaged with a press-in part 241 of the oil seal holder 114. The plunger spring 117 biases an end portion of the plunger 10 to a camshaft (not shown) via a tappet (not shown), whereby the plunger 10 is reciprocated in the axial direction according to the profile of the camshaft. The volume of the pressurizing chamber 210 and the volume of the variable volume chamber are changed by the reciprocation movement of the plunger 10.

The upper pump body 20 is formed nearly in the shape of a rectangular solid and is set above the lower pump body 121. The upper pump body 20 has a cylinder insertion hole 122, a supply part 130, and a discharge part 150. In the upper pump body 20, an inner wall of the cylinder insertion hole 122 is pressed onto an outer wall outside in the radial direction of the cylinder part 11. The supply part 130 is constructed of a suction valve body 131, a seat body 132, a suction valve member 133, a first spring holder 134, a first spring 135, an electromagnetic drive part 140, and the like. The suction valve body 131 is formed nearly in a cylindrical shape and is pressed in a suction passage 123 formed in the upper pump body 20. A cylindrical seat body 132 is set on the pressurizing chamber side of the suction valve body 131. The seat body 132 has a suction chamber 411 formed inside. The suction chamber 411 communicates with a fuel chamber 163 outside the upper pump body 20 through a communication passage 124 formed in the upper pump body 20. The seat body 132 has a valve seat 138 for a suction valve on the pressurizing chamber side. The suction valve member 133 is set on the pressurizing chamber side of the valve seat 136 for a suction valve and can be seated on or separated from the valve seat 136 for a suction valve. One end of the first spring 135 abuts on a first spring holder 134 set on the pressurizing chamber side of the suction valve member 133 and the other end of the first spring 135 abuts on the suction valve member 133 (The first spring 135 biases the suction valve member 133 in a direction to close the valve (in the left direction in FIG. 21).

The electromagnetic drive part 140 has a fixed core 241, a coil 242, a movable core 143, and the like. The fixed core 241 is set on a side opposite to the pressurizing chamber 210 of the suction valve body 131. A cylindrical member 144 formed of a non-magnetic material is set between the fixed core 241 and the suction valve body 131. The cylindrical member 144 inhibits a short circuit of a magnetic flux from being developed between the fixed core 241 and the suction valve body 131. The coil 242 is wound around a bobbin 145 set outside in the radial direction of the fixed core 241. The outside of the coil 242 is covered with a cylindrical case 146 and a flange 147. A connector 148 is extended to the outside in the radial direction of the case 145. When electricity is passed through the coil 242 via a terminal 581 of the connector 148, the coil 242 generates a magnetic field. The movable core 143 nearly shaped like a cylinder is set on the pressurizing chamber side of the fixed core 141 and inside the suction valve body 131 in such a way as to reciprocate. The movable core 143 has a needle 149 fixed thereto. The needle 149 is supported by a second spring holder 137 set inside the suction valve body 131 in such a way as to reciprocate. An end portion on the pressurizing chamber side of the needle 149 can abut on the suction valve member 133. A second spring 138 set inside the second spring holder 137 biases the needle 149 in a direction to open the valve (right direction in FIG. 21) by a force stronger than a force by which the first spring 135 biases the suction valve member 133 in a direction to close the valve.

When the electricity is not passed through the coil 242, the movable core 143 and the fixed core 241 are separated from each other by a biasing force of the second spring 138. In this way, the needle 149 integrated with the movable core 143 is moved to the pressurizing chamber side to press the suction valve member 133 by an end face of the needle 149, whereby the suction valve member 133 is opened. When the electricity is passed through the coil 242, a magnetic flux flows through a magnetic circuit formed of the fixed core 241, the movable core 143, the flange 147, and the case 146, and hence the movable core 143 is magnetically attracted to the fixed core 241 side against the biasing force of the second spring 138. In this way, the needle 149 releases a force of pressing the suction valve member 133.

The discharge part 150 is constructed of a fuel discharge housing 351, a discharge valve body 252, a discharge valve member 253, a relief valve member 154, and the like. The fuel discharge housing 351 is formed nearly in a cylindrical shape and is pressed in a discharge passage 125 formed in the upper valve body 20. Inside the fuel discharge housing 351 is set the discharge valve body 252. The discharge valve body 252 has a valve seat 156 for a discharge valve on a fuel outlet 155 side. The discharge valve member 253 is set on the fuel outlet 155 side of the discharge valve body 252 and can be seated on and separated from the valve seat 156 for a discharge valve. A discharge valve spring 157 biases the discharge valve member 253 to the valve seat 156 for a discharge valve. The discharge valve body 252 has a valve seat 158 for a relief valve on a pressurizing chamber side. The relief valve member 154 is set on the pressurizing chamber side of the valve seat 158 for a relief valve and can be seated on and separated from the valve seat 158 for a relief valve. A relief valve spring 159 biases the relief valve member 154 to the valve seat 158 for a relief valve. A relief passage $21 formed inside the valve seat 158 for a relief valve communicates with the fuel outlet 155.

The cover member 160 is formed in a shape having a closed bottom and has a bottom part 261 and a cylinder part 162 extending in one direction from an outer edge of the bottom part 261. The cylinder part 162 is hermetically joined to the engine fixing part 312 of the lower pump body 121 by welding or the like. The cover member 160 covers the upper pump body 20 and the lower pump body 121 and forms a fuel chamber 163 inside itself. The fuel chamber 163 communicates with the pressurizing chamber 210 through the communication passage 124 of the upper pump body 20 and the suction chamber 411. As shown in FIG. 22, the cover member 160 has the cylinder part 162 formed nearly in an octagonal shape in cross section and has a first insertion hole 164 into which the supply part 130 is inserted, a second insertion hole 165 into which the discharge part 150 is inserted, and a third insertion hole 167 into which a fuel inlet 166 is inserted. The fuel inlet 166 supplies the fuel sucked from a fuel tank (not shown) by a low pressure pump to the fuel chamber 163. The first insertion hole 164 and the supply part 130 of the cover member 160 are joined to each other by welding or the like. Similarly, the second insertion hole 165 and the discharge part 150, and the third insertion hole 167 and the fuel inlet 166 are joined to each other, respectively, by the welding or the like. When the fuel is sucked into the pressurizing chamber 210 from the fuel chamber 163 via the communication passage 124 and the suction chamber 411 by the reciprocation movement of the plunger 10 or when the fuel is discharged to the fuel chamber 163 from the pressurizing chamber 210 via the suction chamber 411 and the communication passage 124, a fuel pressure pulsation is generated in the fuel chamber 163.

Figure 23:
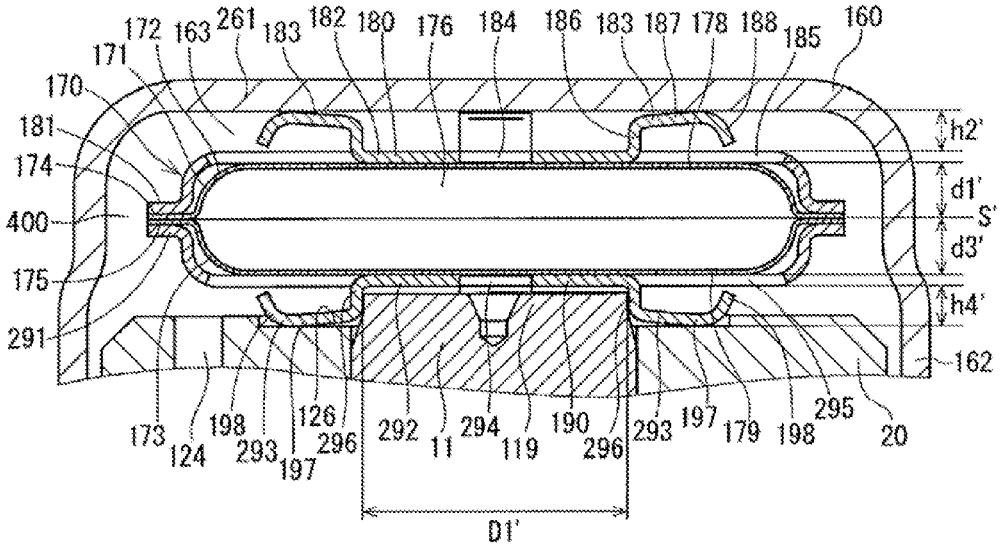
FIG. 23 is a section view, on an enlarged scale, of a main portion of the high pressure pump according to the 13th embodiment.
Figure 24A:
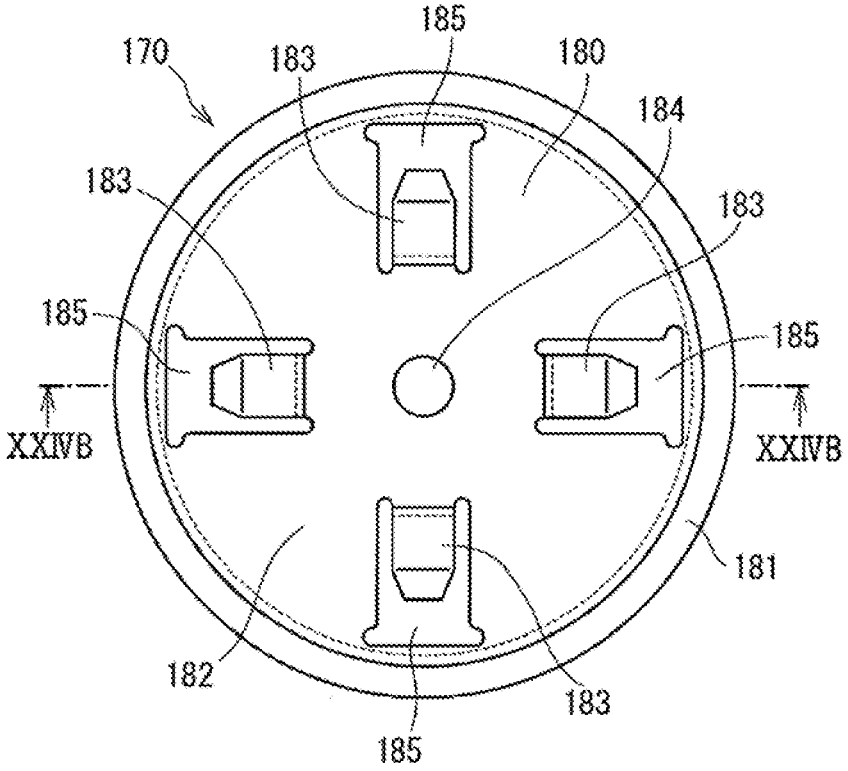
FIG. 24A is a plan view in a state where a pulsation damper to be set in the high pressure pump according to the 13th embodiment is not yet fitted in a fuel chamber.
Figure 24B:
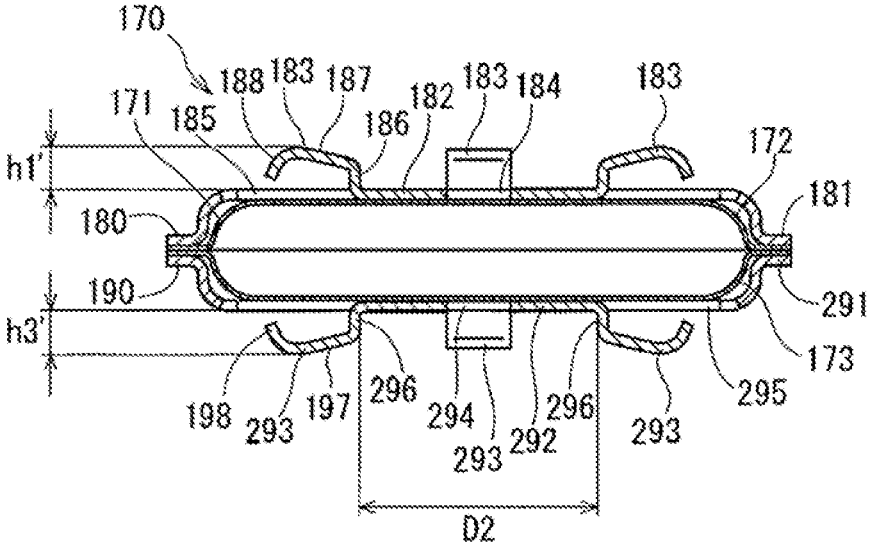
FIG. 24B is a section view taken on a line XXIVB-XXIVB in FIG. 24A.
Figure 25:
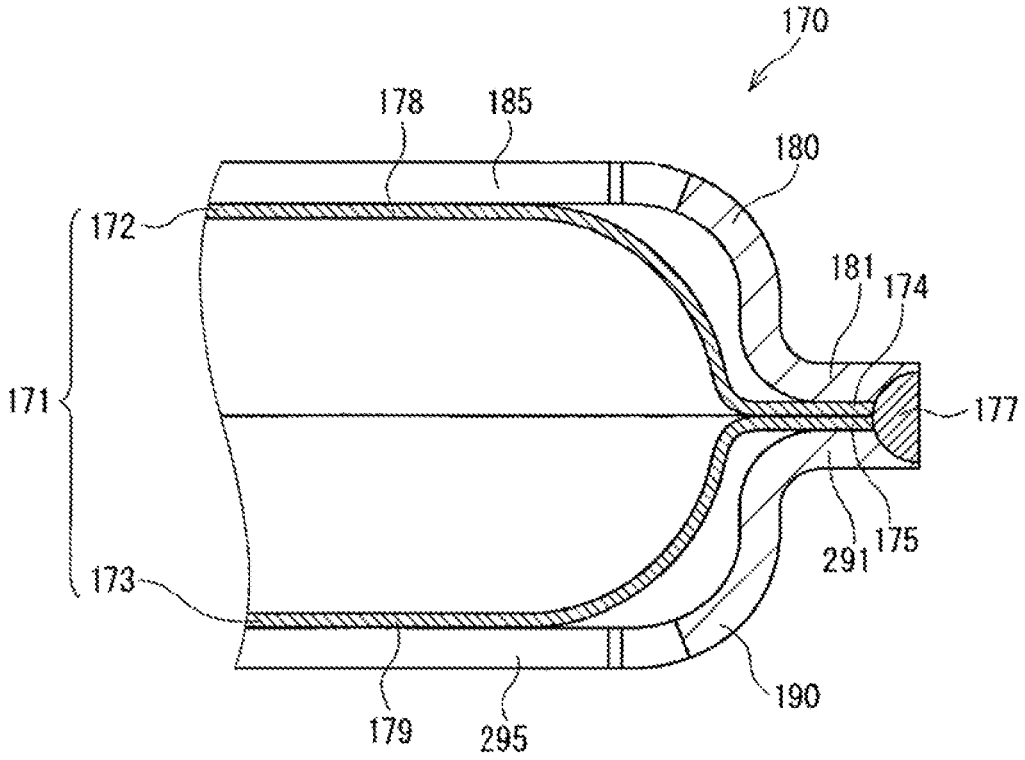
FIG. 25 is a section view, on an enlarged scale, of a pulsation damper to be set in the high pressure pump according to the 13th embodiment.

As shown in FIG. 23 and FIGS. 24A, 24B, a pulsation damper 170 is set between the upper pump body 20 and the cover member 160. The pulsation damper 170 has a pulsation damper body 171, an upper support member 180, and a lower support member 190 and is constructed as a sub-assembly. The pulsation damper body 171 is constructed of two diaphragms 172, 173. Each of the diaphragms 172, 173 is formed in the shape of a plate by press-working a metal plate, for example, a stainless steel plate having a high proof stress and a high fatigue limit. In the pulsation damper body 171, the peripheral edge portions 174, 175 of the two diaphragms 172, 173 are joined to each other and gas having a given pressure is trapped in a closed space 176 formed inside the joined diaphragms 172, 173. In the pulsation damper body 171, the two diaphragms 172, 173 are elastically deformed according to a change in the fuel pressure in the fuel chamber 163 to thereby reduce the fuel pressure pulsation in the fuel chamber 183. By adequately setting the thickness, material, and outside diameter of the two diaphragms 172, 173 and the pressure of the gas trapped in the closed space 176 according to endurance or other required performance, a spring constant of the pulsation damper body 171 is set. A pulsation frequency and a pulsation damping capacity that are reduced by the pulsation damper body 171 are determined by the spring constant. When the thickness of the diaphragm is thin, a pulsation damping effect of the pulsation damper body 171 is improved. Further, when the movable parts 178, 179 of the pulsation damper body 171 have a large outside diameter, the pulsation damping effect of the pulsation damper body 171 is improved. Here, the movable parts 178, 179 are parts that are nearly shaped like a disk and that can be displaced when the pulsation damper body 171 reduces the fuel pressure pulsation in the fuel chamber 163.

The upper support member 180 has an upper ring-shaped part 181, an upper cover part 182, and upper support bodies 183 and is integrally formed by press-working a metal plate, for example, a stainless steel plate having a given rigidity. A plate forming the upper support member 180 is referred to as a first plate. The upper ring-shaped part 181 is formed parallel to the peripheral edge portion 174 of the upper diaphragm 172 and in the shape of a ring. The upper ring-shaped part 181 of the upper support member 180, the peripheral edge portion 174 of the upper diaphragm 172, the peripheral edge portion 175 of the lower diaphragm 173, and a lower ring-shaped part 291 of the lower support member 190 are joined to each other continuously over an entire circumference in a peripheral direction by the laser welding. A welding seam 177 will be shown in FIG. 25. The welding seam 177 is formed over the entire circumference of the pulsation damper 170.

The upper cover part 182 extends along the upper diaphragm 172 from the upper ring-shaped part 181. The upper cover part 182 is formed in the shape of a plane nearly parallel to the movable part 178 of the upper diaphragm 172. Here, a plane including the abutting faces of the peripheral edge portions 174, 175 of the two diaphragms 172, 173 is assumed to be an imaginary plane S'. A distance between the imaginary plane S' in the case where the atmospheric pressure in the closed space 176 of the pulsation damper body 171 is equal to the atmospheric pressure outside the pulsation damper body 171 and a center of the outside end face of the movable part 178 is assumed to be a distance d1'. Further, a distance between an end face on the upper diaphragm side of the upper cover part 182 and the imaginary plane S' is assumed to be a distance d2' (not shown). In this case, there is a relationship such that d2'>d1'. The upper cover part 182 inhibits the upper diaphragm 172 from bulging to the bottom side of the cover member 160. The upper cover part 182 has a circular fuel passage 184 in the center and has four fuel passages 185 in the peripheral direction. These fuel passages 184, 185 are formed by press-working the first plate.

The four upper support bodies 183 are formed at the same time of press-working the fuel passages 184, 185 or by bending conducted after the press-working. In other words, a hole formed when the upper support body 183 is cut out of the first plate becomes the fuel passage 185. The upper support body 183 connects with an upper cover part 182 on the cover member side of the movable part 178 of the upper diaphragm 172 and extends to the outside in the radial direction from a position where the upper support body 183 connects with the upper cover part 182. Specifically, the upper support body 183 has its one end connected with an inner peripheral side of the upper cover part 182 (in detail, a position inside half the radius of the upper diaphragm 172 and outside the fuel passage 184 in the center) and has the other end extended to an outer peripheral side of the upper cover part 182. The upper support body 183 has a vertical part 186 which extends nearly vertically to the bottom side of the cover member 160 from the upper cover part 182, an upper abutting part 187 which bends short of the cover member 160 to the outside in the radial direction from an end portion on a cover member side of the vertical part 186 and extends to the outside in the radial direction, and a curving part 188 which curves to the upper diaphragm side from an end portion outside in the radial direction of the upper abutting part 187. In the upper support body 183, the upper abutting part 187 abuts on an inner wall of the cover member 160. The upper abutting part 187 abuts on the cover member 160 on the outside in the radial direction and has a small clearance formed between a portion inside in the radial direction and the cover member 160. An angle formed by the vertical part 188 and the upper abutting part 187 in the state where the pulsation damper 170 is not yet set in the fuel chamber 163 is set at 90° or more. In this state, a distance between the upper abutting part 187 of the upper support body 183 and the upper cover part 182 is assumed to be h1'. On the other hand, in the state where the pulsation damper 170 is set in the fuel chamber 163, a distance between the upper abutting part 187 of the upper support body 183 and the upper cover part 182 is assumed to be h2'. In this case, there is a relationship such that h1>h2'. A load to be applied to the upper support body 183 is set by the material and the thickness of the upper support body 183, the angle formed by the vertical part 186 and the upper abutting part 187, and a distance of (h1−h2)'. In other words, the upper support body 183 has a spring force of pressing the cover member 160 to a side opposite to the pump body.

The lower support member 190 has substantially the same construction as the upper support body 180. The lower support member 190 has a lower ring-shaped part 291, a lower cover part 292, and lower support bodies 293 and is integrally formed by press-working a plate made of metal, for example, stainless steel having a given rigidity. The plate forming the lower support member 190 is referred to as a second plate. The lower ring-shaped part 291 is formed parallel to the peripheral edge portion 175 of the lower diaphragm 173 and in the shape of a ring. The lower cover part 292 extends along the lower diaphragm 173 from the lower ring-shaped part 291. The lower cover part 292 is formed in the shape of a plane parallel to the movable part 179 of the lower diaphragm 173. A distance between the imaginary plane S' in the case where the atmospheric pressure in the closed space 176 of the pulsation damper body 171 is equal to the atmospheric pressure outside the pulsation damper body 171 and a center of an outside end face of the movable part 179 is assumed to be d3'. Further, a distance between an end face on the lower diaphragm 173 side of the lower cover part 292 and the imaginary plane S' is assumed to be d4' (not shown). In this case, there is a relationship such that d4'>d3'. The lower cover part 292 inhibits the lower diaphragm 173 from bulging to an upper body side. The lower cover part 292 has a circular fuel passage 294 in the center and has four fuel passages 295 in the peripheral direction. These fuel passages 294, 295 are formed by press-working the second plate member.

The four lower support bodies 293 are formed at the same time of press-working the fuel passages 294, 295 or by bending conducted after the press-working. In other words, a hole formed when the lower support body 293 is cut out of the second plate becomes the fuel passage 295. The lower support body 293 connects with a lower cover part 292 on the pump body side of the movable part 179 of the lower diaphragm 173 and extends to the outside in the radial direction from a position where the lower support part 293 connects with the lower cover part 292. Specifically, the lower support body 293 has its one end connected with an inner peripheral side of the lower cover part 292 (in detail, a position inside half the radius of the lower diaphragm 173 and outside the fuel passage 294 in the center) and has the other end extended to an outer peripheral side of the lower cover part 292. The lower support body 293 has a cylinder abutting part 296 which extends nearly vertically to an upper pump body side from the lower cover part 292, a lower abutting part 197 which bends short of the upper pump body 20 to the outside in the radial direction from an end portion on the upper pump body side of this cylinder abutting part 295 and extends to the outside in the radial direction, and a curving part 198 which curves to the lower diaphragm 173 side from an end portion outside in the radial direction of the lower abutting part 197.

The cylinder abutting part 296 extends in the axial direction of the cylinder part 11 along an outer wall of a projected portion 119 of the cylinder part 11 projecting to a fuel chamber side from the upper pump body 20. The projected portion 119 of the cylinder part 11 is inserted into between the four cylinder abutting parts 296. An outside diameter of the projected portion 119 of the cylinder part 11 is assumed to be an outside diameter D1'. The outside diameter D1' of the projected portion 119 of the cylinder part 11 is formed in a smaller diameter than the outside diameter of a cylinder body part pressed in the upper pump body 20. A distance between end faces inside in the radial direction of the two cylinder abutting parts 296 opposed to each other across the cylinder part 11 is assumed to be a distance D2'. There is a relationship such that D1'≤D2'. In this way, the cylinder abutting parts 296 are engaged with an outer wall outside in the radial direction of the projected portion 119 of the cylinder part 11. Thus, the pulsation damper 170 is limited in its movement in the radial direction.

The lower abutting part 197 is fitted in a depressed groove 126 made in the upper pump body 20. The lower abutting part 197 abuts on the depressed groove 126 of the upper pump body 20 on the outside in the radial direction and has a small clearance formed between its inside portion in the radial direction and the depressed groove 126. In this state, a distance between the lower abutting part 197 and the low cover part 292 is assumed to be h3'. On the other hand, in the state where the pulsation damper 170 is set in the fuel chamber 163, a distance between the lower abutting part 197 and the lower cover part 292 is assumed to be h4'. In this case, there is a relationship such that h3>h4'. A load to be applied to the lower support body 293 is set by the material and the thickness of the lower support body 293, the angle formed by the cylinder abutting part 295 and the lower abutting part 197, and a distance of (h3'−h4'). In other words, the lower support body 293 has a spring force of pressing the upper pump body 20 to a side opposite to the pump body 20. A space 400 is formed continuously in the peripheral direction between the cylinder part 162 of the cover member 160 and the pulsation damper body 171. The fuel flows in the upper diaphragm 172 and in the lower diaphragm 173 via the space 400. Thus, the fluid resistance of the fuel chamber 163 is reduced and the pulsation damper 170 can produce a high pulsation damping effect.

Next, the action of the high pressure pump 1 will be described.

(I) Suction Process

When the plunger 10 is moved down from the top dead center to the bottom dead center by the rotation of the camshaft, the volume of the pressurizing chamber 210 is increased and hence the pressure of the fuel is decreased. A discharge valve member 253 of the discharge part 150 is seated on the valve seat 156 for the discharge valve to close the fuel outlet 155. At this time, the passing of the electricity through the coil 242 is stopped, so that the movable core 143 and the needle 149 are moved to the pressuring chamber side by the biasing force of the second spring 138. As a result, the needle 149 presses the suction valve member 133 to make the suction valve member 133 abut on the first spring holder 134, whereby the suction valve member 133 is held in an open state. In this way, the fuel is sucked into the pressurizing chamber 210 from the fuel chamber 183 via the communication passage 124, the suction chamber 411, and the suction hole 411. In the suction process, when the plunger 10 is moved down, the volume of the variable volume chamber is decreased. Thus, the fuel in the variable volume chamber is fed out to the fuel chamber 163.

(II) Volume Control Process

When the plunger 10 is moved up from the bottom dead center to the top dead center by the rotation of the camshaft, the volume of the pressurizing chamber 210 is decreased. At this time, the passing of the electricity through the coil 242 is stopped until a given timing, so that the suction valve member 133 is held in the open state. For this reason, the low-pressure fuel sucked once into the pressurizing chamber 210 is returned to the fuel chamber 163 via the communication passage 124 and the like. In the volume control process, when the plunger 10 is moved up, the volume of the variable volume chamber is increased. Thus, the fuel in the fuel chamber 163 is sucked into the variable volume chamber.

When the passing of the electricity through the coil 242 is started at a given timing in the middle of the process in which the plunger 10 is moved up, a magnetic attracting force is generated between the fixed core 141 and the movable core 143. When this magnetic attracting force is larger than a force obtained by subtracting the biasing force of the first spring 135 from the biasing force of the second spring 138, the movable core 143 and the needle 149 are moved to the fixed core 141 side, whereby the force by which the needle 149 presses the suction valve member 133 is released. In this way, the suction valve member 133 is seated on the valve seat 136 for a suction valve by the biasing force of the first spring 135, thereby being brought into the open state.

(III) Pressurizing Process

After the suction valve member 133 is closed, as the plunger 10 is move up, the fuel pressure of the pressurizing chamber 210 is increased. When the force, which the pressure of the fuel of the pressurizing chamber side applies to the discharge valve member 253, is larger than a resultant force of the force, which the pressure of the fuel on the fuel outlet 155 side applies to the discharge valve member 253, and the biasing force of the discharge valve spring 157, the discharge valve member 253 is opened. In this way, the fuel pressurized in the pressurizing chamber 210 is discharged from the fuel outlet 155. Here, the passing of the electricity through the coil 242 is stopped in the middle of the pressurizing process. The force which the pressure of the fuel in the pressurizing chamber 210 applies to the suction valve member 133 is larger than the biasing force of the second spring 138, so that the suction valve member 133 is held closed. In this way, the high pressure pump 1 repeatedly performs the suction process, the volume control process, and the pressuring process to thereby pressurize and discharge the fuel of a volume necessary for the internal combustion engine.

Figure 26A:
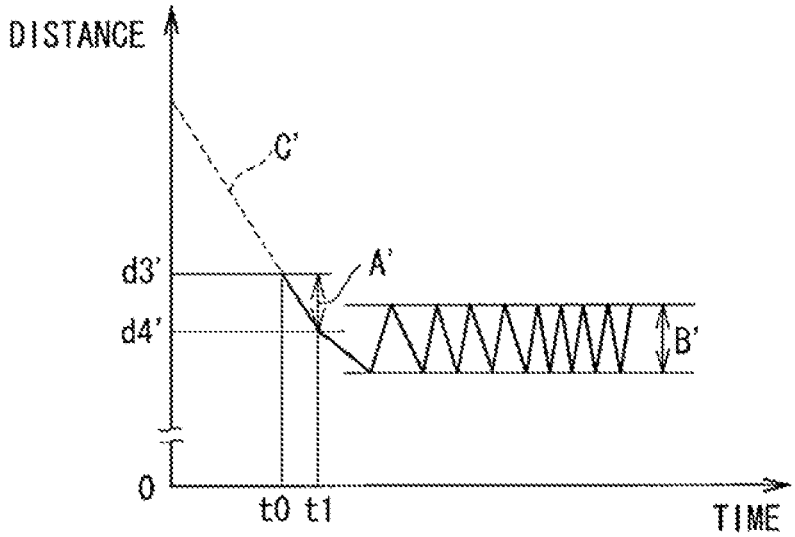
FIG. 26A is a graph to show a displacement of a diaphragm of the high pressure pump according to the 13th embodiment.

Next, a displacement and a stress developed in the pulsation damper body 171 will be described. The displacement of the lower diaphragm 173 of the pulsation damper body 171 will be shown in FIG. 26A and the stress developed in the lower diaphragm 173 at that time will be shown in FIG. 26B. Solid lines on the left side of time to in FIG. 26A show a state in which the engine of a vehicle is stopped and in which the high pressure pump 1 is not acted (hereinafter referred to as "non-acting state"). Since the lower diaphragm 173 has its bulging restricted by the lower cover part 292, a distance between a center of an outside end face of the lower diaphragm 173 and the imaginary plane S' is d3' in a non-acting state. Here, a broken line C' on the left side of the time t0 in FIG. 26A shows a distance between a center of an outside end face of a lower diaphragm of a conventional pulsation damper body, which is not provided with a cover part, and the imaginary plane S'. When time passes from the time t0 to time t1, the high pressure pump 1 is brought from the non-acting state into an action starting state. At this time, the fuel pressure in the fuel chamber 163 is increased and hence the lower diaphragm 173 and the upper diaphragm 172 are displaced in the direction in which both are brought closer to each other, so that the distance between the center of the outside end face of the lower diaphragm 173 and the imaginary plane S' is deceased to a distance d4'. At this time, a displacement width of the lower diaphragm 173 is A' (d3'−d4'). After the time t1, the high pressure pump 1 is in the acting state. At this time, the lower diaphragm 173 and the upper diaphragm 172 repeatedly perform an operation to come close to each other and an operation to separate from each other because of the pulsation of the fuel pressure in the fuel chamber 163. For this reason, the distance between the center of the outside end face of the lower diaphragm 173 and the imaginary plane S' is varied within a given range. A displacement width of the lower diaphragm 173 at this time is B'.

Figure 26B:
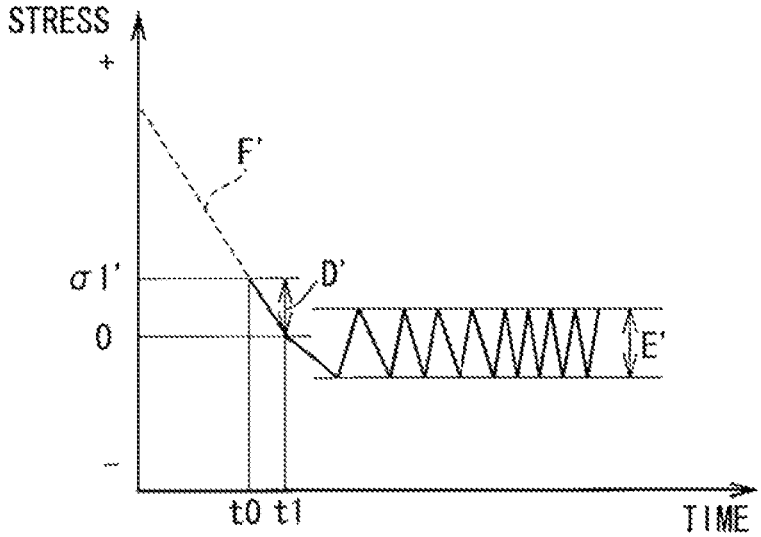
FIG. 26B is a graph to show a stress developed in the diaphragm.

In FIG. 26B, a stress developed in the lower diaphragm 173 when the distance between the center of the outside end face of the lower diaphragm 173 and the imaginary plane S' is larger than d4' is shown on a plus side (+) of a vertical axis, whereas a stress developed in the lower diaphragm 173 when the distance between the center of the outside end face of the lower diaphragm 173 and the imaginary plane S' is smaller than d4 is shown on a minus side (−) of the vertical axis. The lower diaphragm 173 has its bulging restricted to d3' by the lower cover part 292, so that a stress developed in the lower diaphragm 173 when the high pressure pump 1 is in the non-acting state is σ1'. When the high pressure pump 1 is brought from the non-acting state into the action starting state, the stress developed in the lower diaphragm 173 becomes 0. A change in the stress of the lower diaphragm 173 at this time is A' (σ1'−0). After the time t1, when the high pressure pump 1 is brought into the acting state, the stress developed in the lower diaphragm 173 is varied within a given range E'. Here, a broken line F' on the left side of the time t0 in FIG. 26B shows a stress developed in the lower diaphragm of the conventional pulsation damper body not having the cover part. The displacement and the stress of the upper diaphragm 172 are developed similarly to the displacement and the stress of the lower diaphragm 173. In the lower diaphragm 173 and the upper diaphragm 172, a change in the stress when the high pressure pump 1 is brought from the non-acting state into the action starting state and from the acting state into the non-acting state is reduced by the cover part 182, 292 of the upper/lower support members 180, 190.

In the present embodiment, the following effects are produced. (1) In the present embodiment, the ring-shaped parts 181, 291 of the upper/lower support members 180, 190 are formed parallel to the peripheral edge portions 174, 178 of the upper/lower diaphragms 172, 173 and in the shape of a ring and are joined to each other together with the peripheral edge portions 174, 175 of the upper/lower diaphragms 172, 173 in the entire circumference by the laser welding. The peripheral edge portions 174, 175 are increased in rigidity by the ring-shaped parts 181, 291, whereby the peripheral edge portion 174 of the upper diaphragm 172 and the peripheral edge portion 175 of the lower diaphragm 173 are inhibited from being displaced in the direction in which they are separated from each other. Hence, it is possible to reliably inhibit a repeated stress from being applied to the joined portion 177 of the peripheral edge portions 174, 175 of the upper/lower diaphragms 172, 173 by a stress amplitude of the pulsation damper body 170. (2) In the present embodiment, the pulsation damper body 171, the upper support member 180, and the lower support member 190 are constructed as a sub-assembly, so that a man-hour required for incorporating the pulsation damper 170 into the fuel chamber 163 can be reduced. (3) In the present embodiment, the lower support body 293 of the lower support member 190 is engaged with the outer wall of the projected portion 119 of the cylinder part 11. This can surely inhibit the pulsation damper 170 from moving in the radial direction. Thus, the pulsation damper body 171 can be positioned easily and surely in the fuel chamber 163. (4) In the present embodiment, the hole made in the first plate that is the base material of the upper support member 180 by cutting out the upper support body 183 from the first plate becomes the fuel passage 185. Further, the hole made in the second plate that is the base material of the lower support member 190 by cutting out the lower support body 293 from the second plate becomes the fuel passage 295. In this way, without working the pump body 20 or the cover member 160, the upper support 183 and the lower support body 293 can be formed in the upper support member 180 or the lower support member 190 and, at the same time, can form the fuel passages 185, 295. Hence, the production process of the upper support member 180 and the lower support member 190 can be simplified and hence the production cost can be reduced. (5) In the present embodiment, the upper/lower diaphragms 172, 173 are inhibited from bulging in the direction in which they are separated from each other by the upper/lower cover parts 182, 292 of the upper/lower support members 180, 190 supporting the pulsation damper body 171. For this reason, the stress amplitude of the pulsation damper 170 is reduced, which hence inhibits the repeated stress from being applied to the joined portions 177 of the peripheral edge portions 174, 175 of the upper/lower diaphragms 172, 173. Hence, the period of endurance of the pulsation damper 170 can be elongated. (6) In the present embodiment, the upper support body 183 abutting on the cover member 160 connects with the upper cover part 182, so that the displacement of the upper cover part 182 are inhibited. Hence, by the upper cover part 182, the movable part 178 of the upper diaphragm 172 can be surely inhibited from being displaced to the cover member side. Further, the lower support body 293 abutting on the upper pump body 20 connects with the lower cover part 292, so that the displacement of the lower cover part 292 is inhibited. Hence, by the lower cover part 292, the movable part 179 of the lower diaphragm 173 can be surely inhibited from being displaced to the pump body side. (7) In the present embodiment, the upper ring-shaped part 181, the upper cover part 182, and the upper support body 183 are integrally constructed, and the lower ring-shaped part 291, the lower cover part 292, and the lower support body 293 are integrally constructed, so that the pulsation damper 170 can be fitted in the fuel chamber 163 by a simple construction and the period of endurance of the pulsation damper 170 can be elongated. Further, the number of parts is not increased and hence the production cost of the pulsation damper 170 can be reduced.

(14th Embodiment)

Figure 27:
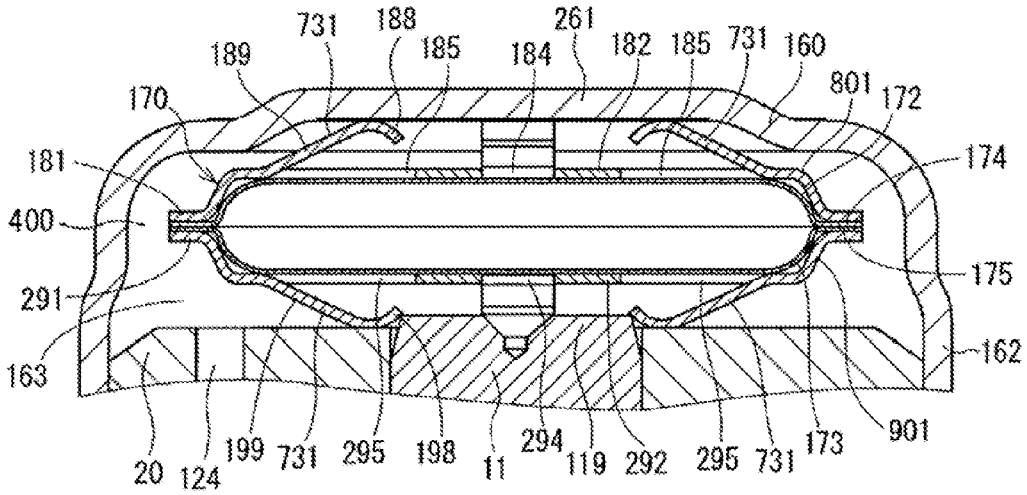
FIG. 27 is a section view, on an enlarged scale, of a main portion of a high pressure pump according to a 14th embodiment.

A high pressure pump according to a 14th embodiment will be shown in FIG. 27. In the 14th embodiment, four upper support bodies 731 of the upper support member 801 connect with the upper cover part 182 on the cover member side of the movable part 178 of the upper diaphragm 172 and extend to the inside in the radial direction from the positions in which the upper support bodies 731 connect with the upper cover part 182. Specifically, the upper support body 731 has its one end connected with an outer peripheral side of the upper cover part 182 (in detail, a position outside half the radius of the upper diaphragm 172 and inside a bent portion of the upper cover part 182) and has the other end extended to an inner peripheral side of the upper cover part 182. The upper support body 731 has a slant part 189, which extends on the slant from the upper cover part 182 to a bottom side of the cover member 160 and a curving part 188, which curves to an upper diaphragm side from an end portion inside in the radial direction of the slant part 189. The slant part 189 abuts on an inner wall of the cover member 160. The four lower support bodies 731 of the lower support member 901 connect with the lower cover part 292 on a pump body side of the movable part 179 of the lower diaphragm 173 and extend to the inside in the radial direction from the positions in which the lower support bodies 731 connect with the lower cover part 292. Specifically, the lower support body 731 has its one end connected with an outer peripheral side of the lower cover part 292 (in detail, a position outside half the radius of the lower diaphragm 173 and inside a bent portion of the lower cover part 292) and has the other end extended to an inner peripheral side of the lower cover part 292. The lower support body 731 has a slant part 199, which extends on the slant from the lower cover part 292 to a bottom side of the cover member 160, and a curving part 198, which curves from an end portion inside in the radial direction of the slant part 199 to the lower diaphragm. The slant part 199 abuts on the upper pump body 20 and the curving part 198 abuts on the projected portion 119 of the cylinder part 11.

The four upper support bodies 731 are formed at the same time of press-working the fuel passages 184, 185 of the upper cover part 182 or by bending conducted after the press-working. A hole formed when the upper support body 731 is cut out of the first plate becomes the fuel passage 185. The four lower support bodies 731 are formed at the same time of press-working the fuel passages 294, 295 of the lower cover part 292 or by bending conducted after the press-working. A hole formed when the lower support body 731 is cut out of the second plate becomes the fuel passage 295. A load to be applied to the upper support body 731 is set by the material and the thickness of the upper support body 731, an angle formed by the upper cover part 182 and the slant part 189. A load to be applied to the lower support body 731 is set by the material and the thickness of the lower support body 731, an angle formed by the lower cover part 292 and the slant part 199. The projected portion 119 of the cylinder part 11 is inserted into between the four lower support bodies 731. The lower support bodies 731 are engaged with an outer wall in the radial direction of the projected portion 119 of the cylinder part 11. This inhibits the pulsation damper 170 from moving in the radial direction. Also in the 14th embodiment, the same effects as in the 13th embodiment described above can be produced.

(15th Embodiment)

Figure 28A:
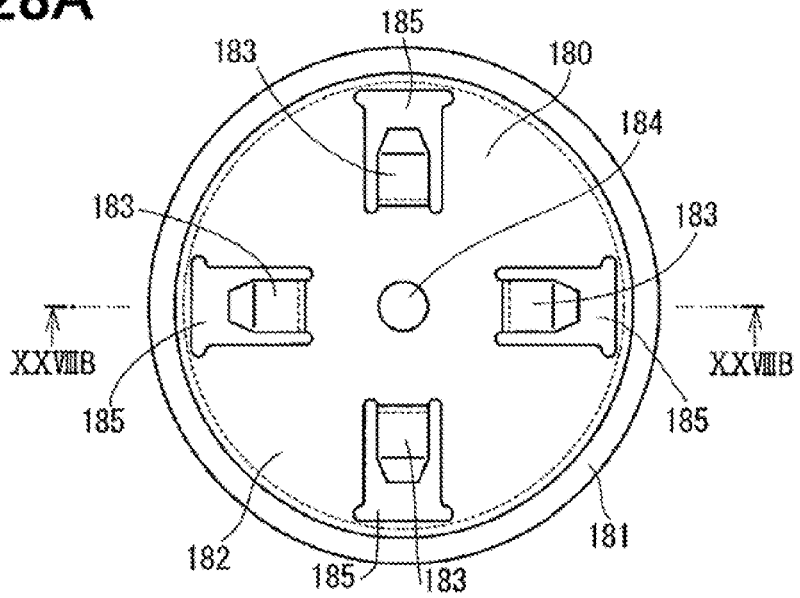
FIG. 28A is a plan view of a pulsation damper to be set in a high pressure pump according to a 15th embodiment.
Figure 28B:
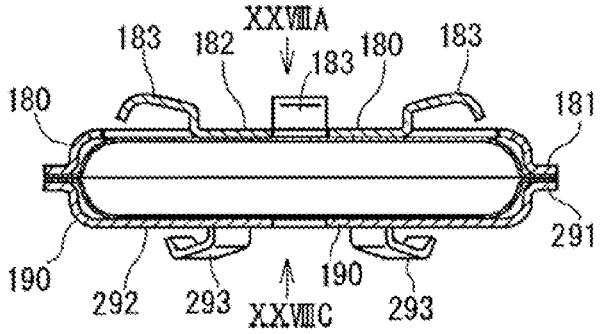
FIG. 28B is a section view taken on a line XXVIIIB-XXVIIIB in FIG. 28A.
Figure 28C:
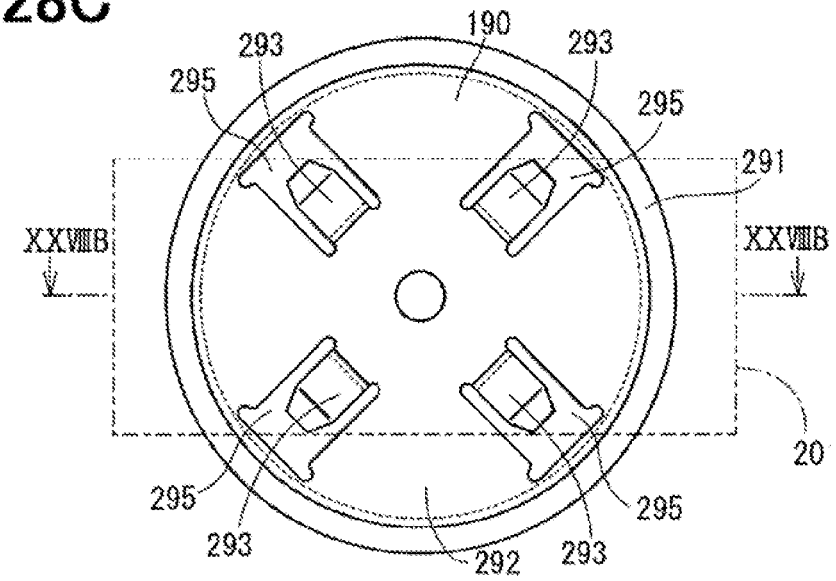
FIG. 28C is a view when viewed from a XXVIIIC direction shown by arrows in FIG. 28B and a bottom view of the pulsation damper.

A main portion of a high pressure pump according to a 15th embodiment will be shown in FIGS. 28A to 28C. In the 15th embodiment, the upper support member 180 and the lower support member 190 are joined to each other in the state in which they are turned by 45° in the peripheral direction. The position of the upper pump body 20 is shown by a single-dot and dash line in FIG. 28C. Four lower support bodies 293 surely abut on the upper pump body 20. In the 15th embodiment, in the case where there is a limit in a direction in which the upper support member 180 is fitted under the conditions, for example, that an inner wall of the cover member 160 has depressions and projections, the pulsation damper 170 can be set in the fuel chamber 163 without enlarging the width of the upper pump body 20.

(16th Embodiment)

Figure 29:
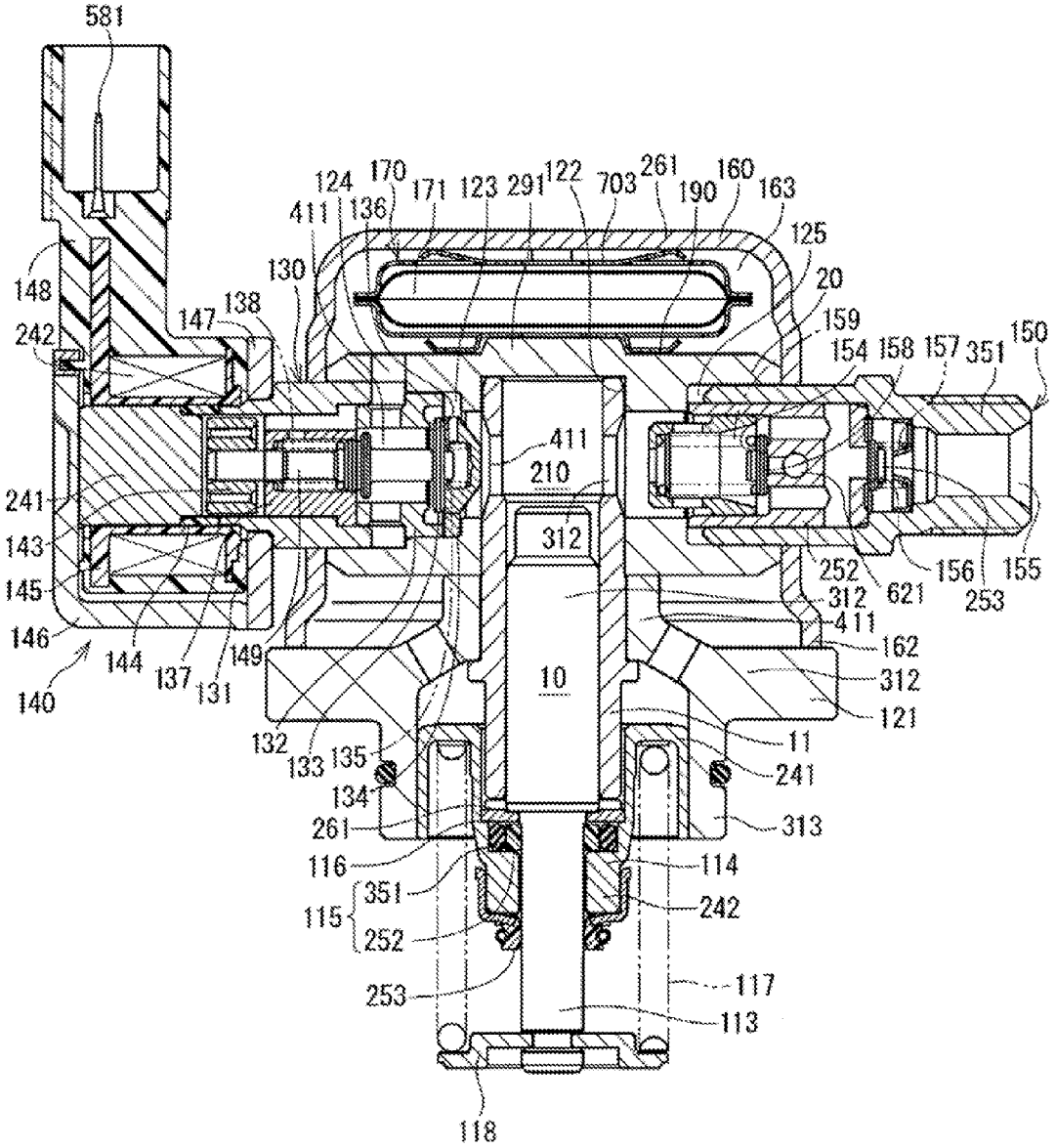
FIG. 29 is a section view of a high pressure pump according to a 16th embodiment.
Figure 30:
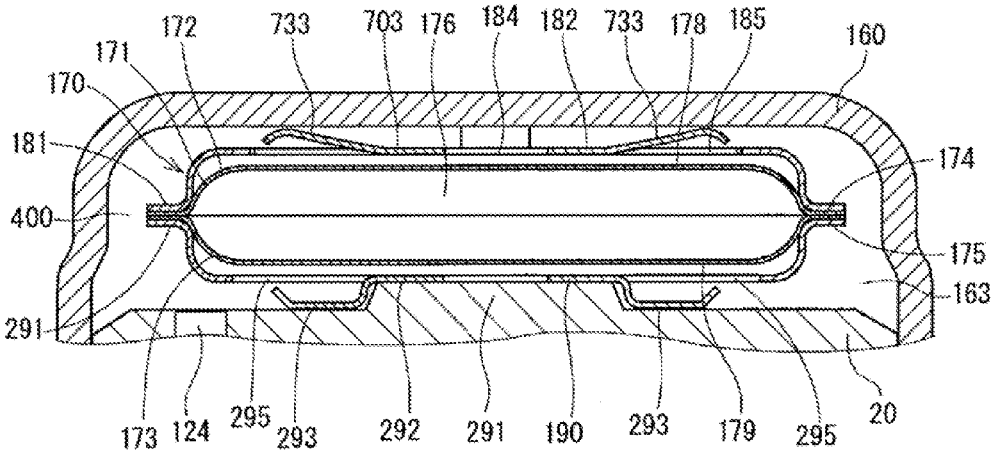
FIG. 30 is a section view, on an enlarged scale, of a main portion of the high pressure pump according to the 16th embodiment.

A high pressure pump according to a 16th embodiment will be shown in FIG. 29 and its main portion will be shown in FIG. 30. In the 16th embodiment, the cylinder part 11 does not project into the fuel chamber 163 from the upper pump body 20. Instead, the upper pump body 20 has a projected portion 291. An upper member 703 has the upper ring-shaped part 181, the upper cover part 182, and an upper support body 733. The upper support body 733 abuts on the cover member 160. The upper support body 733 presses the cover member 160 to a side opposite to the upper pump body 20 by a given spring force. The lower support member 190 has the lower ring-shaped part 291, the lower cover part 292, and the lower support body 293. The lower support body 293 abuts on the upper pump body 20 and the projected portion 291 of the upper pump body 20. In this way, the pulsation damper 170 is limited in the movement in the radial direction and is positioned in the fuel chamber 163. The lower support body 293 presses the upper pump body 20 to a side opposite to the cover member 160 by a given spring force. Also in the present embodiment, a hole made in the first plate that is the base material of the upper support member 70 by cutting out the upper support body 733 from the first plate becomes a fuel passage 185. Further, a hole made in the second plate that is the base material member of the lower support member 190 by cutting out the lower support body 293 from the second plate becomes a fuel passage 295. Also in the 16th embodiment, the same effects as in the 13th to the 15th embodiments described above can be produced.

(17th Embodiment)

Figure 31:
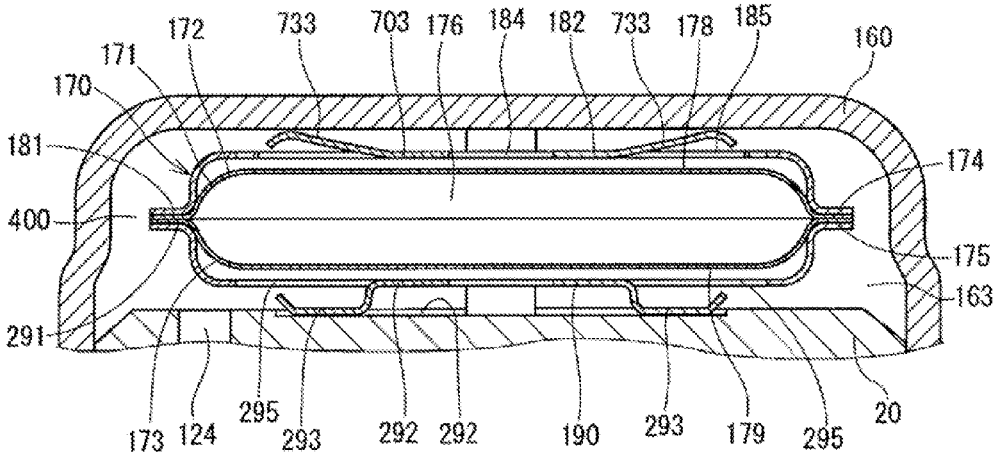
FIG. 31 is an enlarged section view of a main portion of a high pressure pump according to a 17th embodiment.

A main portion of a high pressure pump according to a 17th embodiment will be shown in FIG. 31. In the 17th embodiment, a depressed portion 292 is formed in the upper pump body 20. The lower support body 293 of the lower support member 190 abuts on the depressed portion 292 of the upper pump body 20. In this way, the pulsation damper 170 is limited in the movement in the radial direction and is positioned in the fuel chamber 163. Also in the 17th embodiment, the same effects as in the 13th to the 16th embodiments described above can be produced.

(18th Embodiment)

Figure 32:
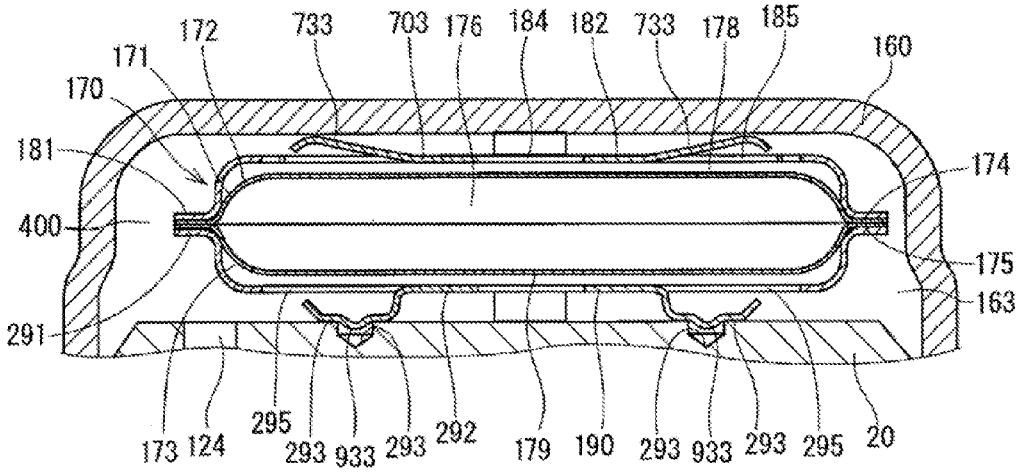
FIG. 32 is a section view, on an enlarged scale, of a main portion of a high pressure pump according to an 18th embodiment.

A main portion of a high pressure pump according to an 18th embodiment will be shown in FIG. 32. In the 18th embodiment, holes 293 are formed in the upper pump body 20. The lower support body 293 of the lower support member 190 has projections 933 at the positions corresponding to the holes 293 of the upper pump body 20. When the projections 933 of the lower support body 293 are fitted in the holes 293 of the upper pump body 20, the pulsation damper 170 is limited in the movement in the radial direction and is positioned in the fuel chamber 163. Further, in the 18th embodiment, the pulsation damper 170 is positioned in a position shifted in the direction separated from the communication passage 124 of the upper pump body 20 (in a right direction in FIG. 32). For this reason, a space near the communication passage 124 of the fuel chamber 163 is made wider. Hence, the flow coefficient of the fuel flowing to the communication passage 124 from the fuel chamber 163 increases and hence the fuel easily flows. Further, the flow coefficient of the fuel flowing to the fuel chamber 163 from the communication passage 124 increases and hence the fuel easily flows. Hence, the pressure pulsation of the fuel can be reduced and the suction efficiency of the fuel from the fuel chamber 163 into the pressurizing chamber 210 can be improved.

(19th Embodiment)

Figure 33:
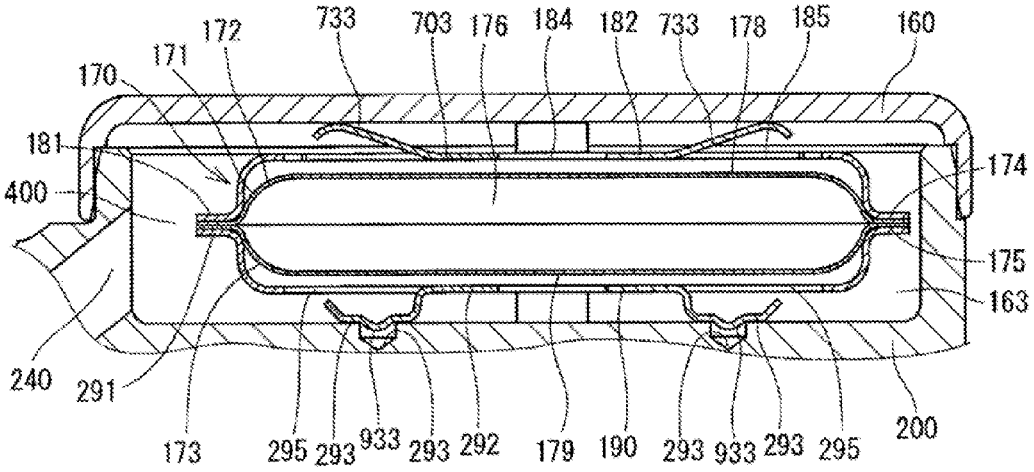
FIG. 33 is a section view, on an enlarged scale, of a main portion of a high pressure pump according to a 19th embodiment.

A main portion of a high pressure pump according to a 19th embodiment will be shown in FIG. 33. In the 19th embodiment, a pump body 200 has a communication passage 240 formed therein. The communication passage 240 is open in an inner wall of the fuel chamber 163 positioned outside in the radial direction of the pulsation damper 170. Also in this case, the pulsation damper 170 is positioned in a position shifted in the direction separated from the communication passage 240 of the upper pump body 200, so that a space near the communication passage 240 of the fuel chamber 163 is made wider. Hence, the flow coefficient of the fuel flowing to the communication passage 240 from the fuel chamber 163 increases and hence the fuel easily flows. Further, the flow coefficient of the fuel flowing to the fuel chamber 163 from the communication passage 240 increases and hence the fuel easily flows. Hence, the pressure pulsation of the fuel can be reduced and the suction efficiency of the fuel from the fuel chamber 163 into the pressurizing chamber 210 can be improved.

(20th Embodiment)

Figure 34:
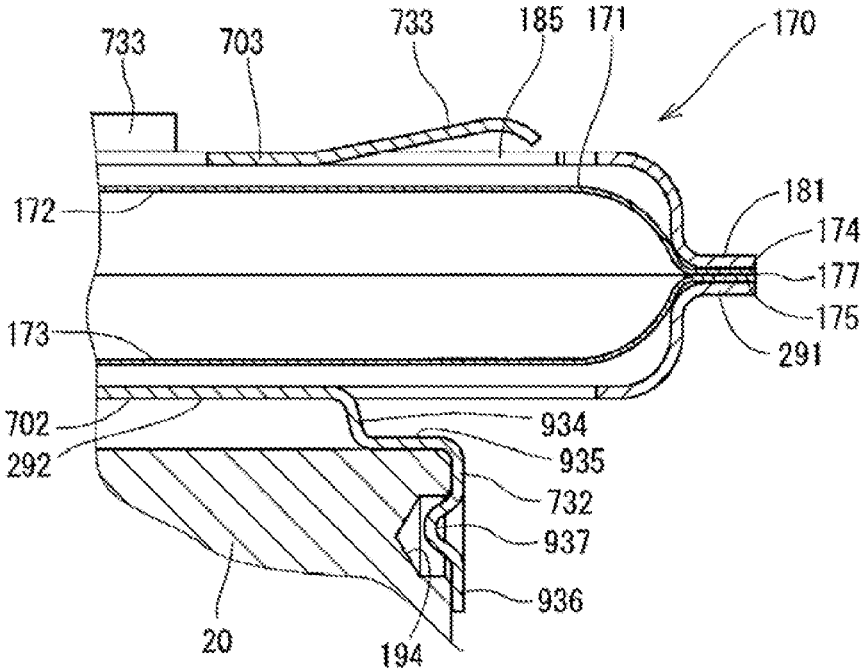
FIG. 34 is a section view, on an enlarged scale, of a main portion of a high pressure pump according to a 20th embodiment.
Figure 35:
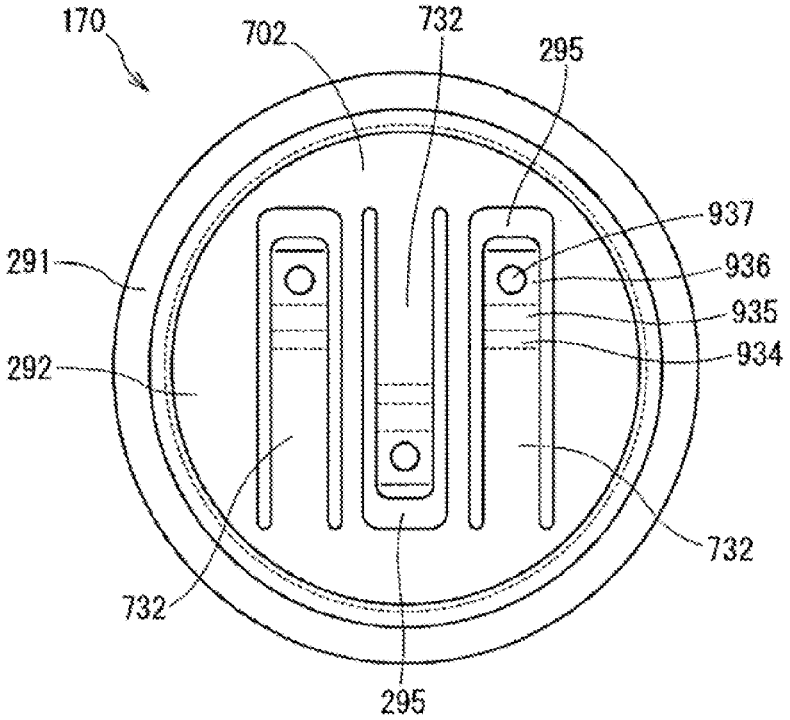
FIG. 35 is a plan view of a lower support member, which is not yet bent, according to the 20th embodiment.
Figure 36:
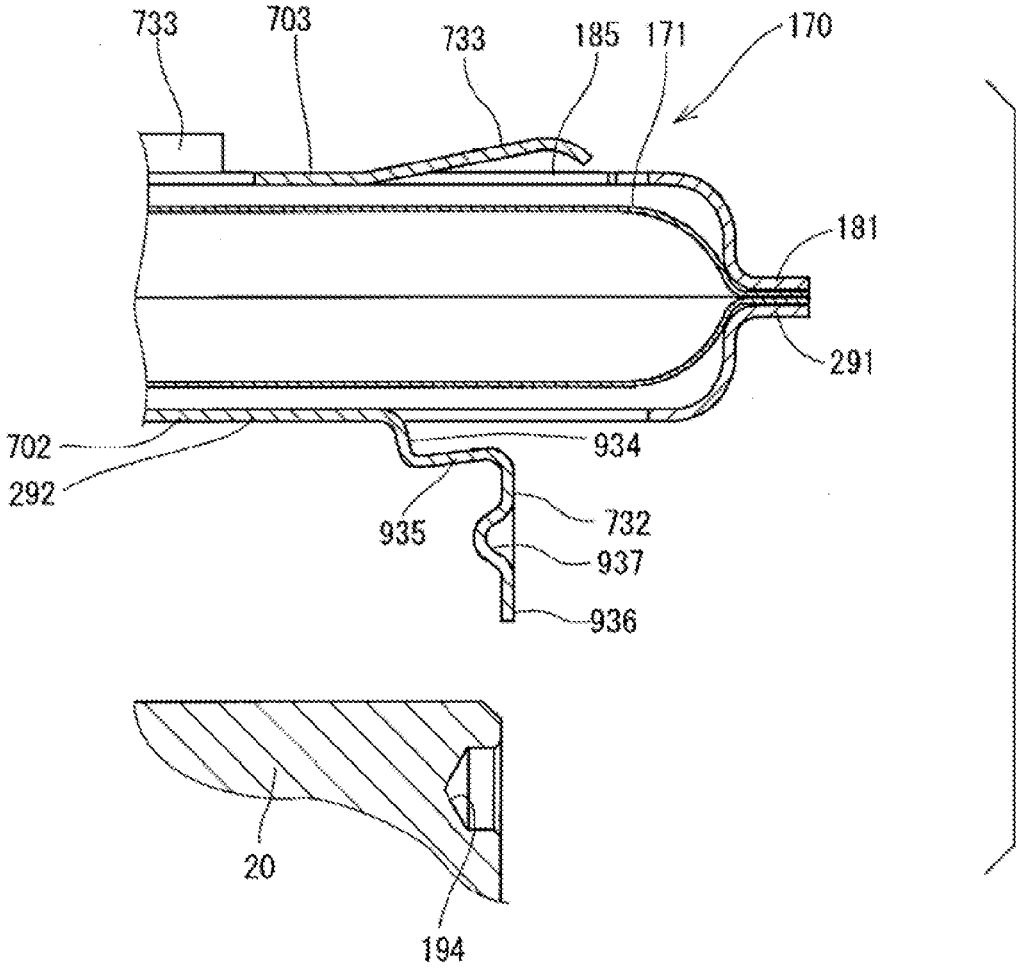
FIG. 36 is an illustration of fitting the lower support member in pump body according to the 20th embodiment.

A main portion of a high pressure pump according to a 20th embodiment will be shown in FIGS. 34 to 36. In the 20th embodiment, a lower support body 732 of a lower support member 702 has a leg part 934, a body abutting part 935, a body engaging part 936, and a projection 937. The leg part 934 extends from the lower cover part 292 to the pump body 20 side. The body abutting part 935 extends nearly in parallel to a top surface of the pump body 20 from an end portion on the pump body side of the leg part 934. The body engaging part 936 extends along an end face in the width direction of the pump body 20. The projection 937 is formed in the body engaging part 936 and is fitted in a hole 194 formed in the pump body 20. In this way, the lower support member 702 is engaged with the pump body 20 by the lower support body 732, so that the pulsation damper 170 can be fitted in the fuel chamber 163.

As shown in FIG. 35, the lower support body 732 is formed at the same time of press-working the second plate that is the base material of the lower support member 702 or by bending performed after the press-working. In FIG. 35, the positions in which the leg part 934, the body abutting part 935, and the body engaging part 935 of the lower support body 732 are bent are shown by broken lines. A hole made in the second plate by cutting out the lower support body 732 from the second plate becomes a fuel passage 295. As shown in FIG. 36, before the lower support body 732 is fitted in the pump body 20, the body abutting part 935 and the top surface of the pump body 20 are not parallel to each other. For this reason, when the lower support body 735 is fitted in the pump body 20, a spring force of lifting up the projection 937 is applied to the lower support body 732 and hence the projection 937 is surely fixed in the hole 194. Hence, this can prevent the pulsation damper 170 from rattling because of the manufacturing tolerances of the projection 937 and the hole 194.

In the 20th embodiment, by engaging only the lower support body 732 of the lower support member 702 with the pump body 20, the pulsation damper 170 can be fitted in the fuel chamber 163. Hence, the pulsation damper 170 can be fitted in the fuel chamber 163 by a simple construction. Further, the size of the lower support body 732 can be decreased and the flow of the fuel in the fuel chamber 163 can be made better.

(21st Embodiment)

Figure 37:
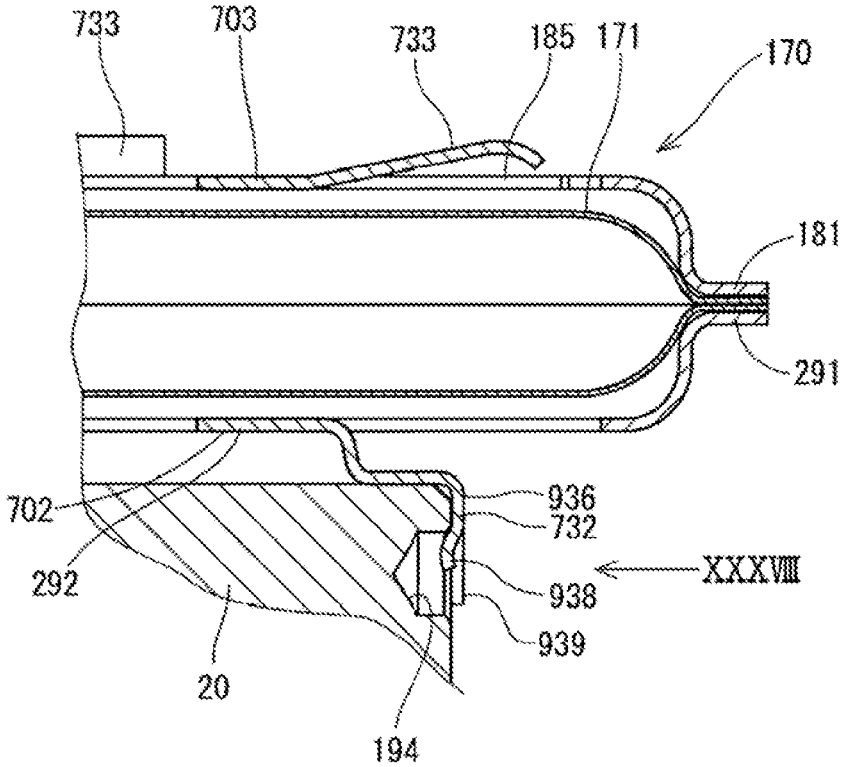
FIG. 37 is a section view, on an enlarged scale, of a main portion of a high pressure pump according to a 21st embodiment.
Figure 38:
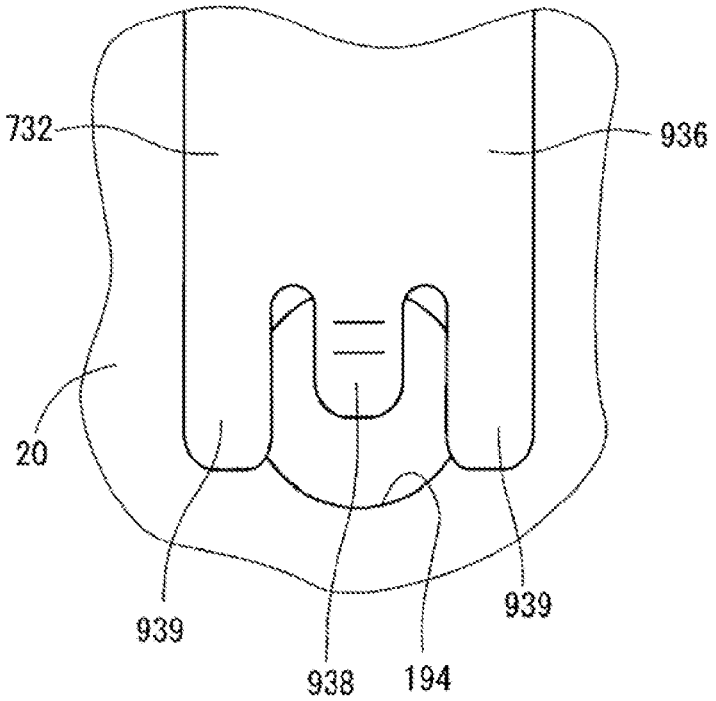
FIG. 38 is an illustration when viewed from a XXXVIII direction shown by arrows in FIG. 37.

A main portion of a high pressure pump according to a 21st embodiment will be shown in FIG. 37 and FIG. 38. In the 20th embodiment, the body engaging part 936 of the lower support body 732 is divided into three portions. A central portion 938 of the three portions is greatly bent to the hole 194 of the pump body 20 and is engaged with the hole 194. Both side portions 939 of body engaging part 936 prevent the lower support body 732 from being slanted.

(22nd Embodiment)

Figure 39:
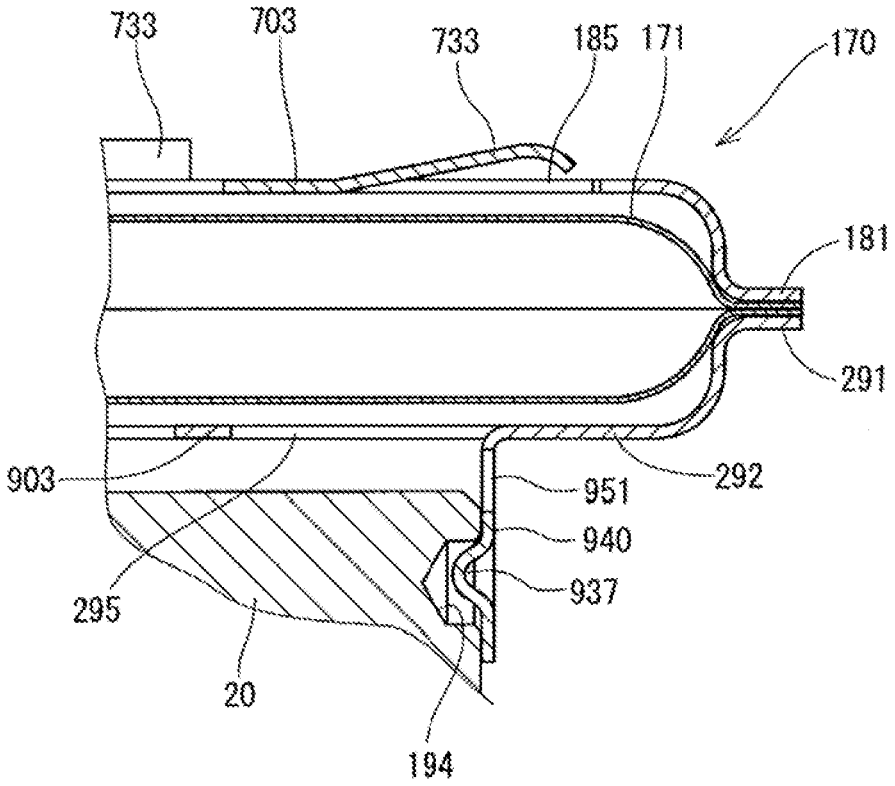
FIG. 39 is a section view, on an enlarged scale, of a main portion of a high pressure pump according to a 22nd embodiment.
Figure 40:
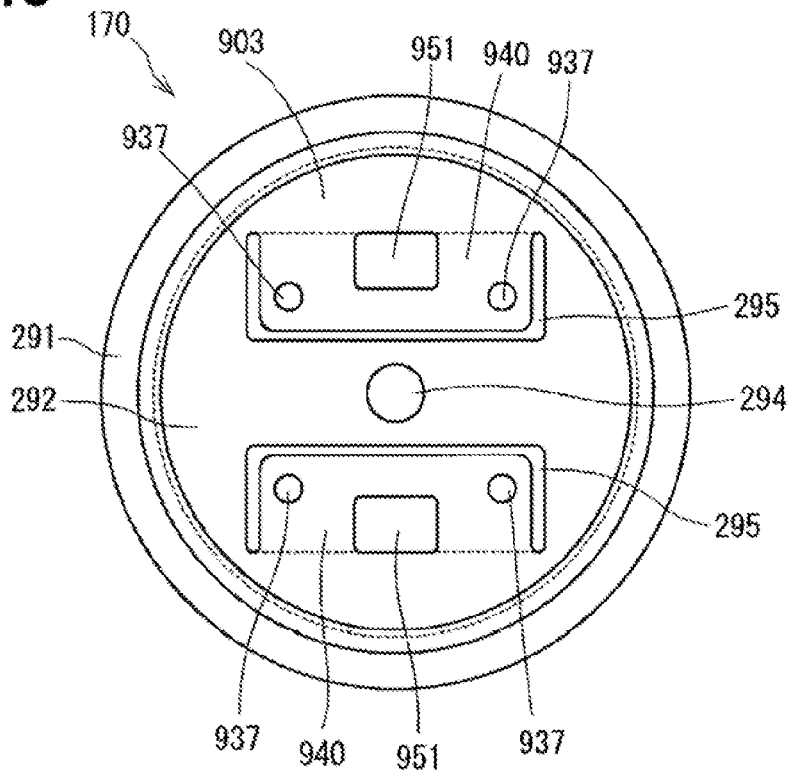
FIG. 40 is a plan view of a lower support member, which is not yet bent, according to the 22nd embodiment.

A main portion of a high pressure pump according to a 22nd embodiment will be shown in FIG. 39 and FIG. 40. In the 22nd embodiment, the lower cover part 292 has a lower support body 940 of a lower support member 903 formed therein. The lower support body 940 extends parallel to an end face in the width direction of the pump body 20. The projection 937 formed in the lower support body 940 is fitted in the hole 194 of the pump body 20. In this way, the pulsation damper 170 is fitted in the fuel chamber 163. In FIG. 40, the position in which the lower support body 940 is bent is shown by broken lines. A hole made in the second plate by cutting out the lower support body 940 from the second plate becomes the fuel passage 295. Further, the lower support body 940 has a fuel passage 951 formed therein. The fuel of the fuel chamber 163 can flow through the fuel passage 951.

(23rd Embodiment)

Figure 41:
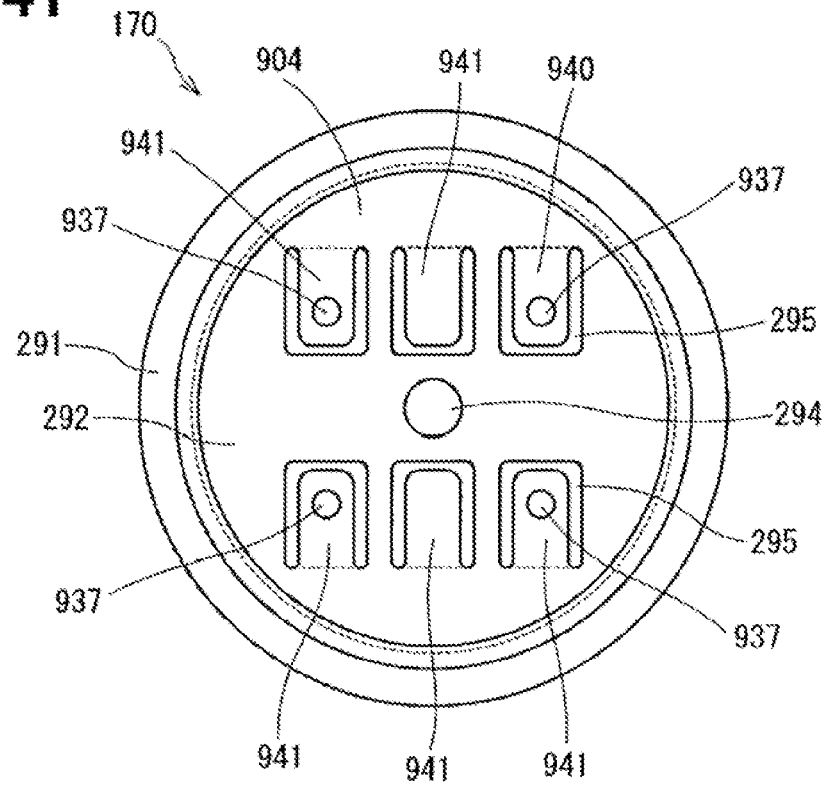
FIG. 41 is a plan view of a lower support member, which is not yet bent, according to a 23rd embodiment.
Figure 42:
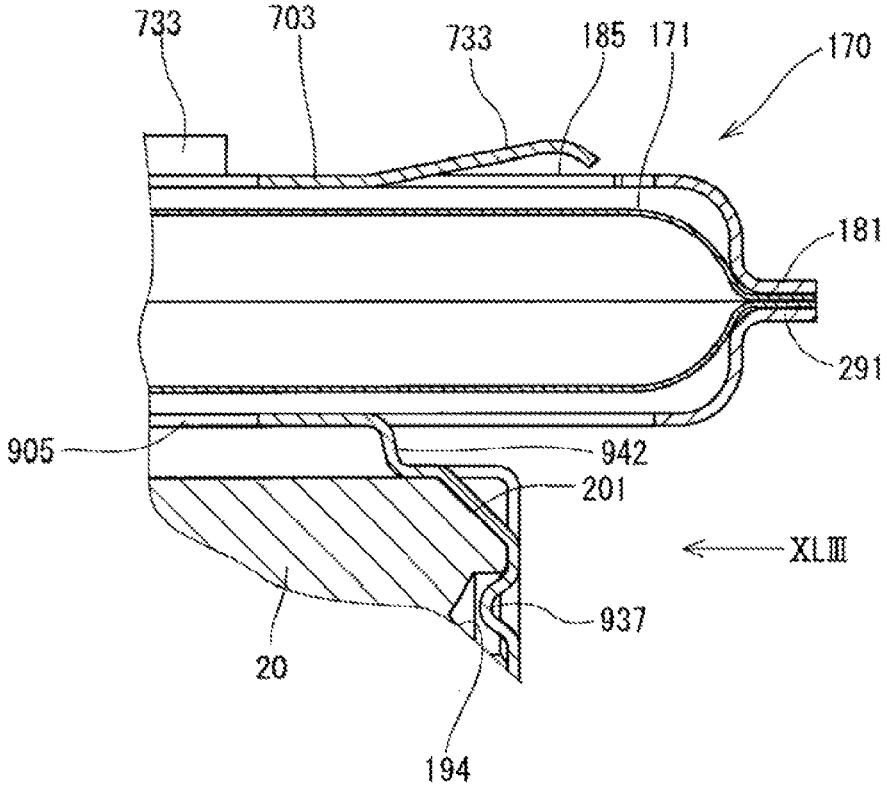
FIG. 42 is a section view, on an enlarged scale, of a main portion of a high pressure pump according to a 24th embodiment.
Figure 43:
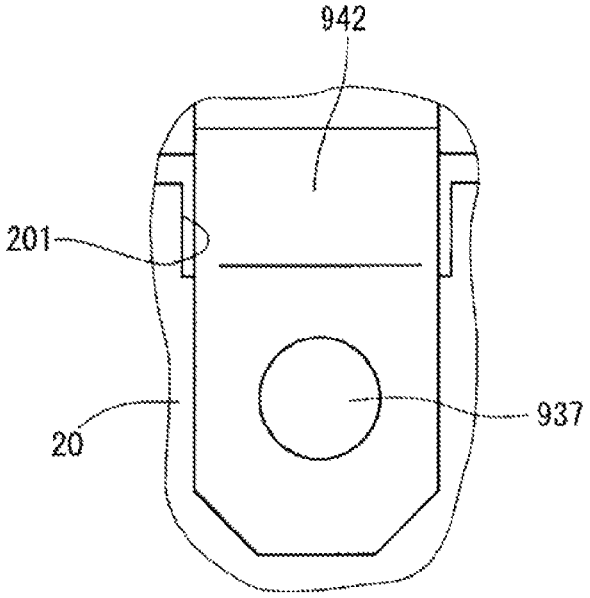
FIG. 43 is an illustration when viewed from a XLIII direction shown by arrows in FIG. 42.
Figure 44:
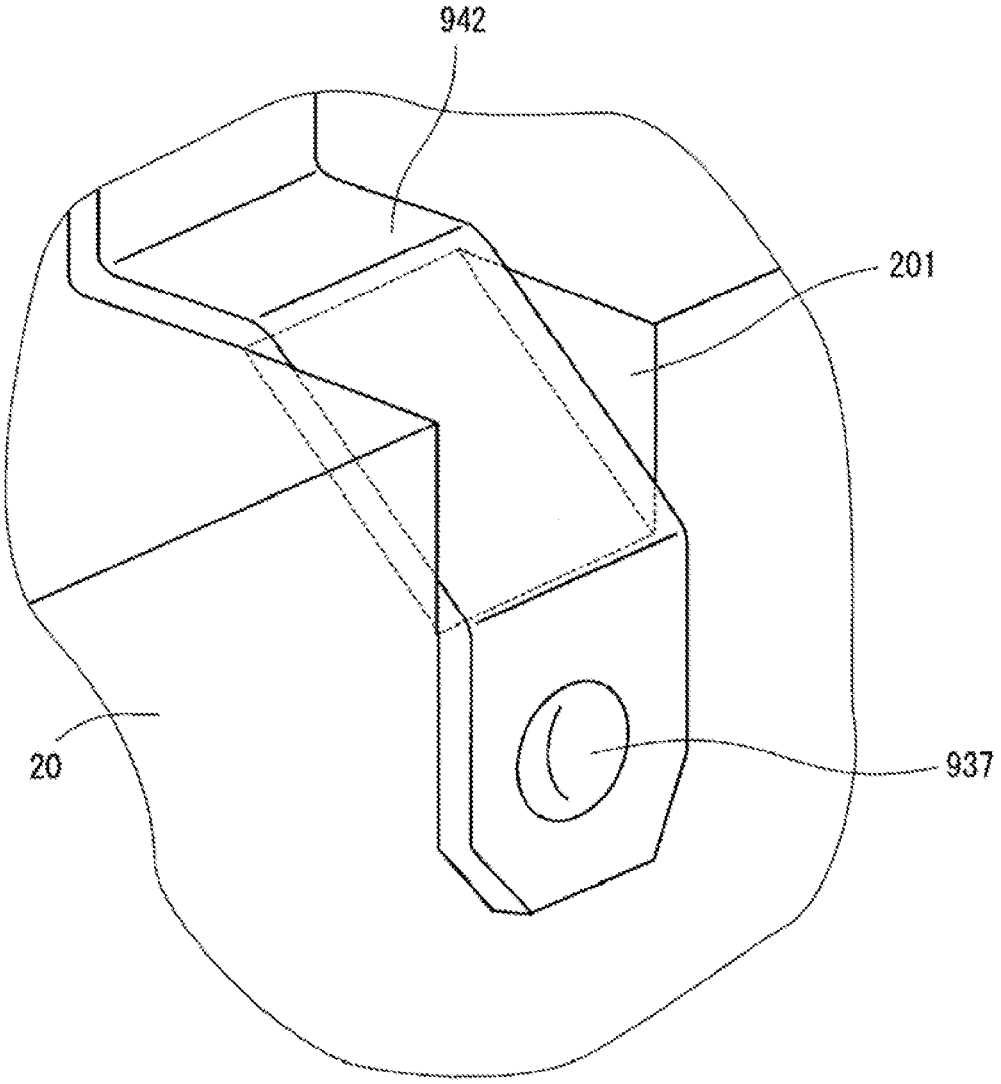
FIG. 44 is a perspective view in FIG. 43.
Figure 45:
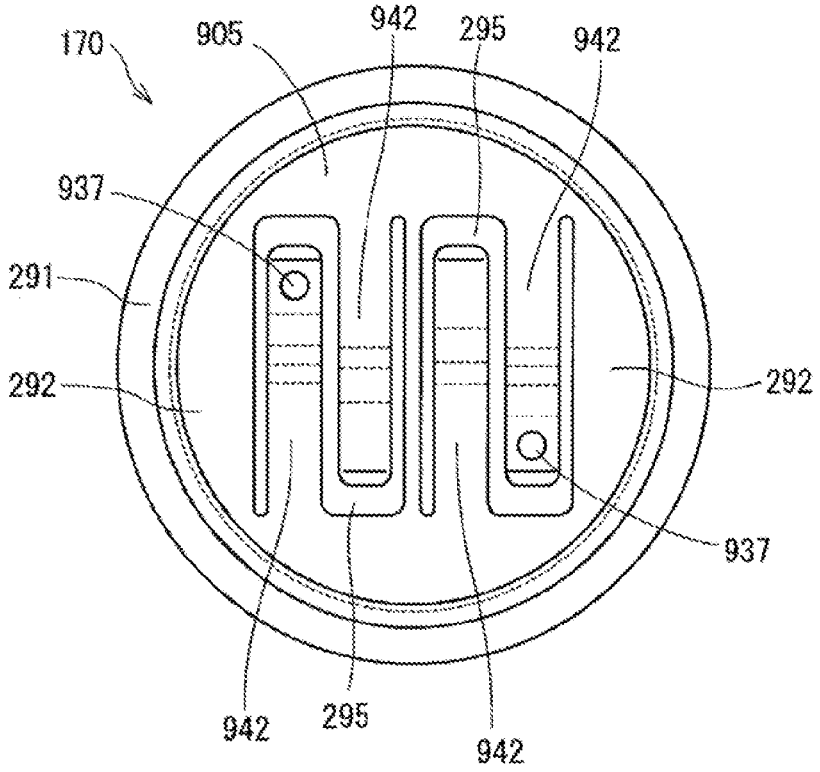
FIG. 45 is a plan view of a lower support member, which is not yet bent, according to the 24th embodiment.

A main portion of a high pressure pump according to a 23rd embodiment will be shown in FIG. 41. In the 23rd embodiment, three lower support bodies 941 of a lower support member 904 are formed on one end face of the pump body 20, respectively. The projection 937 formed in the lower support body 941 is fitted in the hole 194 of the pump body 20. In this way, the pulsation damper 170 is fitted in the fuel chamber 163. In FIG. 41, the positions in which the lower support body 941 is bent are shown by broken lines. A hole made in the second plate by cutting out the lower support body 941 from the second plate becomes the fuel passage 295. Further, a fuel passage is formed also between the lower support body 941 and the lower support body 941, respectively. The fuel of the fuel chamber 163 can flow through these fuel passages.

(24th Embodiment)

A main portion of a high pressure pump according to a 24th embodiment will be shown in FIGS. 42 to 45. In the 24th embodiment, a corner portion of the pump body 20 in which a lower support body 942 of the lower support member 905 is engaged with are cut out on the slant. By fitting the lower support body 942 in this cutout portion 201, the pulsation damper 170 can be prevented from being shifted in a position in the longitudinal direction of the pump body 20. Here, it is essential only that of the plurality of lower support bodies 942, the lower support body 942 corresponding to the cutout portion 201 of the pump body 20 is at least one for one end face in the width direction of the pump body 20. Further, before the lower support body 942 is fitted on the pump body 20, the cutout portion 201 of the pump body 20 and the lower support body 942 are not parallel to each other. For this reason, when the lower support body 942 is fitted on the pump body 20, a spring force of lifting up the projection 937 is applied to the lower support body 942, whereby the projection 937 of the lower support body 942 is surely fitted in the hole 194 of the pump body 20. Thus, this can prevent the pulsation damper 170 from rattling.

(25th Embodiment)

Figure 46:
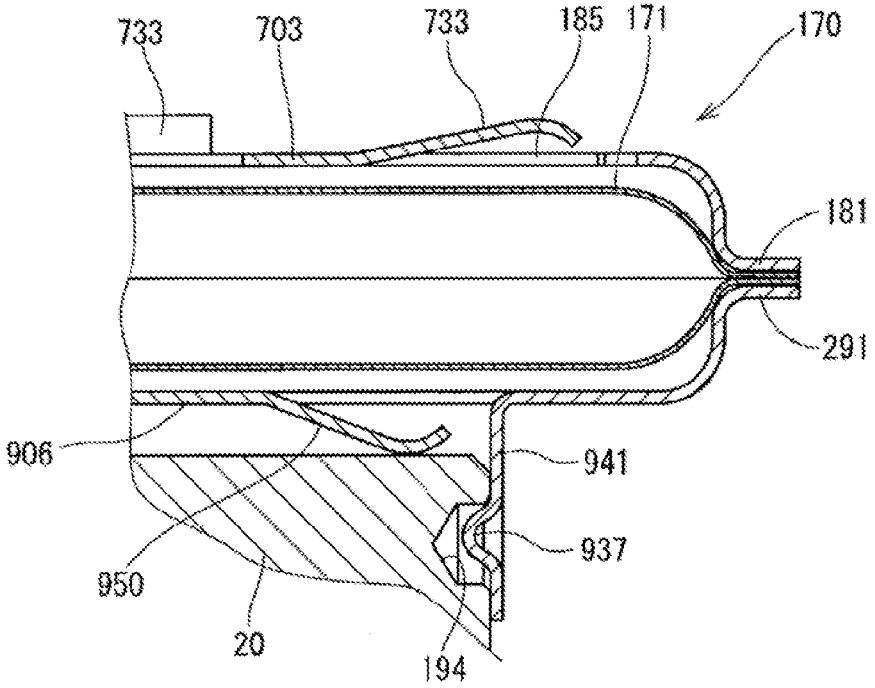
FIG. 46 is a section view, on an enlarged scale, of a main portion of a high pressure pump according to a 25th embodiment.
Figure 47:
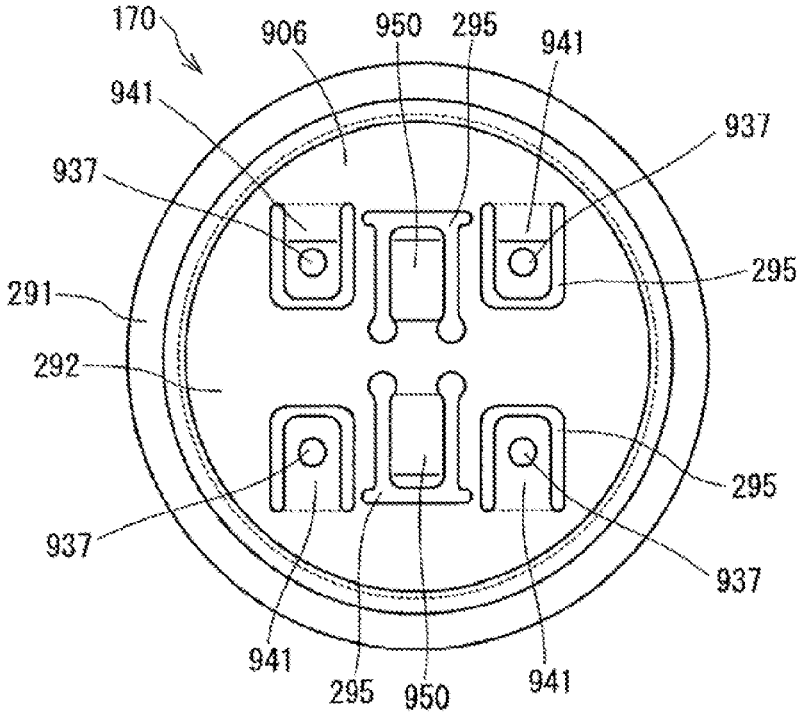
FIG. 47 is a plan view of a lower support member, which is not yet bent, according to the 25th embodiment.

A main portion of a high pressure pump according to a 25th embodiment will be shown in FIG. 46 and FIG. 47. In the 25th embodiment, a lower support member 906 has elastic parts 950 each having a spring force of pressing the pump body 20. As shown in FIG. 47, the elastic part 950 is cut out from the second plate together with the other lower support body 941. The elastic part 950 lifts up the pulsation damper 170 to the cover member side, so that the projection 937 of the lower support body 941 is surely fixed by the hole 194 of the pump body 20. Thus, this can prevent the pulsation damper 170 from rattling.

(26th Embodiment)

Figure 48:
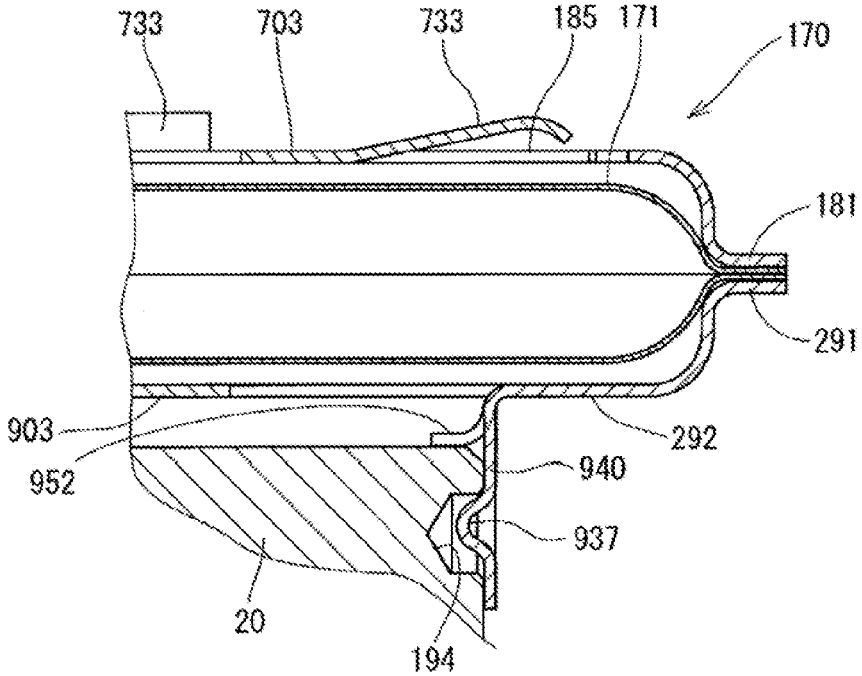
FIG. 48 is a section view, on an enlarged scale, of a main portion of a high pressure pump according to a 26th embodiment.
Figure 49:
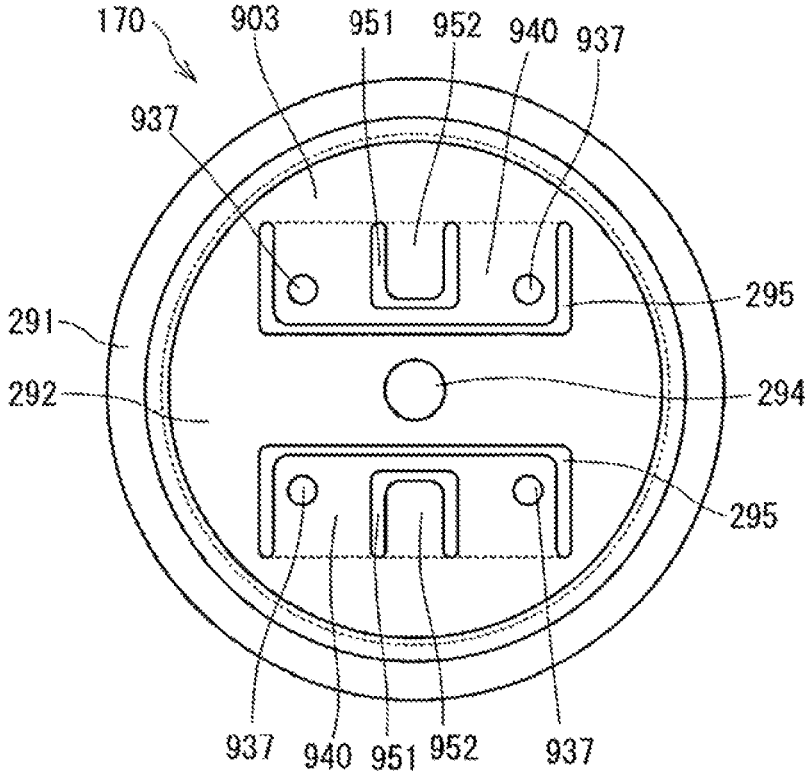
FIG. 49 is a plan view of a lower support member, which is not yet bent, according to the 26th embodiment.
Figure 50:
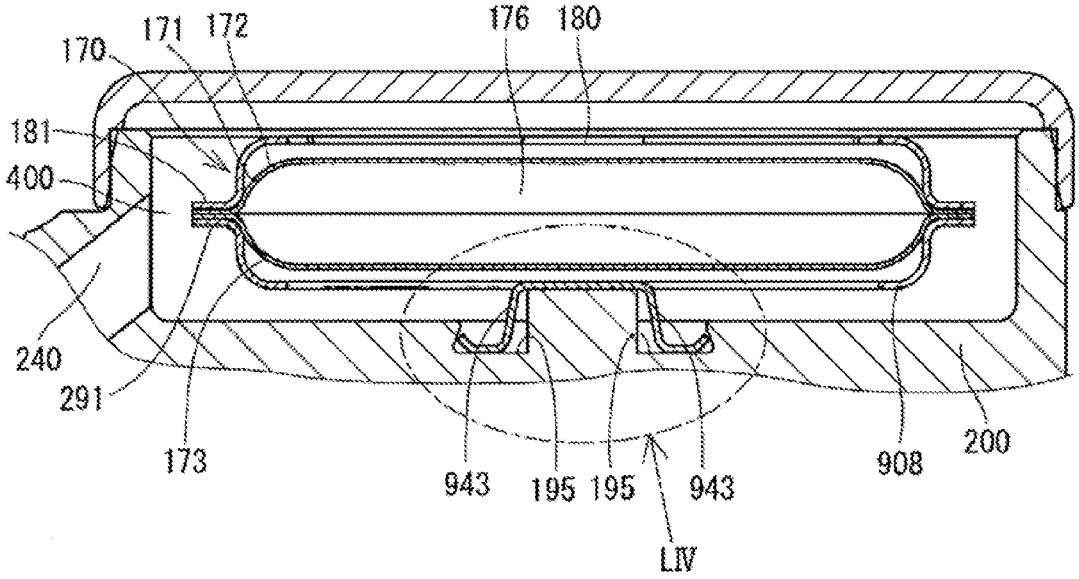
FIG. 50 is a section view, on an enlarged scale, of a main portion of a high pressure pump according to a 27th embodiment.
Figure 51:
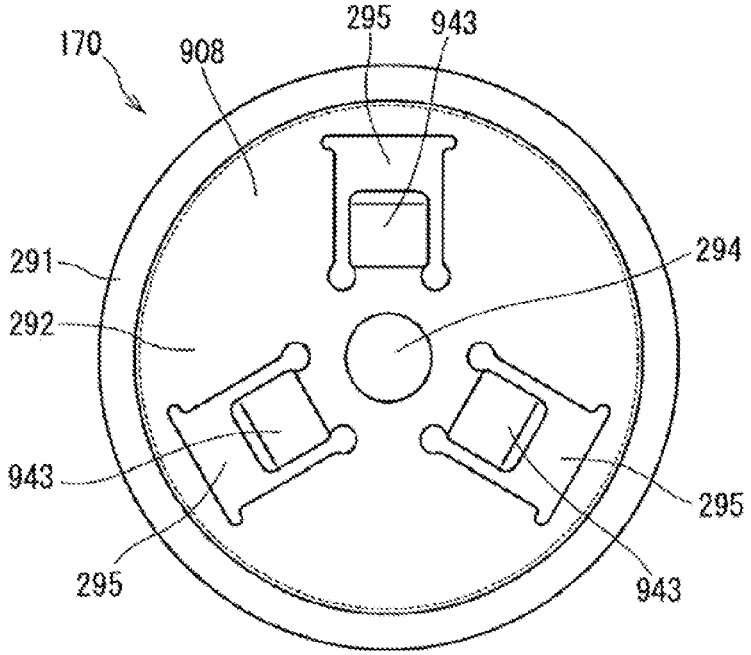
FIG. 51 is a plan view of a lower support member according to the 27th embodiment.

A main portion of a high pressure pump according to a 26th embodiment will be shown in FIG. 48 and FIG. 49. In the 26th embodiment, at the same time when a fuel passage 951 is formed in the lower support body 940 of he 22nd embodiment, a plate of the position in which the fuel passage 951 is formed is made an elastic part 952. The elastic part 952 abuts on the top face of the pump body 20 and has a spring force of pressing the pump body 20. The elastic part 952 lifts up the pulsation damper 170 to the cover member side, so that the projection 937 of the lower support body 940 is surely fixed by the hole 194 of the pump body 20. Thus, this can prevent the pulsation damper 170 from rattling.

(27th Embodiment)

Figure 52:
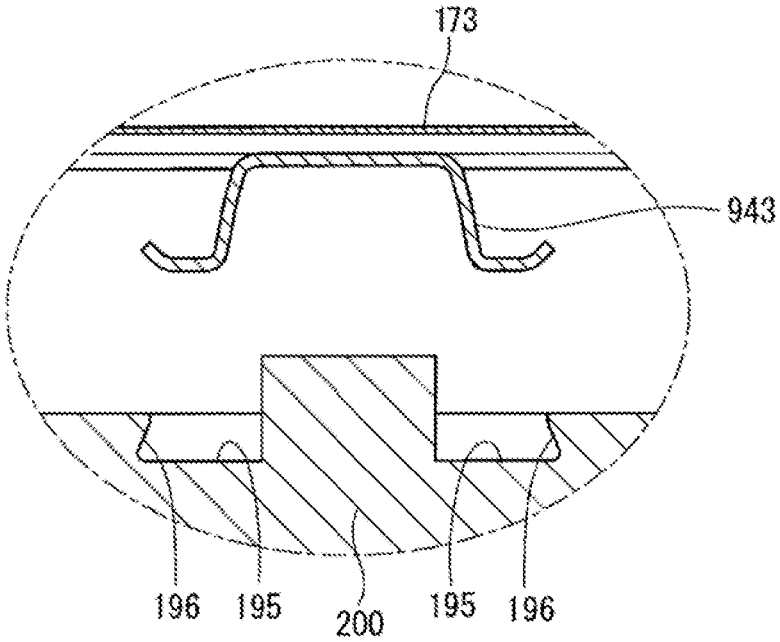
FIG. 52 is an illustration of fitting the lower support member in a pump body according to the 27th embodiment.
Figure 53:
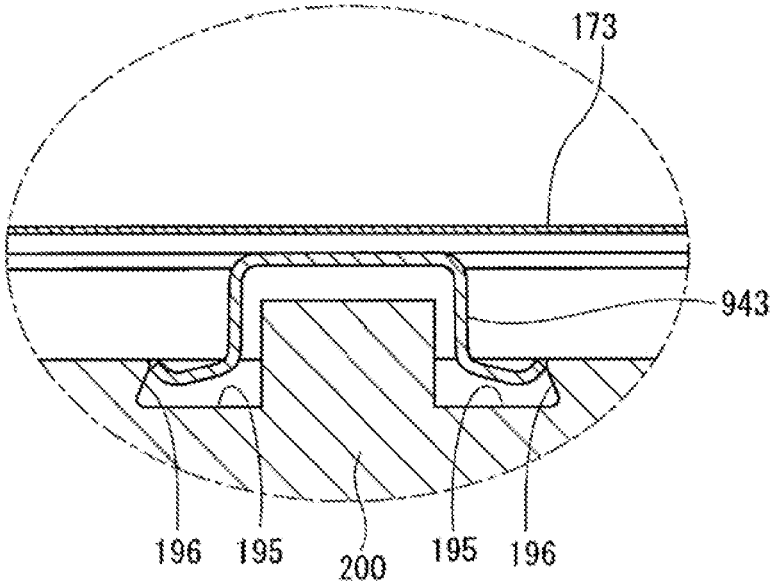
FIG. 53 is an illustration of fitting the lower support member in a pump body according to the 27th embodiment.
Figure 54:
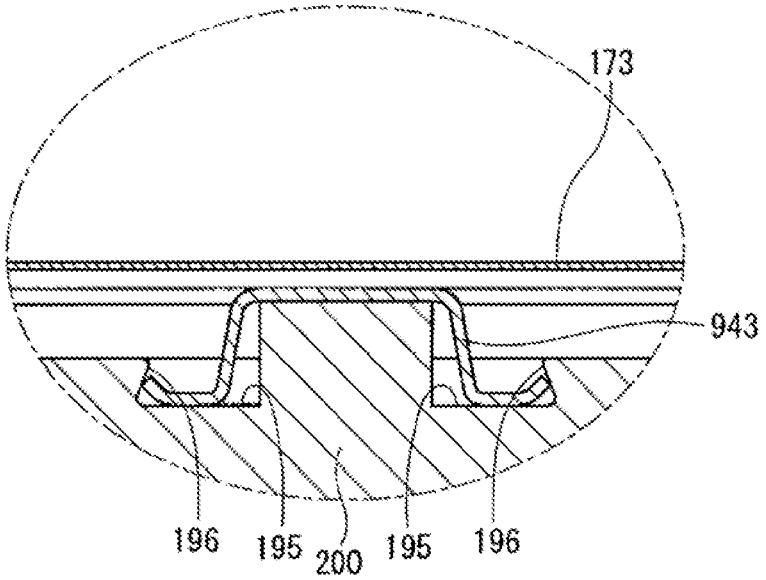
FIG. 54 is an illustration of fitting the lower support member in a pump body according to the 27th embodiment.

A main portion of a high pressure pump according to a 27th embodiment will be shown in FIGS. 50 to 54. In the 27th embodiment, a pump body 200 has a ring-shaped groove 195 formed therein. An inner peripheral wall 196 in the radial direction of the groove 195 has its diameter decreased in a tapered shape to the inside in the radial direction from a bottom side to the cover member side. A plurality of support bodies 943 arranged radially in a lower support member 908 are extended from the inside in the radial direction to the outside in the radial direction and are fitted on an inner peripheral wall of the groove 195, respectively. When the lower support bodies 943 are fitted in the groove 195 of the pump body 200, as shown in FIG. 52 and FIG. 53, the plurality of support bodies 943 are pressed to the inside in the radial direction by an end face on the cover member side of the inner peripheral wall 196 of the groove 195. Thereafter, when the lower support bodies 943 are further moved to the bottom side of the groove 195, as shown in FIG. 54, the plurality of lower support bodies 943 are opened to the outside in the radial direction by the elastic forces of themselves at the bottom of the groove 195, thereby being engaged with the inner peripheral wall 196 of the groove 195. In this way, the pulsation damper 170 is fitted to the pump body 200 by the lower support bodies 943 of the lower support member 908.

(28th Embodiment)

Figure 55:
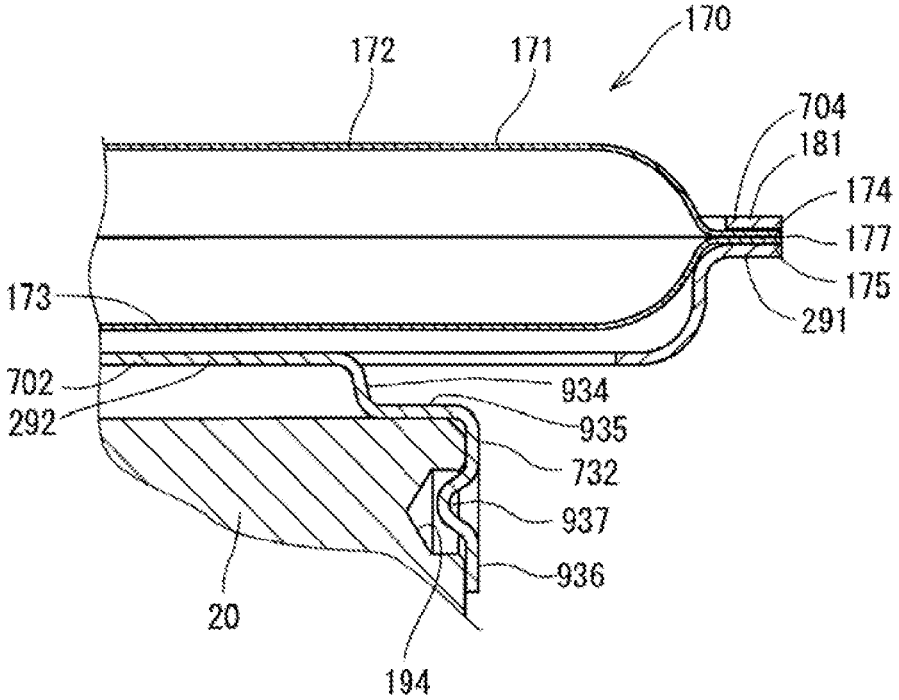
FIG. 55 is a section view, on an enlarged scale, of a main portion of a high pressure pump according to a 28th embodiment.

A main portion of a high pressure pump according to a 28th embodiment will be shown in FIG. 55. In the 28th embodiment, an upper support member 704 is constructed of only an upper ring-shaped part 181. The rigidity is increased by the upper ring-shaped part 181 of the upper support member 704 and a lower ring-shaped part 291 of a lower support member 702, which hence prevents a stress developed by the displacement of the diaphragms 172, 173 from being applied to a welded portion 177 of the peripheral edge portions 174, 175. For this reason, it is not necessary to press the peripheral edge portions 174, 175 of the diaphragms 172, 173 from above and below. Hence, by engaging only the lower support body 732, which extends from the lower ring-shaped part 291 of the lower support member 702, with the pump body 20, the pulsation damper 170 can be fitted in the fuel chamber 163.

(29th Embodiment)

Figure 56:
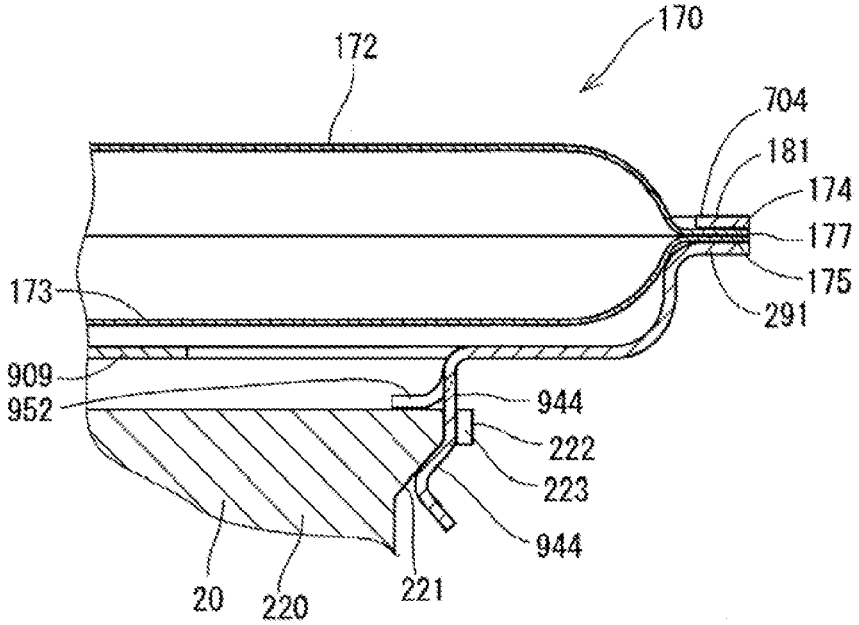
FIG. 56 is a section view, on an enlarged scale, of a main portion of a high pressure pump according to a 29th embodiment.
Figure 57:
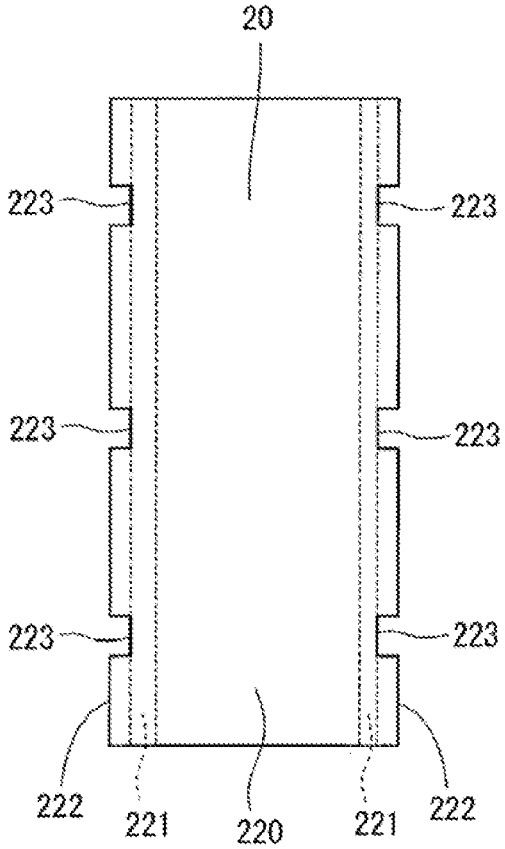
FIG. 57 is a plan view of a pump body according to the 29th embodiment.

A main portion of a high pressure pump according to a 29th embodiment will be shown in FIG. 56 and FIG. 57. FIG. 57 shows a state, when viewed from above, of the pump body 20 in the state where the pump body 20 is not yet fitted with the pulsation damper 170. The pump body 20 is formed in an extruded shape or a drawn shape having a nearly constant cross section vertical to a longitudinal direction. The pump body 20 has a main pump body 220, first flange parts 221, and second flange parts 222. The first flange part 221 projects in the width direction from the main pump body 220. The second flange part 222 projects in the width direction from the first flange part 221. The second flange part 222 has cutout portions 223 at positions corresponding to lower support bodies 944 of a lower support member 909. The lower support body 944 of the lower support member 909 is engaged with the first flange part 221 via the cutout portion 223 of the second flange part 222. The lower support body 944 has its movement limited in the longitudinal direction of the pump body 20 by the cutout portion 223. Further, the lower support member 909 has an elastic part 952. The elastic part 952 has a spring force of pressing the pump body 20. The elastic part 952 lifts up the pulsation damper 170 to the cover member side, so that the lower support body 944 and the first flange part 221 of the pump body 20 are surely fixed to each other. Hence, this can prevent the pulsation damper 170 from rattling.

(30th Embodiment)

Figure 58:
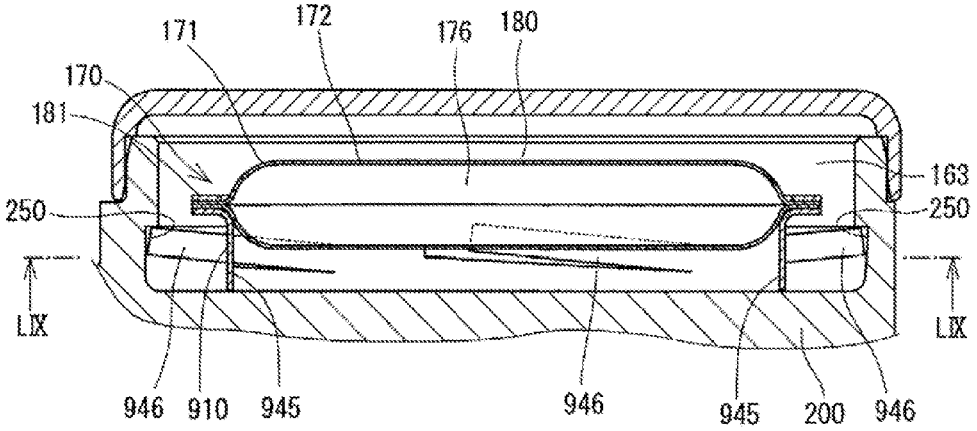
FIG. 58 is a section view, on an enlarged scale, of a main portion of a high pressure pump according to a 30th embodiment.
Figure 59:
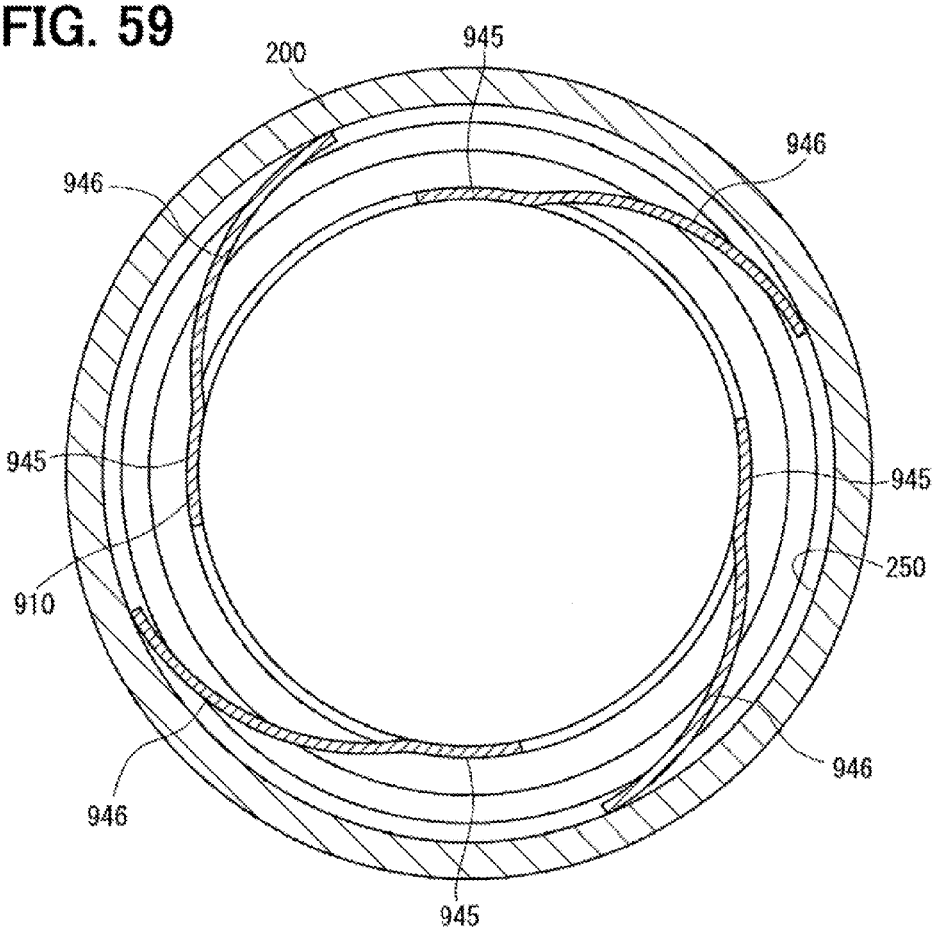
FIG. 59 is a section view taken on a line LIX-LIX in FIG. 58.

A main portion of a high pressure pump according to a 30th embodiment will be shown in FIG. 58 and FIG. 59. In the 30th embodiment, a lower support member 910 has a lower cylinder part 945 and arm parts 946 extending in the peripheral direction and to the outside in the radial direction from the lower cylinder part 945. The arm part 946 is cut out of the lower cylinder part 945 and is bent to the outside in the radial direction. Further, the arm part 946 extends on the slant to the cover member side. The arm part 946 of the lower support member 910 is engaged with a groove portion 250 formed in an inner wall of the pump body 200 positioned outside in the radial direction of the pulsation damper 170. The arm part 946 of the lower support member 910 has a spring force of pressing the groove portion 250 of the pump body 200 to the cover member side. For this reason, the lower cylinder part 945 of the lower support member 910 is pressed onto the pump body 200 that is the bottom of the fuel chamber 163. Hence, this can prevent the pulsation damper 170 from rattling because of the manufacturing tolerances of the arm part 946 and the groove portion 250.

(31st Embodiment)

Figure 60:
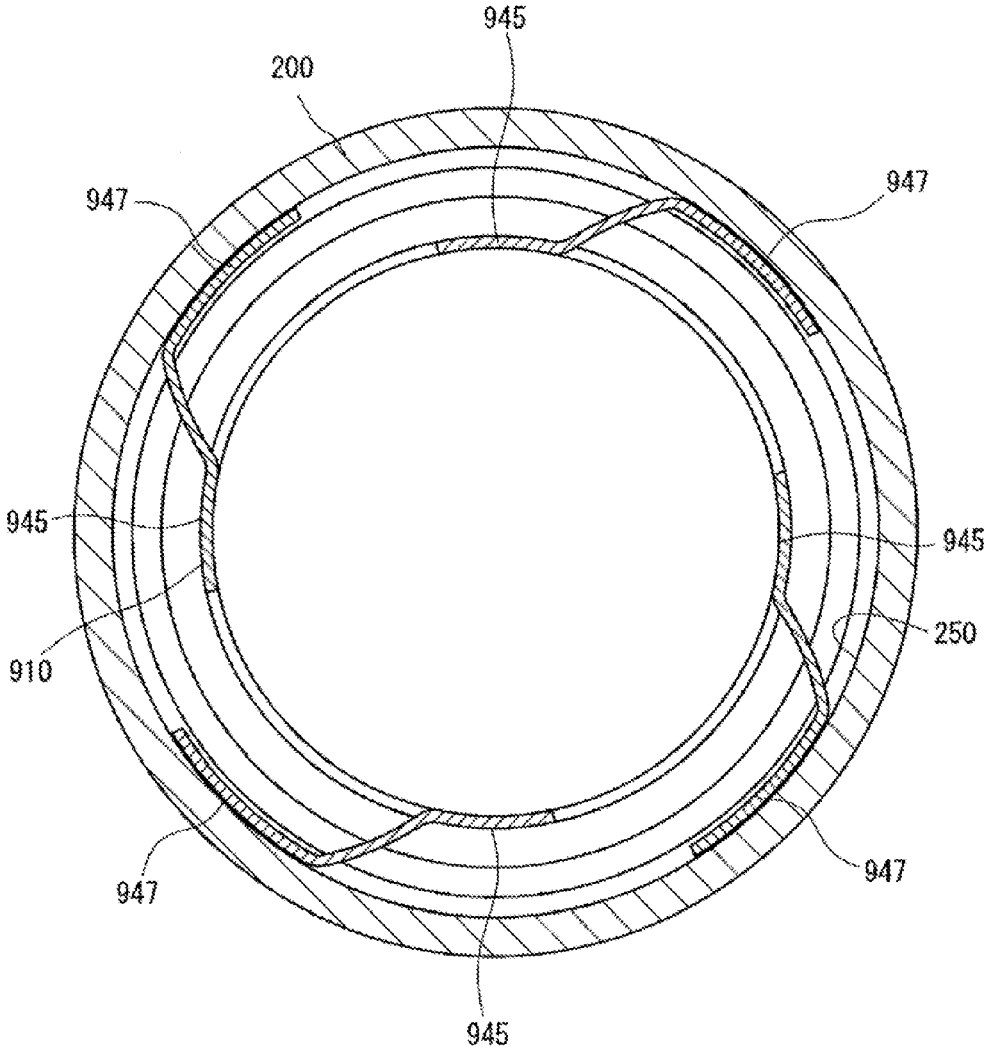
FIG. 60 is a section view, on an enlarged scale, of a main portion of a high pressure pump according to a 31st embodiment.

A main portion of a high pressure pump according to a 31st embodiment will be shown in FIG. 60. In the 31st embodiment, a radius of curvature of an arm part 947 is larger than a radius of curvature of the lower cylinder part 945. The radius of curvature of the arm part 947 is nearly equal to a radius of curvature of the groove portion 250 of the pump body 200. Even this construction can produce the same effects as in the 30th embodiment.

(32nd Embodiment)

Figure 61:
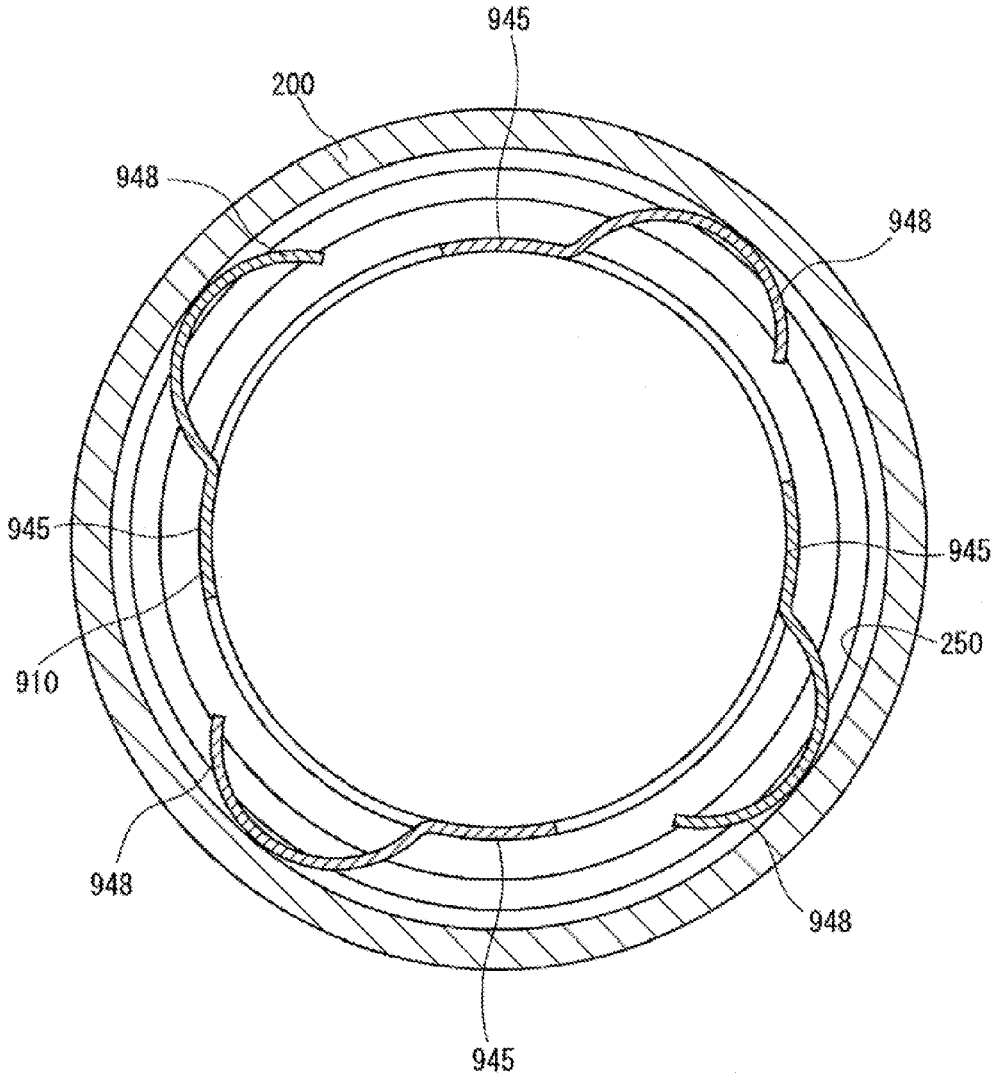
FIG. 61 is a section view, on an enlarged scale, of a main portion of a high pressure pump according to a 32nd embodiment.

A main portion of a high pressure pump according to a 32nd embodiment will be shown in FIG. 61. In the 32nd embodiment, a radius of curvature of an arm part 948 is smaller than the radius of curvature of the groove portion 250 of the pump body 20 and is smaller than the radius of curvature of the lower cylinder part 945. Even this construction can produce the same effects as in the 30th embodiment.

(33rd Embodiment)

Figure 62:
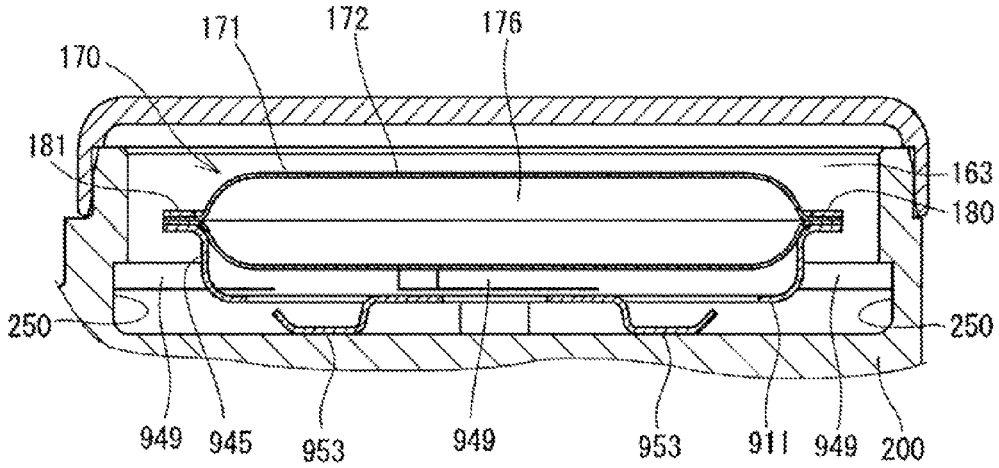
FIG. 62 is a section view, on an enlarged scale, of a main portion of a high pressure pump according to a 33rd embodiment.

A main portion of a high pressure pump according to a 33rd embodiment will be shown in FIG. 62. In the 33rd embodiment, arm parts 949 of a lower support member 911 extend vertically to a central axis of the lower cylinder part 945. Further, the lower support member 911 has elastic parts 953 on the pump body side. The elastic part 953 abuts on the pump body 200 and has a spring force of pressing the pump body 200. In this way, the arm parts 949 of the lower support member 911 are pressed onto to the end face on the cover member side of the groove portion 250. Hence, this can prevent the pulsation damper 170 from rattling.

(34th Embodiment)

Figure 63:
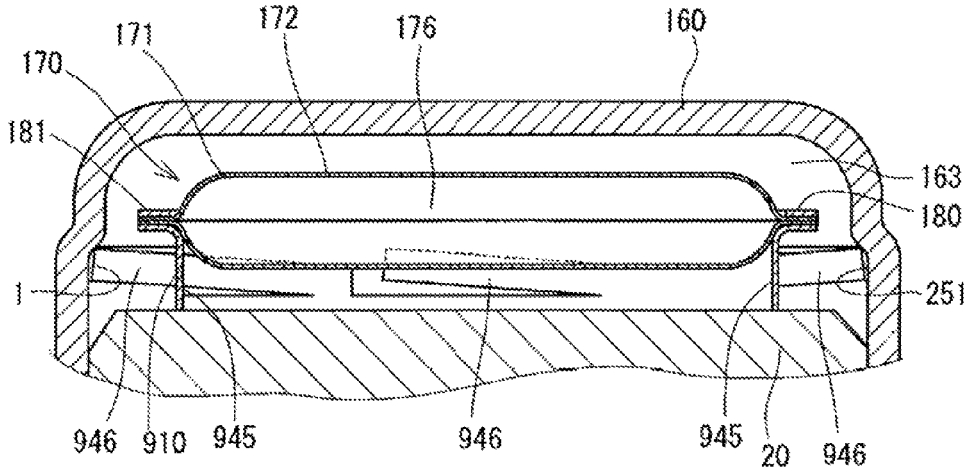
FIG. 63 is a section view, on an enlarged scale, of a main portion of a high pressure pump according to a 34th embodiment.

A main portion of a high pressure pump according to a 34th embodiment will be shown in FIG. 63. In the 34th embodiment, the cover member 160 has a groove portion 251 formed in its inner wall positioned outside in the radial direction of the pulsation damper 170. An arm part 946 of the lower support member 910 is engaged with the groove portion 251 of the cover member 160. The arm part 946 of the lower support member 910 has a spring force of pressing the groove portion 251 of the cover member 160 to a side opposite to the pump body 200. For this reason, the lower cylinder part 945 of the lower support member 160 is pressed onto the pump body 20 that is the bottom of the fuel chamber 163. Hence, this can prevent the pulsation damper 170 from rattling.

(35th Embodiment)

Figure 64:
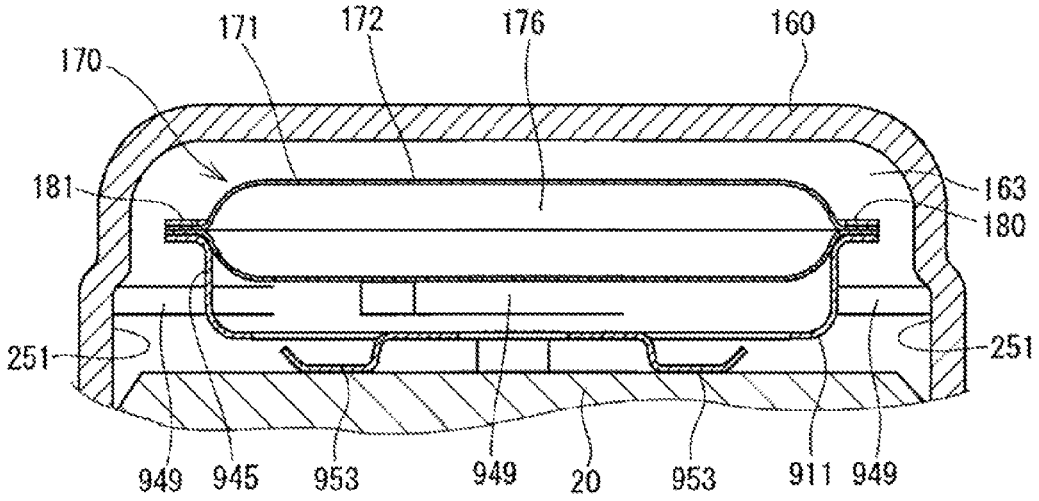
FIG. 64 is a section view, on an enlarged scale, of a main portion of a high pressure pump according to a 35th embodiment.

A main portion of a high pressure pump according to a 35th embodiment will be shown in FIG. 64. In the 35th embodiment, arm parts 949 of a lower support member 911 are engaged with the groove portion 251 of the cover member 160. The lower support member 911 has the elastic parts 953 on the pump body side. The arm parts 949 are pressed onto the end face of the groove portion 251 of the cover member 160. Hence, this can prevent the pulsation damper 170 from rattling.

(36th Embodiment)

Figure 65:
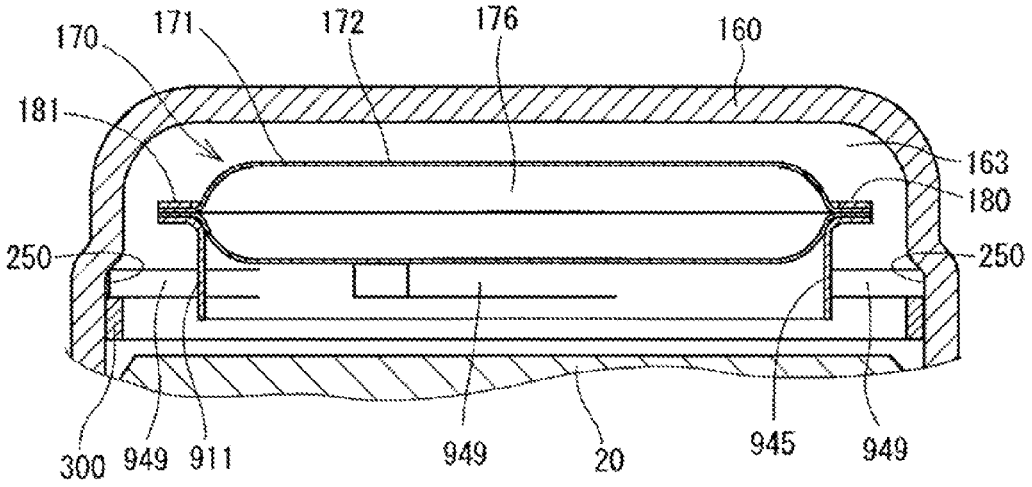
FIG. 65 is a section view, on an enlarged scale, of a main portion of a high pressure pump according to a 36th embodiment.

A main portion of a high pressure pump according to a 36th embodiment will be shown in FIG. 65. In the 36th embodiment, the lower support member 911 has a ring 300 set on the pump body side of the arm part 949 thereof. The ring 300 is pressed and fixed in the groove portion 251 of the cover member 160. In this way, the arm parts 949 of the lower support member 911 are fixed in the groove portion 251. A clearance is made between the lower cylinder part 945 of the lower support member 911 and the pump body 20 and the fuel can flow through the clearance.

(Other Embodiments)

In the 20th embodiment to the 36th embodiment, the lower support body extending from the lower ring-shaped part of the lower support member of the pulsation damper is constructed in such a way as to be engaged with the groove or the hole of the pump body or with the groove of the cover member. In contrast to this, in the other embodiments, the upper support body extending from the upper ring-shaped part of the upper support member of the pulsation damper may be engaged with the groove or the hole formed in the cover member or with the groove and the like of the pump body.

The present disclosure is not limited to the embodiments described above but can be put into practice net only in the combination of the plurality of the embodiments described above but also in other various modes within a scope not departing from the gist of the disclosure.

The present disclosure has been described with reference to the embodiments but it should be understood that the present disclosure is not limited to the embodiments and the structures. The present disclosure includes also various modified embodiments and modifications within an equivalent scope. In addition, it should be recognized that various combinations and modes and other combinations and modes having only one element, more elements, or less elements added to those lie within the scope and spirit of the present disclosure.

What is claimed is:

1. A high pressure pump comprising:

a plunger that is capable of reciprocating in its axial direction;

a cylinder part which includes a pressurizing chamber and receives the plunger in such a way that the plunger is capable of reciprocating;

a pump body that includes a supply part which is configured to supply fuel into the pressurizing chamber, and a discharge part which is configured to discharge fuel pressurized in the pressurizing chamber;

a cover member that covers the pump body and defines a fuel chamber communicating with the supply part;

a pulsation damper body that includes an upper diaphragm and a lower diaphragm with their peripheral edge portions joined to each other, wherein gas having a predetermined pressure is sealed between the upper diaphragm and the lower diaphragm, so that a pressure pulsation in the fuel chamber is reduced;

an upper support member that includes:

an upper ring-shaped part which is joined to the peripheral edge portion of the upper diaphragm;

an upper cover part which forms a radially central part of the upper support member and which extends from the upper ring-shaped part in a planar shape along the upper diaphragm; and an upper support body which extends outward in a radial direction and toward the cover member from the upper cover part and is in contact with the cover member; and a lower support member that includes:

a lower ring-shaped part which is joined to the peripheral edge portion of the lower diaphragm; and a lower support body which extends from the lower ring-shaped part and is in contact with the pump body, wherein the upper ring-shaped part, the peripheral edge portion of the upper diaphragm, the peripheral edge portion of the lower diaphragm, and the lower ring-shaped part are formed parallel to each other and are all joined together continuously in a circumferential direction of the pulsation damper body.

2. The high pressure pump according to claim 1, wherein the lower support body of the lower support member is in contact with a depressed portion or a projected portion of the pump body, and the pulsation damper body is thereby positioned in the fuel chamber.

3. The high pressure pump according to claim 1, wherein:

the upper support body of the upper support member has a spring force of pressing the cover member in a direction opposite to the pump body; and the lower support body of the lower support member has a spring force of pressing the pump body in a direction opposite to the cover member.

4. The high pressure pump according to claim 1, wherein:

the upper ring-shaped part, upper cover part, and the upper support body of the upper support member are formed from a first plate; and the lower ring-shaped part and the lower support body of the lower support member are formed from a second plate, the high pressure pump further comprising:

a fuel passage configured as a hole made in the first plate by cutting out the upper support body from the first plate; and a fuel passage configured as a hole made in the second plate by cutting out the lower support body from the second plate.

5. The high pressure pump according to claim 1, wherein the upper support body of the upper support member extends radially outward of the pulsation damper body from the upper cover part and extends from a radially outward end portion of the upper support body in a circumferential direction of the pulsation damper body to be in contact with the cover member.

6. The high pressure pump according to claim 5, further comprising an elastic member disposed between the upper support body of the upper support member and the cover member.

7. The high pressure pump according to claim 1, wherein:

the cylinder part projects from an end face of the pump body on the fuel chamber-side into the fuel chamber; and the lower support body of the lower support member is in contact with the cylinder part which projects into the fuel chamber, and the pulsation damper body is thereby positioned in the fuel chamber.

8. The high pressure pump according to claim 1, wherein the cover member defines a continuous space in a circumferential direction of the pulsation damper body, and wherein the cover member includes an inner wall which defines the fuel chamber and is located radially outward of the pulsation damper body, the upper support member, and the lower support member.

9. The high pressure pump according to claim 1, wherein the upper support body is in contact with the cover member at a position within the radial extent of the pulsation damper body.

* * * * *